US012305267B2

(12) United States Patent
Rios et al.

(10) Patent No.: US 12,305,267 B2
(45) Date of Patent: May 20, 2025

(54) RAPIDLY SOLIDIFIED ALUMINUM-RARE EARTH ELEMENT ALLOY AND METHOD OF MAKING THE SAME

(71) Applicants: UT-Battelle, LLC, Oak Ridge, TN (US); University of Tennessee Research Foundation, Knoxville, TN (US); Iowa State University Research Foundation, Inc., Ames, IA (US); ECK Industries Incorporated, Manitowoc, WI (US); Lawrence Livermore National Security, LLC, Livermore, CA (US)

(72) Inventors: Orlando Rios, Knoxville, TN (US); Scott McCall, Livermore, CA (US); Ryan Ott, Ames, IA (US); Zachary Cole Sims, Knoxville, TN (US); Michael Kesler, Knoxville, TN (US); Hunter B. Henderson, Knoxville, TN (US); Michael McGuire, Knoxville, TN (US); David Weiss, Manitowoc, WI (US)

(73) Assignees: UT-Battelle, LLC, Oak Ridge, TN (US); University of Tennessee Research Foundation, Knoxville, TN (US); Iowa State University Research Foundation, Inc., Ames, IA (US); ECK Industries Incorporated, Manitowoc, WI (US); Lawrence Livermore National Security, LLC, Livermore, CA (US)

( * ) Notice: Subject to any disclaimer, the term of this patent is extended or adjusted under 35 U.S.C. 154(b) by 509 days.

(21) Appl. No.: 15/901,759

(22) Filed: Feb. 21, 2018

(65) Prior Publication Data

US 2018/0237893 A1 Aug. 23, 2018

Related U.S. Application Data

(60) Provisional application No. 62/616,658, filed on Jan. 12, 2018, provisional application No. 62/461,899, filed on Feb. 22, 2017.

(51) Int. Cl.
*C22F 1/00* (2006.01)
*B22D 17/22* (2006.01)
(Continued)

(52) U.S. Cl.
CPC ..... *C22F 1/002* (2013.01); *B22D 17/2218* (2013.01); *B22D 21/007* (2013.01);
(Continued)

(58) Field of Classification Search
CPC .... C22F 1/00; C22F 1/002; C22F 1/02; C22F 1/04–05; B22D 17/2218; B22D 30/00;
(Continued)

(56) References Cited

U.S. PATENT DOCUMENTS 1,960,916 A 5/1934 Murphey et al.
2,656,270 A * 10/1953 Russell ..... C22C 21/00 420/529
(Continued)

FOREIGN PATENT DOCUMENTS

CN 103509977 A 1/2014
CN 104004947 A 8/2014
(Continued)

OTHER PUBLICATIONS

Gallo, et al; "Aluminum fluxes and fluxing practices", ASM Handbook, 2008, vol. 15, pp. 230-239 (Year: 2008).*
(Continued)

*Primary Examiner* — Alexandra M Moore
*Assistant Examiner* — Austin Pollock
(74) *Attorney, Agent, or Firm* — Klarquist Sparkman, LLP

(57) ABSTRACT

Disclosed herein are embodiments of rapidly solidified alloys that comprise aluminum, a rare earth element, one or more additional alloying elements, such as aluminum, and
(Continued)

an optional additive component. The alloy embodiments exhibit a unique microstructure as compared to microstructures obtained from other alloys that are not rapidly cooled. The disclosed aluminum-rare earth element alloys also exhibit improved mechanical properties without the need for post-processing heat treatments and further do not exhibit substantial coarsening.

11 Claims, 43 Drawing Sheets

(51) Int. Cl.

| | |
|---|---|
| ***B22D 21/00*** | (2006.01) |
| ***C22C 1/02*** | (2006.01) |
| ***C22C 1/11*** | (2023.01) |
| ***C22C 21/00*** | (2006.01) |
| ***C22C 21/06*** | (2006.01) |
| ***C22C 45/08*** | (2006.01) |
| ***C22F 1/04*** | (2006.01) |
| ***C22F 1/047*** | (2006.01) |

(52) U.S. Cl.
CPC ..... *C22C 1/026* (2013.01); *C22C 1/11* (2023.01); *C22C 21/00* (2013.01); *C22C 21/06* (2013.01); *C22C 45/08* (2013.01); *C22F 1/04* (2013.01); *C22F 1/047* (2013.01); *C22C 2200/02* (2013.01)

(58) Field of Classification Search
CPC . B22D 21/00–007; C22C 1/002; C22C 1/026; C22C 21/00; C22C 21/06–08; C22C 45/08
See application file for complete search history.

(56) References Cited

U.S. PATENT DOCUMENTS 4,379,719 A * 4/1983 Hildeman ..... C22C 1/0416 419/1
4,464,199 A * 8/1984 Hildeman ..... C22C 1/0416 419/28
4,787,943 A * 11/1988 Mahajan ..... B22F 9/008 148/437
4,915,869 A 4/1990 Aubert et al.
4,950,452 A * 8/1990 Masumoto ..... C22C 45/08 148/438
5,037,608 A 8/1991 Tarcy et al.
5,074,935 A * 12/1991 Masumoto ..... C22C 45/08 148/403
5,154,780 A * 10/1992 Premkumar ..... C22C 21/00 148/437
5,264,021 A * 11/1993 Kita ..... C22C 1/0416 148/438
5,318,642 A * 6/1994 Kita ..... B22D 11/003 148/437
5,320,688 A * 6/1994 Masumoto ..... C22C 45/08 148/403
5,431,751 A 7/1995 Okochi et al.
3,252,841 A 5/1996 Foerster
5,578,144 A * 11/1996 Satou ..... C22C 21/00 148/415
5,647,919 A * 7/1997 Kita ..... C22C 21/00 148/437
5,900,210 A * 5/1999 Buchler ..... C22C 45/08 420/548
6,231,808 B1 * 5/2001 Hashikura ..... C22C 1/0416 420/528
6,248,453 B1 * 6/2001 Watson ..... C22C 21/00 148/437
7,811,395 B2 10/2010 Pandey
7,875,131 B2 * 1/2011 Pandey ..... C22C 21/00 148/403
9,079,211 B1 7/2015 Deshpande et al.
9,394,596 B2 7/2016 Kramer et al.
9,963,770 B2 * 5/2018 Rios ..... B22D 7/005
11,383,296 B2 * 7/2022 Wagstaff ..... B22D 11/18
2003/0183306 A1 10/2003 Hehmann et al.
2004/0156739 A1 * 8/2004 Song ..... C22C 1/026 420/528
2004/0238150 A1 12/2004 Adachi et al.
2005/0199318 A1 * 9/2005 Doty ..... C22C 21/02 148/439
2005/0271543 A1 12/2005 Pfannen-Mueller et al.
2008/0219882 A1 * 9/2008 Woydt ..... B22D 21/007 420/544
2009/0263266 A1 * 10/2009 Pandey ..... C22C 21/00 419/25
2009/0288796 A1 11/2009 Song et al.
2010/0226817 A1 9/2010 Pandey
2010/0282428 A1 11/2010 Pandey
2012/0058353 A1 3/2012 Komiyama et al.
2012/0152414 A1 6/2012 Che et al.
2013/0312876 A1 * 11/2013 Palm ..... C22C 21/06 148/549
2014/0326368 A1 11/2014 Okamoto
2015/0135897 A1 5/2015 Sutkliffe et al.
2016/0053346 A1 2/2016 Szuromi et al.
2017/0096730 A1 4/2017 Rios et al.
2018/0237893 A1 8/2018 Rios et al.
2018/0291489 A1 10/2018 Mann et al.
2019/0085431 A1 3/2019 Rios et al.
2021/0032727 A1 2/2021 Chehab
2021/0276099 A1 9/2021 Chehab

FOREIGN PATENT DOCUMENTS

CN 104711464 A * 6/2015
CN 109797326 A 5/2019
CN 114438383 A 5/2022
DE 10 2011 111365 2/2013
JP 06184712 A 7/1994
JP H07 268597 10/1995
JP 3392509 B2 3/2003
WO WO 02/086175 A1 10/2002
WO WO-2011035653 A1 * 3/2011 ..... C22F 1/057
WO WO 2017/007908 1/2017
WO WO 2018/119283 A1 6/2018
WO WO 2018/156651 A1 8/2018
WO WO 2019155180 8/2019

OTHER PUBLICATIONS

Raghavan V.; "Al—Ce—Mg (Aluminum-Cerium-Magnesium)", ASM International, 2007, p. 453-455 (Year: 2007).*
Prakash U., et al.; The effect of Mg Addition on Microstructure and Tensile and Stress Rupture Properties of a P/M Al—Fe—Ce alloy; Scripta Materialia, vol. 39., No. 7, pp. 867-872, 1998 (Year: 1998).*
Fodran E.; "Microstructural Evolution and Thermal Stability of Al—Ce—Ni Ternary Eutectic"; Dissertation from University of Florida, 2002 (Year: 2002).*
Czerwinski F., et al.; "On the Al—Al11Ce3 Eutectic Transformation in Aluminum-Cerium Binary Alloys"; J. Materials, 13, 2020 (Year: 2020).*
Park H., et al.; Effect of Fe additions on microstructure and mechanical properties in near-eutectic Al-Ce Alloys; j. of Materials Science & Engineering A; 88, 2023 (Year: 2023).*
Bakke et al., "Improving the Strength and Ductility of Magnesium Die-Casting Alloys via Rare-Earth Addition," *The Journal of the Minerals, Metals & Materials Society*, 55(11): 46-51, Nov. 2003.
Cecchinato et al., "Influence of Magnesium Alloy Degradation on Undifferentiated Human Cells," *PLOS One*, 10(11): 1-18, Nov. 23, 2015.
International Search Report and Written Opinion issued for International Application No. PCT/US2016/41293 dated Nov. 17, 2016.
Plotkowski et al., "Evaluation of an Al—Ce alloy for laser additive manufacturing," *Acta Materialia*, vol. 126, pp. 507-519, Dec. 27, 2016.

(56) References Cited

OTHER PUBLICATIONS

Sims et al., "Cerium-Based, Intermetallic-Strengthened Aluminum Casting Alloy: High-Volume Co-product Development," *The Minerals, Metals & Materials Society*, 68(7): 1940-1947, May 23, 2016.
Sims et al., "High performance aluminum-cerium alloys for high-temperature applications," *Materials Horizons*, 4(6): 1070-1078, Aug. 1, 2017.
Zhang, "Effect of substituting cerium-rich mischmetal with lanthanum on microstructure and mechanical properties of die-cast Mg—Al—Re alloys," *Materials and Design*, 30(7): 2372-2378, Aug. 2009.
International Search Report and Written Opinion issued for International Application No. PCT/US2017/042208 dated Oct. 20, 2017.
International Search Report and Written Opinion issued for International Application No. PCT/US2018/019046 dated Jul. 17, 2018.
International Search Report and Written Opinion issued for International Application No. PCT/US2018/051218 dated Dec. 21, 2018.
Yao et al., "Effects of La on the age hardening behavior and precipitation kinetics in the cast Al—Cu alloy," *Journal of Alloys and Compounds*, 540(5): 154-158, Jun. 26, 2012.
Fan et al., "Dual characteristic of trace rare earth elements in a commercial casting Al—Cu-X alloy," *Rare Metals*, 34(5): 308-313, May 2015.
Yao et al., "Phase relations in the Cu-poor part of the Ce—Al—Cu system at 503 K," *Journal of Alloys and Compounds*, 484(1-2): 86-89, Sep. 18, 2009.
Jin et al., "Thermodynamic evaluation and optimization of Al—La, Al—Ce, Al—Pr, Al—Nd and Al—Sm systems using the Modified Quasichemical Model for liquids," *CALPHAD: Computer Coupling of Phase Diagrams and Thermochemistry*, 35(1): 30-41, Dec. 14, 2010.
Kang et al., "Critical evaluation and thermodynamic optimization of the Al—Ce, Al—Y, Al—Sc and Mg—Sc binary systems," *Computer Coupling of Phase Diagrams and Thermochemistry*, 32(2): 413-422, Mar. 27, 2008.
Meng et al., "Thermodynamic optimization of the Al—Yb binary system," *Journal of Alloys and Compounds*, 452(2): 279-282, Dec. 5, 2006.
Riani et al., "Ternary rare-earth aluminum systems with copper: a review and a contribution to their assessment," *Journal of Phase Equilibria and Diffusion*, 25(1): 22-52, Feb. 2004.
Van Dalen et al., "Erbium and ytterbium solubilities and diffusivities in aluminum as determined by nanoscale characterization of precipitates," *Acta Materialia*, 57(14): 4081-4089, Jun. 6, 2009.
Abbas, "Effect of high-power diode laser surface melting on wear resistance of magnesium alloys," *Wear*, vol. 260, pp. 175-180, May 10, 2005.
Audebert et al., "Production of glassy metallic layers by laser surface treatment," *Scripta Materialia*, 48(3):281-286, Feb. 2003.
Chen et al., "Mechanical Properties of Nanometric Al2O3 Particulate-Reinforced Al-Al11Ce3 Composites Produced by Friction Stir Processing," *Materials Transactions*, 51(5):933-938, Apr. 7, 2010.
Davis, "Aluminum and Aluminum Alloys," *ASM International*, pp. 1-2, 18, and 309-310 (1993).
Debroy et al., "Additive Manufacturing of Metallic Components—Process, Structure and Properties," *Progress in Materials Science*, vol. 92, pp. 112-224 (2018).
Dudas et al., "Preventing Weld Cracks in High-Strength Aluminum Alloys," Weld. Res., vol. 45, pp. 241-249 (Jun. 1966).
Eskin et al., "A Quest for a New Hot Tearing Criterion," Metall. Mater. Trans. A Phys. Metall. Mater. Sci., vol. 38A, pp. 1511-1519 (Jul. 2007).
Final Office Action issued for U.S. Appl. No. 16/132,231 on Dec. 27, 2021 (13 pages).
Final Office Action issued for U.S. Appl. No. 16/132,231 on Jan. 25, 2023 (12 pages).
Frazier, "Metal Additive Manufacturing: A Review," J. Mater. Eng. Perform., vol. 23(6), pp. 1917-1928 (Jun. 2014).
Graham et al., "Coarsening of Eutectic Microstructures at Elevated Temperatures," Transactions of the Metallurgical Society of AIME, vol. 236, pp. 94-102, Jan. 1966.
International Search Report and Written Opinion issued for International Application No. PCT/US2017/042203 on Oct. 20, 2017.
International Search Report and Written Opinion issued for International Application No. PCT/US2018/019046 on May 9, 2018, 21 pages.
Jun et al., "Characterization and wear resistance of laser surface melting AZ91D alloy," *Journal of Alloys and Compounds*, vol. 455, pp. 142-147, Jan. 16, 2007.
Kou, "A Criterion for Cracking During Solidification," Acta Mater., vol. 88, pp. 366-374 (2015).
Kou, "A Simple Index for Predicting the Susceptibility to Solidification Cracking," Weld. J., vol. 94, pp. 374-388 (Dec. 2015).
Kou, "Welding Metallurgy, Second Edition," John Wiley & Sons, Inc., Hoboken, NJ, 466 pages (2003).
Knipling et al., "Criteria for developing castable, creep-resistant aluminum-based alloys—A review," *Z. Metallkd.*, 97(3):246-265, Mar. 2006.
Lewandowski et al., "Metal Additive Manufacturing: A Review of Mechanical Properties," Annu. Rev. Mater. Res., vol. 46, pp. 151-186 (2016).
Li et al., "Corrosion mechanism associated with T1 and T2 precipitates of Al—Cu—Li alloys in NaCl solution", Journal of Alloys and Compounds, 460, pp. 688-693 (2008).
Lin et al., "Hot-Tear Susceptibility of Aluminum Wrought Alloys and the Effect of Grain Refining," Metall. Mater. Trans. A Phys. Metall. Mater. Sci., vol. 38, pp. 1056-1068 (2007).
Manca et al., "Microstructure and Properties of Novel Heat Resistant Al—Ce—Cu Alloy for Additive Manufacturing," *Metals and Materials International*, 8 pages (Nov. 2018) [available online: https://doi.org/10.1007/s12540-018-00211-0].
Miller et al., "Recent Development in Aluminum Alloys for the Automotive Industry," Mater. Sci. Eng. A., vol. 280, pp. 37-49 (2000).
Non-Final Office Action issued for U.S. Appl. No. 16/132,231 on Jun. 15, 2021, 15 pages.
Non-Final Office Action issued for U.S. Appl. No. 16/132,231 on Jun. 16, 2022 (14 pages).
Phillion et al., "A New Methodology for Measurement of Semi-Solid Constitutive Behavior and its Application to Examination of As-Cast Porosity and Hot Tearing in Aluminum Alloys," pp. 1-24 (also published as PHILLION et al., "A New Methodology for Measurement of Semi-Solid Constitutive Behavior and its Application to Examination of As-Cast Porosity and Hot Tearing in Aluminum Alloys," Mater. Sci. Eng. A., vol. 491, pp. 237-247 (2008).
Plotkowski et al., "Corrigendum to 'Evaluation of an Al-Ce alloy for additive manufacturing," [Acta Mater. 126 (2017) 507-519] *Acta Materialia*, vol. 159, pp. 439-441, Aug. 22, 2018.
Raghavan, "Al-Cu-Li (Aluminum-Copper-Lithium)", Journal of Phase Equilibria and Diffusion, vol. 31, No. 3, pp. 288-290 (2010).
Rappaz et al., "A New Hot-Tearing Criterion," Metall. Mater. Trans. A., vol. 30A, pp. 449-455 (Feb. 1999).
Sames et al., "The Metallurgy and Processing Science of Metal Additive Manufacturing," pp. 1-76 (also published as SAMES et al., "The Metallurgy and Processing Science of Metal Additive Manufacturing," Int. Mater. Rev., vol. 61, pp. 315-360 (2016).
Sims et al., "Characterization of Near Net-Shape Castable Rare Earth Modified Aluminum Alloys for High Temperature Application," *Light Metals*, ed. Edward Williams, pp. 111-114, 2016.
Tomida et al., "Improvement in wear resistance of hyper-eutectic Al-Si cast alloy by laser surface remelting," *Surface and Coatings Technology*, vol. 169-170, pp. 468-471, 2003.
Trevisan, "On the Selective Laser Melting (SLM) of the AlSi10Mg Alloy: Process, Microstructure, and Mechanical Properties," *Materials*, 10(76):1-23, Jan. 2017.
Yilmaz et al., "The microstructure and mechanical properties of unidirectionally solidified Al-Si alloys," *Journal of Materials Science*, vol. 24, pp. 2065-2070, 1989.

* cited by examiner

RAPIDLY SOLIDIFIED ALUMINUM-RARE EARTH ELEMENT ALLOY AND METHOD OF MAKING THE SAME

CROSS REFERENCE TO RELATED APPLICATION

This application claims the benefit of the earlier filing date of U.S. Provisional Patent Application No. 62/461,899, filed on Feb. 22, 2017, and U.S. Provisional Patent Application No. 62/616,658, filed on Jan. 12, 2018; the entirety of each of these prior applications is incorporated herein by reference.

ACKNOWLEDGMENT OF GOVERNMENT SUPPORT

This invention was made with government support under Contract Nos. DE-AC05-00OR22725 and DE-AC02-07CH11358 awarded by the United States Department of Energy and Contract No. DE-AC52-07NA27344 between the United States Department of Energy and Lawrence Livermore National Security, LLC for the operation of Lawrence Livermore National Laboratory. The government has certain rights in the invention.

PARTIES TO JOINT RESEARCH AGREEMENT

The invention arose under an agreement between UT-Battelle, LLC, Lawrence Livermore National Security, LLC, and Ames National Security, LLC, and funded by the Critical Materials Institute of the United States Department of Energy, which agreement was in effect on or before the effective filing date of the claimed invention.

FIELD

Disclosed herein are embodiments of aluminum alloy compositions comprising one or more rare earth elements and methods of making the same.

BACKGROUND

Alloy processing methods, like die casting (and particularly high pressure die-casting, or "HPDC") can be used to mass produce cast aluminum parts. Die casting accounted for nearly half of all aluminum castings in 2015, with production of 1.5 billion pounds. Currently available aluminum alloys and processing methods, however, only provide alloys that have moderate mechanical properties. Further, these alloys require using post-processing heat treatments to obtain suitable properties, which increases complexity and cost of alloy processing methods. There exists a need in the art for alloying compositions that can be used in alloying processes that can avoid heat treatment steps without sacrificing alloy stability and strength.

SUMMARY

Disclosed herein are embodiments of a rapidly solidified alloys, which typically comprise aluminum and a rare earth element, and methods of making the same. In some embodiments, the alloys further comprise magnesium and can also comprise one or more additive components. The rapidly solidified alloy embodiments described herein exhibit unique microstructural features and properties that distinguish them from other aluminum-containing alloys. The rapidly solidified alloys are made using methods that do not require post-processing heat treatments. In particular disclosed embodiments, the alloys can be made using a die-casting method.

The foregoing and other objects, features, and advantages of the present disclosure will become more apparent from the following detailed description, which proceeds with reference to the accompanying figures.

BRIEF DESCRIPTION OF THE DRAWINGS

FIGS. 18A-18C are SEM backscatter images from three points within an Al-12Ce-0.4Mg-1Fe wedge mold sample, wherein FIG. 18A shows three different magnifications of the sample having microstructural features obtained from a slow cooling rate; FIG. 18B shows three different magnifications of the sample having microstructural features obtained from a moderate cooling rate; and FIG. 18C shows three different magnifications of the sample having microstructural features obtained from a high cooling rate; the symbols included in the lower images of FIG. 18A-18C represent different compositional phases, which are summarized in Table 1 herein.

FIGS. 22A-22F provide images of a die-cast alloy embodiment wherein FIG. 22A is an x-ray radiograph of a die cast plate; FIG. 22B is a schematic illustration of a die cast part specifying representative locations from which SEM backscatter images (FIGS. 22D-22F) were obtained; FIG. 22C is an SEM backscatter image showing the Al-12Ce binary microstructure obtained from a sand casted alloy; and FIGS. 22D-22F show SEM backscatter images from a Al-12Ce-1Fe-0.4Mg alloy embodiment, which illustrate changes in the microstructure as cooling rate increases (FIG. 22D shows the microstructure obtained from rapid cooling; FIG. 22E shows the microstructure obtained from a less rapid cooling rate; and FIG. 22F shows the microstructure obtained from a slow cooling rate).

DETAILED DESCRIPTION

I. Overview of Terms

Figure 1:
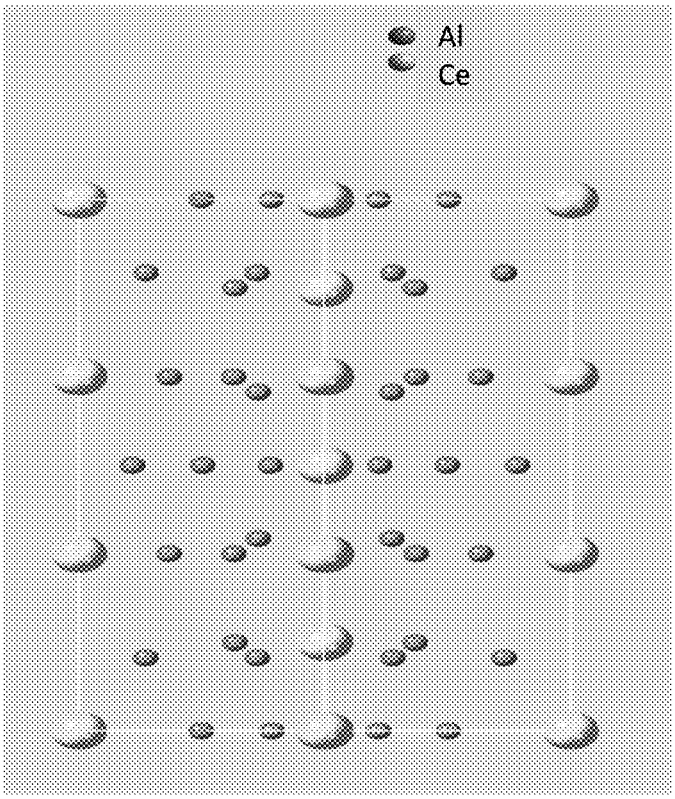
FIG. 1 is an illustration of the crystal structure of $Al_{11}Ce_3$.

The following explanations of terms are provided to better describe the present disclosure and to guide those of ordinary skill in the art in the practice of the present disclosure. As used herein, "comprising" means "including" and the singular forms "a" or "an" or "the" include plural references unless the context clearly dictates otherwise. The term "or" refers to a single element of stated alternative elements or a combination of two or more elements, unless the context clearly indicates otherwise.

Unless explained otherwise, all technical and scientific terms used herein have the same meaning as commonly understood to one of ordinary skill in the art to which this disclosure belongs. Although methods and compounds similar or equivalent to those described herein can be used in the practice or testing of the present disclosure, suitable methods and compounds are described below. The compounds, methods, and examples are illustrative only and not intended to be limiting, unless otherwise indicated. Other features of the disclosure are apparent from the following detailed description and the claims.

Unless otherwise indicated, all numbers expressing quantities of components, molecular weights, percentages, temperatures, times, and so forth, as used in the specification or claims are to be understood as being modified by the term "about." Accordingly, unless otherwise indicated, implicitly or explicitly, the numerical parameters set forth are approximations that can depend on the desired properties sought and/or limits of detection under standard test conditions/methods. When directly and explicitly distinguishing embodiments from discussed prior art, the embodiment numbers are not approximates unless the word "about" is recited. Furthermore, not all alternatives recited herein are equivalents.

In some embodiments, reference is made herein to microstructures and/or alloys that do not exhibit "substantial coarsening" when being formed during process using rapid cooling rates and/or after exposure to a post-casting process. That is, the microstructures and/or alloys are able to resist coarsening during such processes. In some embodiments, a lack of "substantial coarsening" means that the morphological features of the alloy are resistant to coarsening such that (for example) the average thickness of the morphological features, the average number density of features, the average spacing (e.g., eutectic interlamellar spacing) of the morphological features, or a combination thereof may increase by less than 100%, less than 50%, less than 20%, less than 15%, less than 10%, or less than 5% after subjecting the alloy to a temperature of 300° C. for 24 hours. In independent embodiments, the average cross section of the morphological features may increase by less than 50% after subjecting the cast alloy as described herein to a temperature of 300° C. for 24 hours. In some additional embodiments, an alloy (or microstructure thereof) disclosed herein lacks "substantial coarsening" after/during exposure to an environment at temperatures ranging from 150° C. to 500° C. for 24 hours and even up to 1500 hours. In yet some additional embodiments, coarsening is not substantial when coarsening of less than 50% (as evidenced by increased thickness, spacing, and/or cross-section of morphological feature), such as coarsening of less than 40%, less than 30%, or less than 20% occurs when the cast alloy is exposed to a temperature of 300° C. for 1,000 hours. In yet some additional embodiments, lacking "substantial coarsening" means that spacing of lamellae and/or particles does not increase over 24 hours at 300° C. Without wishing to be bound by a particular theory of operation, much of the resistance to coarsening can be attributed to low mobility of the rare-earth element in the aluminum matrix. A person of ordinary skill in the art, with the benefit of this disclosure, recognizes when a microstructure or an alloy does not exhibit substantial coarsening as this can be evaluated using optical microscopy and/or SEM analysis. For example, a person of ordinary skill in the art can compare an SEM or optical micrograph of the inventive alloy embodiments disclosed herein (and the microstructures thereof) with an SEM or optical micrograph of an alloy free of a rare earth element (e.g., Al—Si alloys) and/or an alloy that has not been rapidly cooled, and readily recognize that the inventive cast alloys exhibit little to no coarsening (that is, it does not exhibit substantial coarsening), whereas the comparative alloy exhibits substantial coarsening.

The notation "Al-aX," as used in certain embodiments described herein, indicates the composition of the alloy, where "a" is the percent by weight of the rare earth component X in the Al-aX alloy. For example, Al-12Ce indicates an alloy of 12 wt % Ce with the balance being aluminum.

The following terms and definitions are provided:

Additional Alloying Elements: Elements, typically metals, that can be included in the alloy and that are other than aluminum, a rare earth element (or mischmetal), and an additive component. In some embodiments, additional alloying elements can be selected from zinc, titanium, zirconium, vanadium, copper, nickel, scandium, or any combinations thereof.

Additive Component: A component that is present in certain embodiments of the alloys described herein and that can form a binary, ternary, or other such complex with aluminum when a rapid cooling rate is used to cool the alloy and further prevents the alloy from sticking to or interacting with a mold component. In some embodiments, the additive component can be iron, strontium, silicon, boron, manganese, titanium, chromium, cobalt, carbon, or any combinations thereof.

Alloy: A solid or liquid mixture of two or more metals, or of one or more metals with certain metalloid elements.

Aluminum Matrix: The primary aluminum phase in the alloy, i.e., the alloy phase having aluminum atoms arranged in a face-centered cubic structure, optionally with other elements in solution in the aluminum structure.

Cellular breakdown: A microstructural feature defined by local areas of aluminum matrix surrounded by a substantially fully connected or substantially fully interconnected structure of intermetallic or other phase.

Degassing: A processing step wherein dissolved gasses are removed from the molten material to increase total material density and limit final product porosity.

Dendrite: A characteristic tree-like structure of crystals that grows as molten metal solidifies.

Eutectic Structure/Composition: A homogeneous solid mix of atomic and/or chemical species forming a super lattice having a unique molar ratio between the components. At this molar ratio, the mixtures melt as a whole at a specific temperature—the eutectic temperature. At other molar ratios, one component of the mixture will melt at a first temperature and the other component(s) will melt at a higher temperature.

Fluxing: A processing step wherein impurities are removed from a molten composition by the addition and subsequent removal of reactive halide or phosphor substances to thereby purge impurities from the molten composition.

Intermetallic phase: A solid-state compound containing two or more metallic elements and exhibiting metallic bonding, defined stoichiometry and/or ordered crystal structure, optionally with one or more non-metallic elements. In some instances, an alloy may include regions of a single metal and regions of an intermetallic phase. Ternary and quaternary alloys may have other intermetallic phases including other alloying elements.

Lamella: A thin layer or plate-like structure.

Master Alloy: A feedstock material which has been premixed and solidified into ingots for remelting and part production. In some embodiments, master alloys can be complete mixtures comprising all required elemental additions. In some other embodiments, master alloys can be partial mixtures of elemental elements to which are added additional elements during final processing to bring alloy compositions to the desired final compositions.

Microstructure: The structure of an alloy (e.g., grains, cells, dendrites, rods, laths, lamellae, precipitates, etc.) that can be visualized and examined with a microscope at a magnification of at least 25×. Microstructure can also include nanostructure, i.e., structure that can be visualized and examined with more powerful tools, such as electron microscopy, atomic force microscopy, X-ray computed tomography, etc.

Mischmetal: An alloy of rare earth elements, typically comprising 47-70 wt % cerium and from 25-45 wt % lanthanum. Mischmetal may further include small amounts of neodymium, praseodymium, and/or trace amounts (i.e., less than 1 wt %) of other rare earth elements, and may include small amounts (i.e., up to a total of 15 wt %) of impurities such as Fe or Mg. In some examples, mischmetal comprises 47-70 wt % Ce, 25-40 wt % La, 0.1-7 wt % Pr, 0.1-17 wt % Nd, up to 0.5 wt % Fe, up to 0.2 wt % Si, up to 0.5 wt % Mg, up to 0.02 wt % S, and up to 0.01 wt % P. In certain examples, mischmetal comprises 50 wt % cerium, 25-30 wt % La, with the balance being other rare-earth metals. In one example, mischmetal comprises 50 wt % Ce, 25 wt % La, 15 wt % Nd, and 10 wt % other rare earth elements and/or iron. In an independent example, mischmetal comprises 50 wt % Ce, 25 wt % La, 7 wt % Pr, 3 wt % Nd, and 15 wt % Fe. In any embodiments where the mischmetal contains an element that also may serve as an additive component (e.g., Fe), the amount of that element contained in the mischmetal is not intended to be included in the total amount of the additive component used.

Moderate Cooling Rate: A cooling rate used during an alloying process wherein the temperature is decreased at an average rate ranging from 1 K/s to less than 10 K/s.

Molten: As used herein, a metal is "molten" when the metal has been converted to a liquid form by heating. In some embodiments, the entire amount of metal present may be converted to a liquid or only a portion of the amount of metal present may be converted to liquid (wherein a portion comprises greater than 0% and less than 100% [wt % or vol %] of the amount of metal, such as 90%, 85%, 80%, 70%, 60%, 50%, 40%, 30%, 20%, 10%, 5%, and the like.

Pouring Temperature: A temperature at which an alloy's material rheology exhibits sufficient properties so that the alloy can be poured into a mold. In particular disclosed embodiments of the disclosed aluminum alloys, the pouring temperature can range between 690° C. and 800° C.

Rapidly Solidified Alloy: An alloy that has been solidified using a rapid cooling rate. Rapidly solidified alloys of the present disclosure have microstructures that differ from those found in alloys that have been solidified at moderate cooling rates and/or slow cooling rates.

Rapid Cooling Rate: A cooling rate used during an alloying process wherein the temperature of the alloy is decreased at an average rate that is above the range of a slow or moderate cooling rate. Exemplary rapid cooling rate ranges are described herein.

Rare Earth Element: As used herein, this term refers to a component comprising one or more rare earth elements. As defined by IUPAC and as used herein, the term rare earth element includes the 15 lanthanide elements, scandium, and yttrium (Sc, Y, La, Ce, Pr, Nd, Pm, Sm, Eu, Gd, Tb, Dy, I, Er, Tm, Yb, or Lu).

Semi-Eutectic Structure: A structure similar to a fully eutectic structure, but with deviations. In some embodiments, a semi-eutectic structure can comprise a dendritic/cellular-type structure.

Slow Cooling Rate: A cooling rate used during an alloying process wherein the temperature is decreased at a rate ranging from greater than 0 K/s to less than 1 K/s.

Theoretical Density: A material density that assumes no material defects or impurities are present. Theoretical density often is used as a measure of the purity of a material. In some embodiments, actual materials can deviate from theoretical density due to inclusion of dissolved gases or other trace impurities.

Vickers Hardness: A hardness measurement determined by indenting the test material with a pyramidal indenter, particular to Vickers hardness testing units, subjected to a load of 50 to 1000 gf for a period of time and measuring the resulting indent size. Vickers hardness may be expressed in units of HV. In particular disclosed embodiments, the Vickers hardness can be measured by as measured by ASTM method E384.

Yield Strength (or Yield Stress): The stress a material can withstand without permanent deformation; the stress at which a material begins to deform plastically.

II. Introduction

Heat treatments used in alloy processing are necessary to obtain alloys having suitable properties (e.g., mechanical strength and/or stability) for use in a variety of applications. In some processing methods, parts are required to go through at least three heat treatment steps, which include heating bulk parts to above 500° C. for at least two hours followed by an aggressive quench and a subsequent long aging heat-treatment (below 300° C.). The reduction or elimination of these processes can produce greener, lower cost components and allow manufacturers to optimize the use of floor space in other production equipment; however, currently available alloys do not exhibit sufficient performance properties without these heat treatments.

Disclosed herein are embodiments of rare earth-modified aluminum alloys that are made using rapid solidification (or "cooling") rates used in different alloy processing methods, such as additive manufacturing methods, melt spinning methods, direct chill casting methods, die-casting methods (e.g., high-pressure die-casting methods), squeeze casting methods, water cooled permanent mold casting methods, and continuous casting methods. The aluminum-rare earth metal compositions disclosed herein provide alloys that do not require post-alloy formation heat treatments and that exhibit unique microstructures and performance capabilities not attained by other aluminum alloys used in the art. The inventors of the present disclosure have surprisingly found that the alloy embodiments disclosed herein do not exhibit brittleness that would be expected in the art for rare earth-containing alloys and instead exhibit superior mechanical strength and a superior ability to avoid substantially coarsening as compared to other aluminum alloys. In particular disclosed embodiments, the alloy embodiments of the present disclosure exhibit hardness in the as-cast state far above (e.g., three times) that of current commercial aluminum alloys (e.g., A380 in T6 condition) without the need for post-processing heat treatments.

In some embodiments, the alloy compositions can be modified to include additive components that can prevent die sticking when particular processes utilizing die molds are used. In some alloy embodiments comprising an additive component, the solidified microstructure can be changed slightly and hardness improved. The aluminum-rare earth alloys disclosed herein are particularly suited for die casting applications and other processing methods that utilize rapid cooling rates. Additionally, the alloy embodiments described herein can be die cast without the need for a heat treatment, providing enormous economic and energy efficiency benefits.

III. Alloy Embodiments

Described herein are new aluminum alloys comprising a rare earth element component and that exhibit unique microstructural phases not present in current aluminum alloys. The alloys of the present disclosure further exhibit exceptional mechanical properties and stability without any need for a post-processing heat treatment. In particular disclosed embodiments, the aluminum alloys described herein exhibit unique microstructural features that result from higher cooling rates. The aluminum alloys further exhibit properties (e.g., hardness, tensile strength, yield strength, and resistance to corrosion, coarsening, and fatigue) that are superior to commercial aluminum compositions and other aluminum-rare-earth alloys. In particular disclosed embodiments, the aluminum alloys disclosed herein include strengthening phases that are obtained without having to use a heat treatment step and can be obtained simply by increasing the cooling rate used to prepare the alloy. Furthermore, the microstructures of the disclosed alloys are stable and are not influenced by post-processing steps. In some embodiments, the alloys disclosed herein do not exhibit substantial coarsening and thus provide improved alternatives to other aluminum-based alloys that do exhibit substantial coarsening, particularly when the alloy is exposed to post-processing methods and/or when heat treatment steps are used to form the alloy itself.

Embodiments of the present disclosure include aluminum alloys modified with rare earth elements, such as cerium, lanthanum, mischmetal, or any combinations thereof. It is to be understood that wherever cerium is mentioned herein, lanthanum and/or mischmetal can be substituted for a portion of, or all of the cerium. In some embodiments, the alloys described herein can further comprise additional alloying elements, such as magnesium, zinc, titanium, zirconium, vanadium, copper, nickel, scandium, and any combinations thereof. In yet additional embodiments, the alloys described herein can further comprise an additive component, such as iron, strontium, titanium, manganese, silicon, boron, cobalt, chromium, carbon, or any combinations thereof. In particular disclosed embodiments, the aluminum alloy comprises, consists essentially of, or consists of aluminum and at least one rare earth element, magnesium or zinc or a combination thereof, and one or more additive components. In yet additional embodiments, the aluminum alloy comprises, consists essentially of, or consists of aluminum and at least one rare earth element, and one or more additive components. In yet additional embodiments, the aluminum alloy comprises, consists essentially of, or consists of aluminum, at least one rare earth element, and one or more additional alloying elements. In yet additional embodiments, the aluminum alloy comprises, consists essentially of, or consists of aluminum; cerium or lanthanum (or combination thereof); magnesium; and iron, strontium, or a combination thereof. "Consists essentially of" means that the alloy does not include additional components that affect the chemical and/or mechanical properties of the alloy by more than 10%, such as 5% to 2%, relative to a comparable alloy that is devoid of the additional components. Such elements may include titanium, vanadium, zirconium, or any combinations thereof. Alloy embodiments described also can contain innocuous amounts of various impurities that have no substantial effect on the chemical and/or mechanical properties of the alloys.

Lanthanum modification has the potential to exhibit similar mechanical properties to that of cerium modification, as does mischmetal. Natural mischmetal comprises, in terms of weight percent, about 50% cerium, 30% lanthanum, with the balance being other rare earth elements. Thus, modification of aluminum alloys with cerium through addition of mischmetal can be a less expensive alternative to pure cerium.

In particular disclosed embodiments, the amount of the rare earth element(s) included in the cast alloy can range from 5 wt % to 30 wt %, such as 5 wt % to 20 wt %, or 6 wt % to 16 wt %, or 8 wt % to 12 wt %. In particular disclosed embodiments, the rare earth element is present in an amount ranging from 8 wt % to 12 wt %. In some embodiments, the amount of the additive component can range from 0 wt % to 5 wt %, such as greater than 0 wt % to 5 wt %, or 0.1 wt % to 5 wt %, or 0.1 wt % to 4 wt %, or 0.1 wt % to 3 wt %, or 0.1 wt % to 2 wt %, or 0.1 wt % to 1 wt %. In some embodiments, the alloy can comprise one or more additional alloying elements. In particular disclosed embodiments wherein magnesium is used as the additional alloying element, the magnesium can be present in an amount ranging from greater than 0 wt % to 15 wt %, such as 0.4 wt % to 12 wt %, or 0.4 wt % to 8 wt %. In an independent embodiment, the amount of any additional alloying elements can range from 0.1 wt % to 5 wt % total of one or more additional alloying elements with each additional element not exceeding 1% of the total wt % of the one or more additional alloying elements. In some independent embodiments, a total amount ranging from 0.1 wt % to 3 wt %, or 0.1 wt % to 1 wt % of the one or more additional alloying elements can be used. In an independent embodiment where zinc is included as an additional alloying element, the zinc can be present in an amount ranging from greater than 0 wt % to 7 wt %. In an independent embodiment wherein copper and/or nickel are used as additional alloying elements, the copper and/or the zinc can be present in an amount ranging from greater than 0 wt % to 8 wt %. The balance wt % of the aluminum alloys in any or all of the above embodiments is made up of aluminum. In representative embodiments, alloys having the following composition are described: 86.6Al-12Ce-1Fe-0.4Mg, 91.6Al-8Ce-0.4Mg, 90.6Al-8Ce-0.4Mg-1Fe, 87.6Al-12Ce-0.4Mg, 84Al-8Ce-8Mg, and 83Al-8Ce-8Mg-1Fe.

Figure 2:
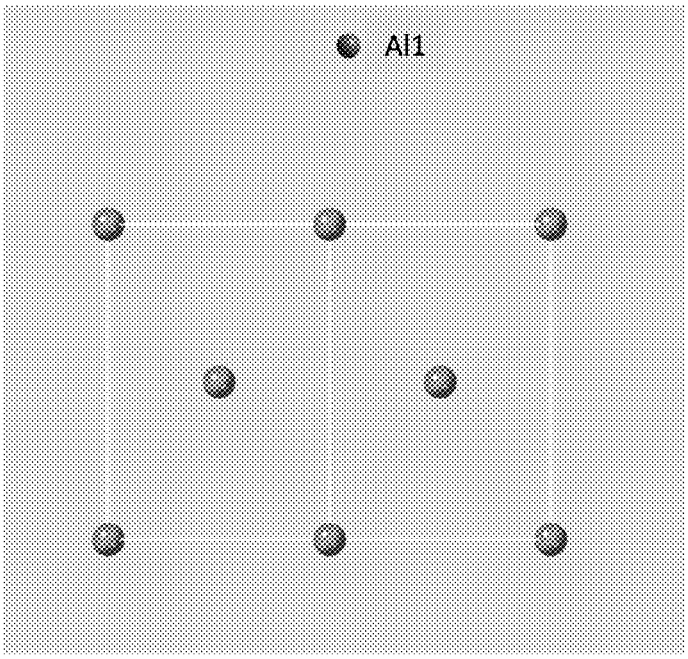
FIG. 2 is an illustration of the crystal structure of a pure Al(FCC) matrix phase.
Figure 3:
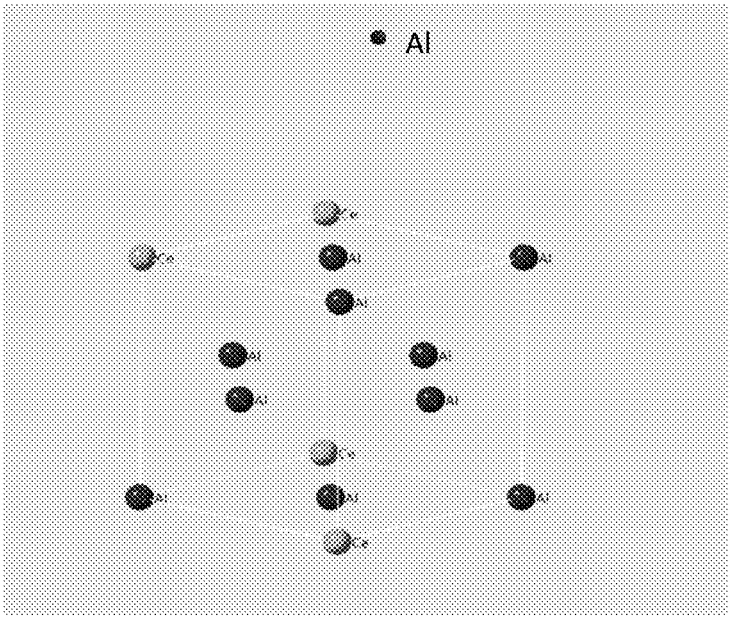
FIG. 3 is an illustration of unique crystal structure observed in representative alloy embodiments described herein wherein very rapid cooling rates lock cerium in substitutional solid solution with aluminum forming a new FCC matrix phase composed of aluminum and cerium.
Figure 4:
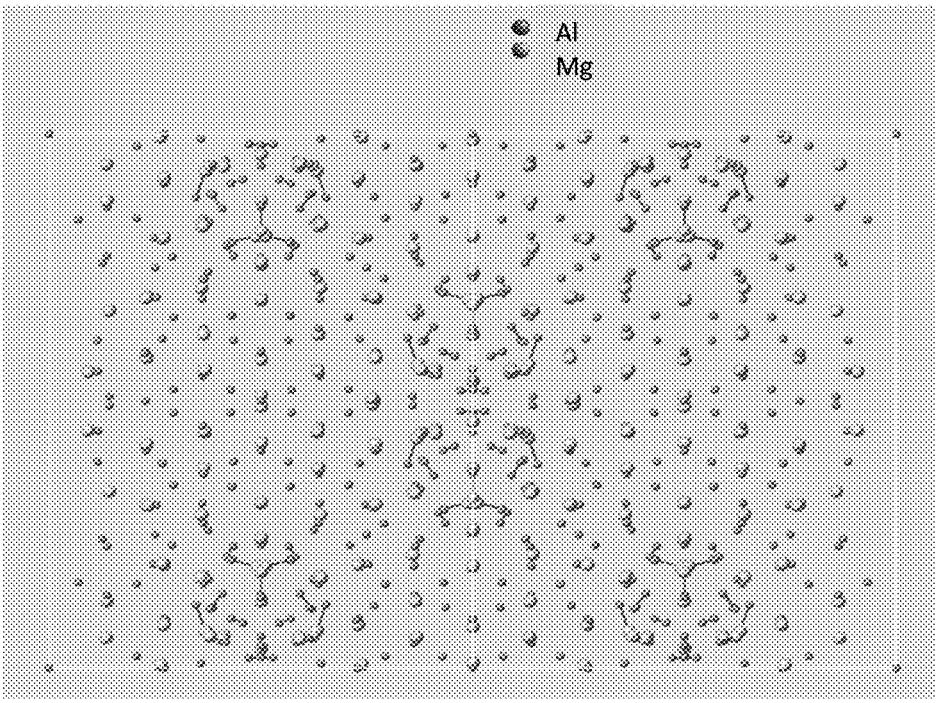
FIG. 4 is an illustration of the crystal structure of $Al_{13}(Mg,Ce)_2$, which is a phase that is present in representative alloy embodiments as a substitutional solid solution when $Al_{11}Ce_3$ formation is suppressed and can be obtained using rapid cooling rates described herein.
Figure 5:
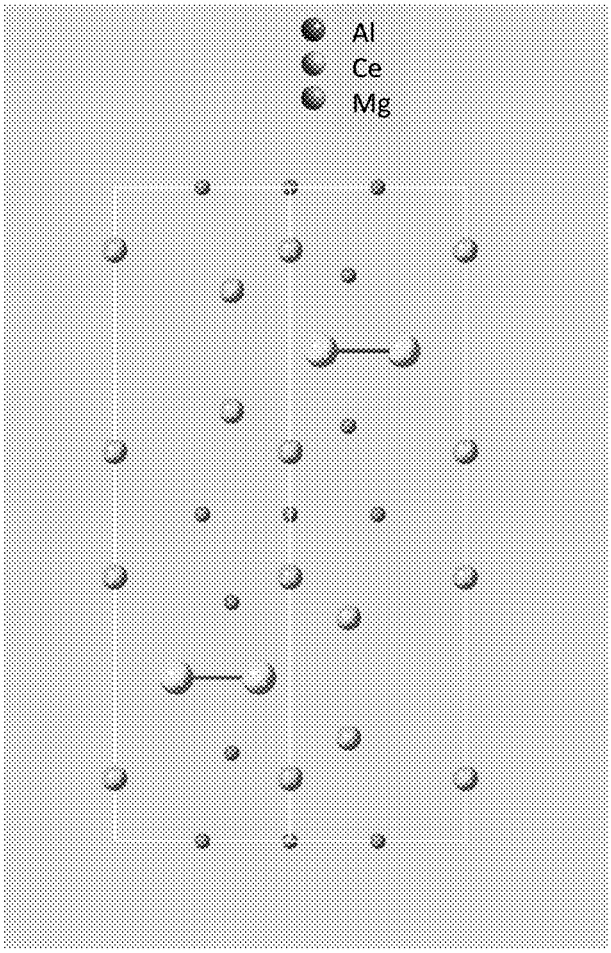
FIG. 5 is an illustration of the crystal structure of a unique ternary $Al_{12}CeMg_6$ phase observed in representative alloy embodiments.

Cast alloy embodiments described herein have a strengthening $Al_{11}X_3$ intermetallic phase, where X is cerium, lanthanum, mischmetal, or any combinations thereof. In some embodiments, the intermetallic phase is present in an amount in the range of from 5 wt % to 30 wt %. A representative illustration of such a phase is provided by FIG. 1. In an independent embodiment, certain alloys of the present disclosure can comprise a reduced amount of an $Al_{11}Ce_3$ intermetallic phase as compared to a slow cooled alloy. For example, if a binary phase of $Al_{11}Ce_3$ is present at 60 vol %, rapid cooling rates used herein can suppress up to 50% of that volume into the different phases and/or solid solutions described below. In yet another independent embodiment, certain alloys of the present disclosure do not comprise, or are free of, an $Al_{11}Ce_3$ intermetallic phase. Such alloys may be obtained by using very rapid cooling rates, such as cooling rates wherein the temperature of the alloy is decreased at an average rate ranging from $10^4$ K/s to $10^8$ K/s, such as $10^5$ K/s to $10^8$ K/s. In some embodiments, the alloy embodiments disclosed herein can comprise a pure Al(FCC) matrix phase (FIG. 2), which can be converted to a unique FCC matrix phase comprising aluminum and cerium (FIG. 3) utilizing rapid cooling rates, such as cooling rates wherein the temperature of the alloy is decreased at an average rate ranging from $10^4$ K/s to $10^8$ K/s, such as $10^5$ K/s to $10^8$ K/s. In yet additional embodiments, the alloys disclosed herein can comprise an $Al_{13}(Mg,Ce)_2$ crystal structure (FIG. 4), which is present as a substitutional solid solution under very rapid cooling rates (e.g., cooling rates wherein the temperature of the alloy is decreased at an average rate ranging from $10^4$ K/s to $10^8$ K/s, such as $10^5$ K/s to $10^8$ K/s) when $Al_{11}Ce_3$ formation is suppressed. Additionally, this phase can be seen contributing to the formation of nanocrystalline domains as small as 10 nm. In yet some additional embodiments, the alloys disclosed herein can exhibit a ternary $Al_{12}CeMg_6$ phase (FIG. 5). This ternary phase can form under very rapid cooling rates (e.g., cooling rates wherein the temperature of the alloy is decreased at an average rate ranging from $10^4$ K/s to $10^8$ K/s, such as $10^5$ K/s to $10^8$ K/s) and also can be seen contributing to the formation of nanocrystalline domains as small as 10 nm.

Figure 6:
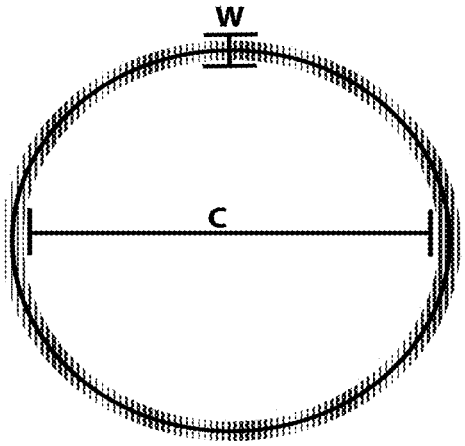
FIG. 6 is a schematic representation of a cell of a cellular microstructure, wherein C is the cell size and W is wall width.

Cast alloy embodiments described herein also can comprise a unique microstructure formed from the high cooling rates used to obtain the cast alloy. In some embodiments, a portion of the alloy can comprise a semi- to fully-eutectic microstructure with a maximum spacing between dominant eutectic features being greater than 8 μm, such as 0 μm to 5 μm or 0 μm to 1 μm. Such microstructures can be observed when rapid cooling rates wherein the temperature of the alloy is decreased at an average rate ranging from 100 K/s to less than $10^4$ K/s, such as 100 K/s to 1000 K/s are used. In yet additional embodiments, a portion of the alloy can comprise a cellular microstructure. In some embodiments comprising a cellular microstructure, the cell size can range from 5 μm to 30 μm and the wall width of the cell can range from 0.1 μm to 15 μm. As such, the ratio between cell size (represented as "C" in the schematic diagram of FIG. 6) and wall width (represented as "W" in the schematic diagram of FIG. 6) can range from 300 to 2. In some embodiments, this ratio between cell size (C) and wall width (W) is a factor in microstructure and can be considered proportional to cooling rate. Such cellular microstructures can be observed when rapid cooling rates wherein the temperature of the alloy is decreased at an average rate ranging from 1000 K/s to $10^5$ K/s, such as $10^4$ K/s to $10^5$ K/s are used. In yet additional embodiments, a portion of the alloy can comprise laths, particles, and/or rods. Such microstructures can be observed when rapid cooling rates wherein the temperature of the alloy is decreased at an average rate ranging from $10^5$ K/s to $10^8$ K/s are used. In some embodiments, the microstructure is characterized by laths, rods, particles, and/or cellular features, depending on the cooling rate used, which can have an average thickness of no more than 500 nm and an average lath spacing of no more than 1 μm, particularly when rapid cooling rates wherein the temperature of the alloy is decreased at a rate ranging from 100 K/s to $10^4$ K/s.

The aluminum alloys of the present disclosure exhibit superior properties to conventional aluminum alloys that do not include rare earth elements and/or aluminum alloys comprising a rare earth element that are cast without rapid cooling and/or that do not include an aluminum-additive component phase. In some embodiments, the aluminum alloys of the present disclosure exhibit hardness values that are not found in conventional aluminum alloys or aluminum alloys comprising a rare earth element that are cast without rapid cooling and/or that do not include an aluminum-additive component phase. In some embodiments, the aluminum-rare earth element alloys described herein exhibit Vickers hardness values that are nearly 3 times that of an aluminum-rare earth element alloy that is cast without rapid cooling and/or that does not include an aluminum-additive component phase. In some embodiments, the disclosed aluminum-rare earth element alloys of the present disclosure exhibit Vickers hardness values ranging from 55 HV to 155 HV.

IV. Methods

Disclosed herein are embodiments of making the rapidly solidified aluminum alloys described herein. In some embodiments, the method comprises combining aluminum with at least one rare earth element and optionally one or more additional alloying elements to form a mixed alloy composition and rapidly cooling the mixed alloy composition at a cooling rate effective to form an alloy having certain microstructural features that are not obtained in alloys that are not rapidly cooled and/or alloys that do not comprise rare earth elements. Unique microstructures that can be obtained using these methods are described above. In some embodiments, the method can further comprise adding an additive component as described herein. In the method, rapid cooling can comprise exposing the mixed alloy composition to a rapid cooling rate, which can comprise decreasing the temperature of the alloy at an average rate of 10 K/s to $10^8$ K/s, such as greater than 10 K/s to $10^8$ K/s, such as 100 K/s to $10^8$ K/s, or 100 K/s to $10^7$ K/s, or 100 K/s to $10^6$ K/s, or 100 K/s to $10^5$ K/s, or 100 K/s to $10^4$ K/s, or 100 K/s to 1000 K/s. In some embodiments, a rapid cooling rate comprises a cooling rate wherein the temperature of the alloy is decreased at an average rate ranging from greater than 10 K/s to 1000 K/s, such as 100 K/s to 1000 K/s. In some embodiments, a rapid cooling rate comprises a cooling rate wherein the temperature of the alloy is decreased at an average rate ranging from greater than 10 K/s to $10^4$ K/s, such as 100 K/s to $10^4$ K/s. In some embodiments, a rapid cooling rate comprises a cooling rate wherein the temperature is decreased at an average rate ranging from greater than 1000 K/s to less than $10^5$ K/s, such as greater than 1000 K/s to 99999 K/s, or greater than 1000 K/s to $10^4$ K/s. In some embodiments, a rapid cooling rate comprises a cooling rate wherein the temperature is decreased at an average rate ranging from greater than $10^4$ K/s to less than $10^5$ K/s, such as greater than $10^4$ K/s to 99999 K/s. In yet some additional embodiments, a rapid cooling rate comprises a cooling rate wherein the temperature of the alloy is decreased at an average rate ranging from $10^4$ K/s to $10^8$ K/s or higher, such as $10^4$ K/s to $10^8$ K/s, or $10^4$ K/s to $10^7$ K/s or $10^4$ K/s to $10^6$ K/s. In yet some additional embodiments, a rapid cooling rate comprises a cooling rate wherein the temperature of the alloy is decreased at an average rate ranging from $10^5$ K/s to $10^8$ K/s or higher, such as $10^5$ K/s to $10^8$ K/s, or $10^5$ K/s to $10^7$ K/s or $10^5$ K/s to $10^6$ K/s.

In some embodiments, increasing the cooling rate can influence the microstructure of the alloy such that it is refined as cooling rate increases. In some embodiments, using an average cooling rate of greater than 10 K/s to 1000, such as 100 K/s to 1000 K/s can provide an alloy comprising a semi to fully eutectic structure. In some embodiments, using an average cooling rate of greater than 1000 K/s to $10^5$ K/s, such as $10^4$ K/s to $10^5$ K/s, can provide an alloy having a cellular microstructure that can be substantially free of any semi or fully-formed eutectic. In some embodiments, using an average cooling rate of greater than $10^4$ K/s to $10^8$ K/s, such as $10^5$ K/s to $10^8$ K/s, can provide an alloy having microstructure comprising distinct laths, rods, and/or particles. In some independent embodiments, greater than 0% to 50% or more of any $Al_{11}Ce_3$ intermetallic portion present in such microstructures can be suppressed. In some embodiments, the cooling rate can lead to smaller lath structures within the alloy's microstructure. For example, in some embodiments utilizing cooling rates ranging from 100 K/s to 1000 K/s, laths observed within the microstructure are not larger than 1 μm, and typically are not larger than 0.5 μm. In some embodiments, if the cooling rate is increased above 1000 K/s, such to $10^4$ K/s, laths observed within the microstructure typically are not larger than 10 nm.

The method further can comprise performing one or more additional steps to form the alloy, such as one or more additive manufacturing steps (e.g., three-dimensional printing of the alloy); melt spinning steps (e.g., applying the alloy to a cooled wheel and rotating the wheel); direct chill casting steps (e.g., pouring the mixed alloy composition into a bottom-open mold and directly spraying water on the alloy as it leaves the mold through the open bottom); die-casting steps, such as high pressure die-casting steps described below; squeeze casting steps (e.g., pouring the mixed alloy composition to partially fill a die and applying high pressures to the partially-filled die), water-cooled permanent mold casting steps (applying cooling water to a mold into which the mixed alloy is poured), continuous casting steps, or any combinations thereof.

In embodiments wherein a die-cast alloy is made, the method typically comprises heating aluminum or a master alloy to a molten state (e.g., to a temperature of 100° C. or 100° C. above its melting temperature under an oxygen-excluded atmosphere) adding additional alloying elements, adding a rare earth element, filling a mold, performing a rapid cooling step, and any suitable combination of such steps. In some embodiments, the method can further comprise adding an additive component. For example, the method can comprise combining molten aluminum (or a molten master alloy) with the additive component and the rare earth element and may further comprise adding one or more additional alloying elements in any suitable order. The resulting composition is then added to and fills a mold, such as a die mold, and is exposed to a rapid cooling step. In some embodiments, the additive component can first be added to the molten aluminum, followed by any additional alloying elements and the rare earth element, in any order. For example, the additive component can first be added to the molten aluminum, followed by adding the additional alloying elements and then the rare earth element can be added. In yet other embodiments, the additive component can first be added to the molten aluminum, followed by the rare earth element and then the additional alloying elements can be added. In yet additional embodiments, the rare earth element can first be added to the molten aluminum, followed by addition of the additive component, and then addition of the additional alloying elements. In yet additional embodiments, the rare earth element can first be added to the molten aluminum, followed by addition of the additional alloying elements, and then addition of the additive component.

In particular disclosed embodiments, the rate at which the mold is filled with the alloy composition is controlled such that the filling rate ranges from 50 inches/second to 150 inches/second, such as 100 inches/second to 50 inches/second, or 150 inches/second to 100 inches/second. In yet additional embodiments, the rate at which the mold and/or alloy is solidified (or cooled) can be controlled. For example, after using any of the disclosed embodiments to make the alloy composition that is placed into the mold, such as a die-cast mold, the alloy composition is solidified at a rapid rate using cooling channels that are cut through the die mold near the casting surfaces. Forced circulation of a cooling fluid is used to lower the temperature of the die. In particular disclosed embodiments, a particular cooling rate (or $R_c$) is selected such that the mold is cooled rapidly. Suitable rapid cooling rates are described above. In yet additional embodiments, this method can form an additional microstructure resulting from the binary aluminum/additive component phase (e.g., an aluminum-iron phase) when an additive component is included. This additional microstructure is not present in conventional aluminum alloys or aluminum-rare earth alloys formed using other casting methods that do not use such a cooling process.

Additional method steps can be included in the above-described method embodiments, such as one or more degassing steps, one or more fluxing steps, one or more purging steps, one or more theoretical density determination steps, one or more temperature adjustment steps, and any combinations thereof. Degassing steps, such as rotary degassing, can utilize a reactive gas, such as nitrous oxide (N.O.S.) or chloride gas; or, they can utilize non-reactive gases, such as an inert gas like argon or nitrogen. These optional steps can be conducted in any suitable order in combination with the other method steps discussed above. Representative method embodiments using such optional steps are described below and in FIGS. 7-17. Certain of FIGS. 7-17 include a wavy line, which is used to indicate that the schematic is continued on the following drawing sheet (solely to improve readability of the schematic illustrations). In particular disclosed embodiments, the representative methods illustrated in FIGS. 7-17 can be modified to exclude the additive component. In yet additional embodiments, these representative methods can further include performing a rapid cooling step whereby the filled mold is cooled using a rapid cooling rate (e.g., 10 K/s to $10^8$ K/s, such as 100 to 1000 K/s or higher).

Figure 7A:
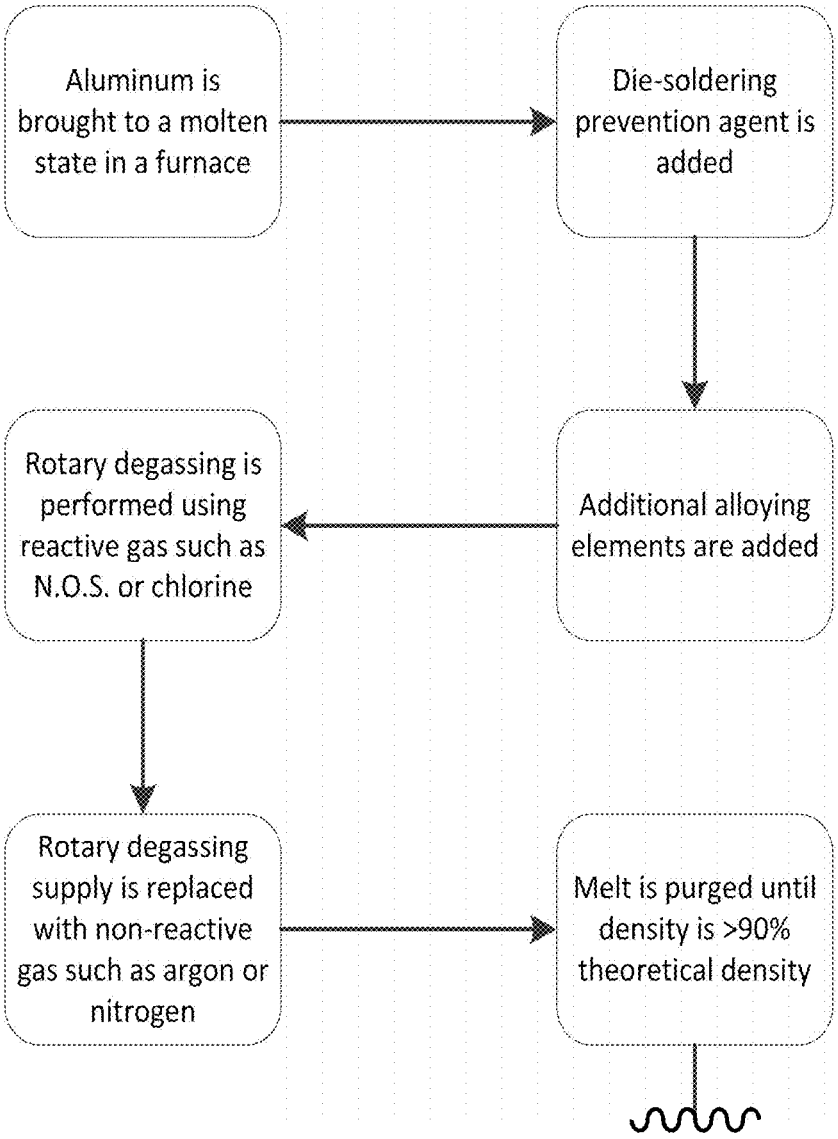
FIGS. 7A and 7B are a schematic diagrams of a representative method for making a die-cast aluminum-rare earth element alloy embodiment.
Figure 7B:
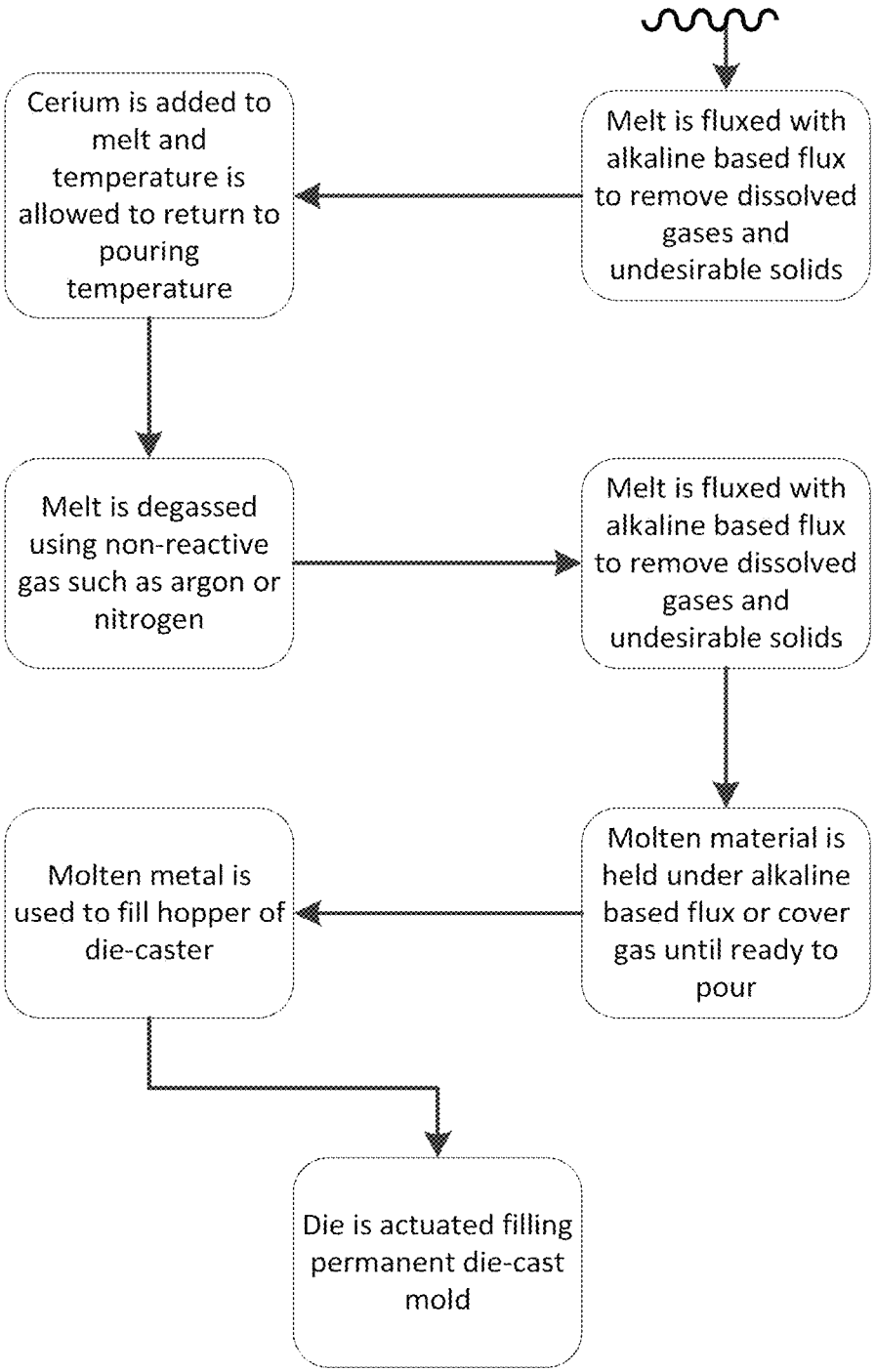

FIGS. 7A and 7B provide certain steps used in one representative embodiment of a method for making the aluminum alloys described herein. In the method of FIGS. 7A and 7B, aluminum is heated to a molten state, an additive component ("die-soldering prevention agent") is added to form an additive-containing composition, followed by adding additional alloying elements to form an alloy composition. Then, a rotary degassing step can be performed using a reactive gas, such as N.O.S. or chlorine. The reactive gas can then be replaced with a non-reactive gas in a subsequent rotary degassing step. The alloy composition is then purged until the density is greater than 90% of the theoretical density. The alloy composition is then fluxed using an alkaline-based flux composition or a halide-based flux composition to remove any dissolved gases and/or undesirable solids such that no more than trace amounts (e.g., 5 wt % or less, such as less than 1 wt %) of such impurities are present, thus providing a substantially purified alloy composition. Following this fluxing step, a rare earth element, such as cerium or lanthanum (or mischmetal), is added to form a rare earth element alloy composition (e.g., a cerium-containing alloy composition) and the temperature of the rare earth element alloy composition is allowed to return to a sufficient temperature such that the rare earth element alloy composition can be poured. A subsequent degassing step with a non-reactive gas is then used, followed by a final fluxing step during which the rare earth element alloy composition can be held under the alkaline-based flux or a cover gas until it is ready to be poured into a fill hopper of a die-caster. After being added to the fill hopper, the die is actuated so that the die mold is filled with the composition.

Figure 8A:
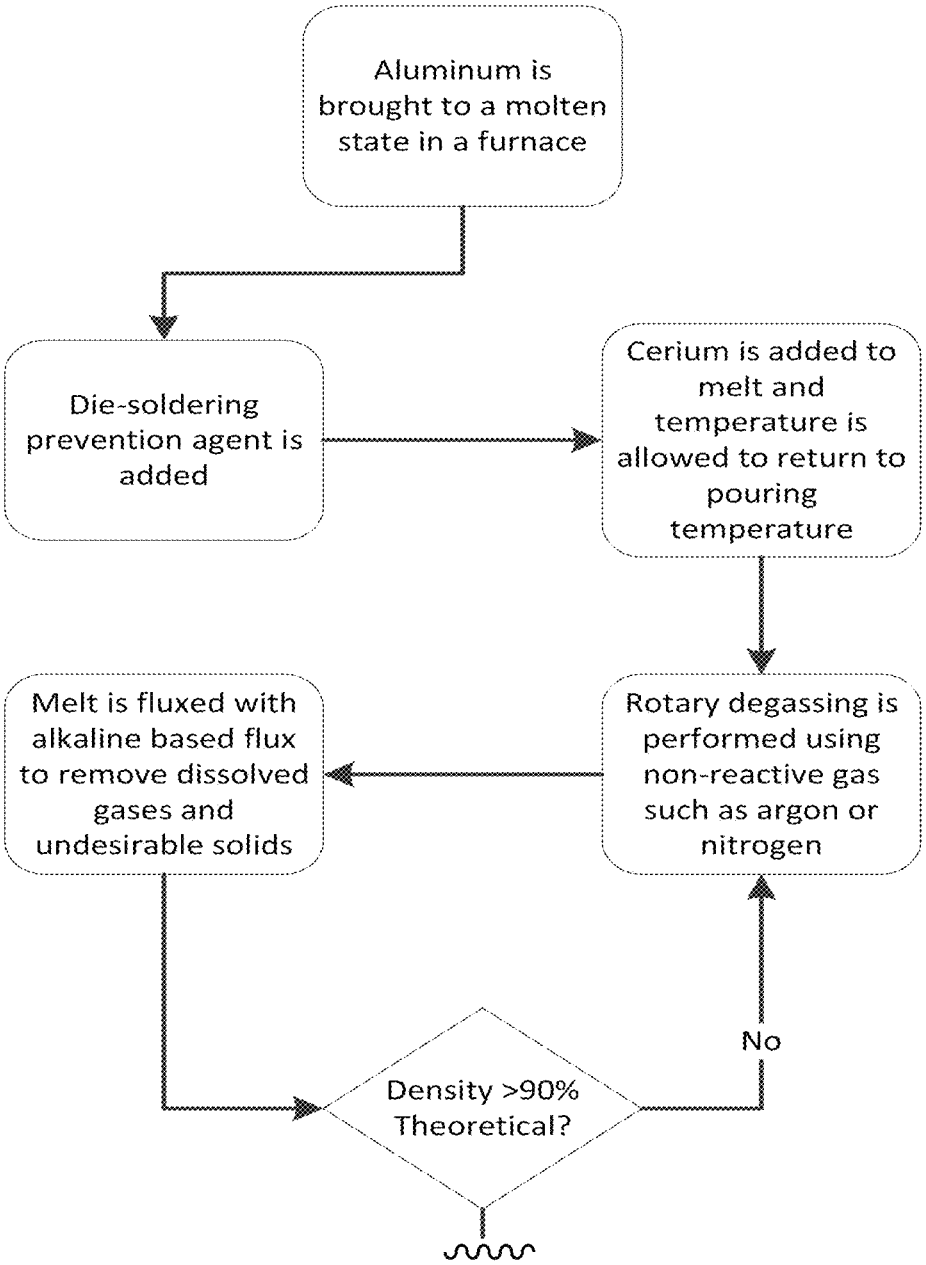
FIGS. 8A and 8B are a schematic diagrams of another representative method for making a die-cast aluminum-rare earth element alloy embodiment.
Figure 8B:
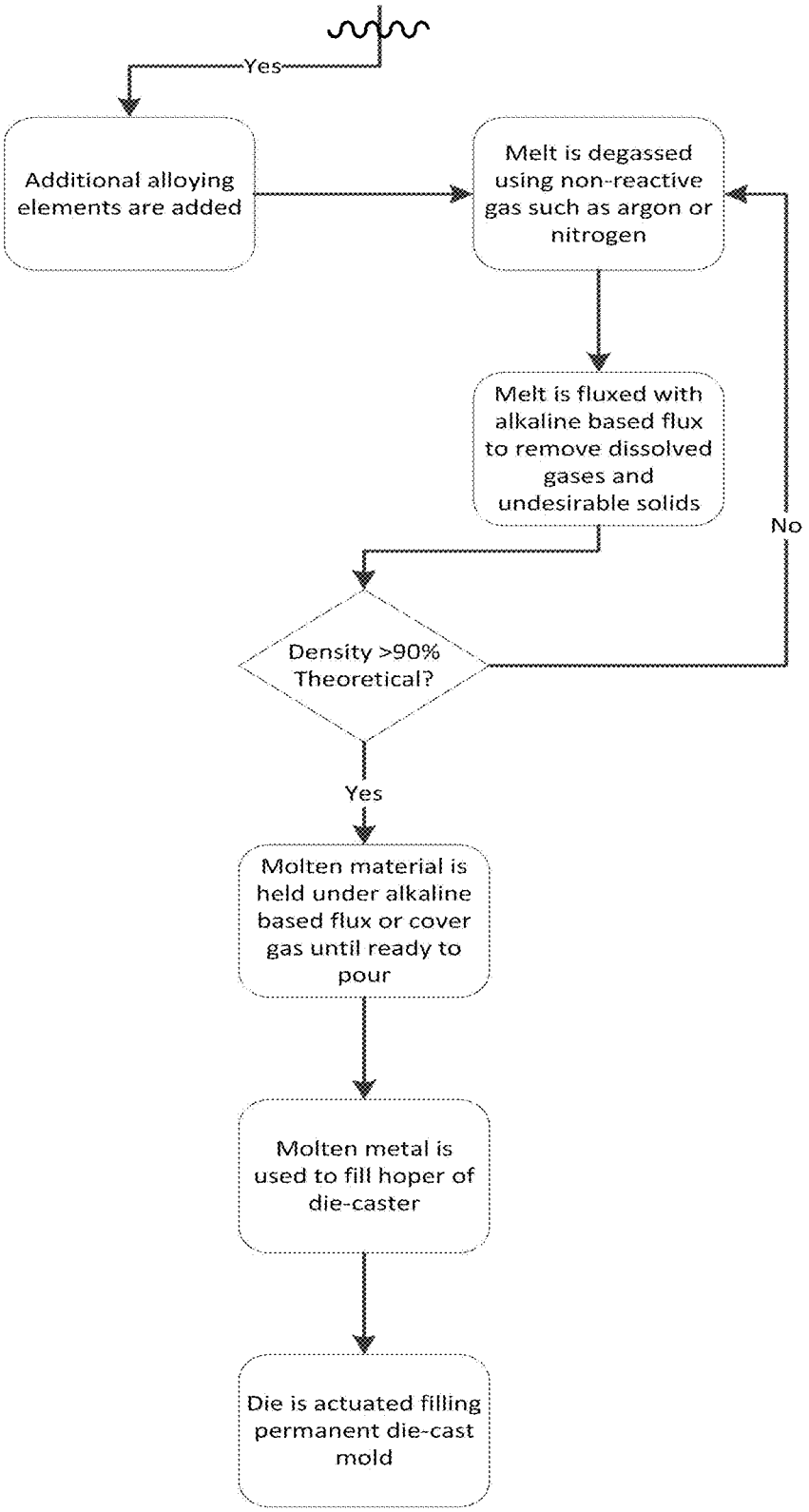

FIGS. 8A and 8B show a schematic illustration of modified method utilizing similar steps as those shown for FIGS. 7A and 7B, but wherein the rare earth element is added prior to adding additional alloying elements. With reference to FIGS. 8A and 8B, this method embodiment comprises adding the additive component to molten aluminum to form an additive-containing composition, followed by addition of the rare earth element to form a rare earth element alloy composition and then allowing the temperature of the rare earth element alloy composition to return to a suitable pouring temperature. A rotary degassing step using a non-reactive gas is then used, followed by a fluxing step similar to that described above for FIGS. 7A and 7B. The density is then evaluated and if it is greater than 90% of the theoretical density, additional alloying elements are added to form a mixed alloy composition. If the density is less than 90% of the theoretical density, then one or more degassing/fluxing steps are used until the density is greater than 90% of the theoretical density. After additional alloying elements are added, the mixed alloy composition is degassed and fluxed and the density is again evaluated. If the density is determined to be less than 90% of the theoretical density, then the degassing and fluxing steps are repeated. Then, the mixed alloy composition is held under the alkaline-based flux or a cover gas until pouring takes place. The mixed alloy composition is then added to the hopper of a die-caster and the die are actuated and filled.

Figure 9A:
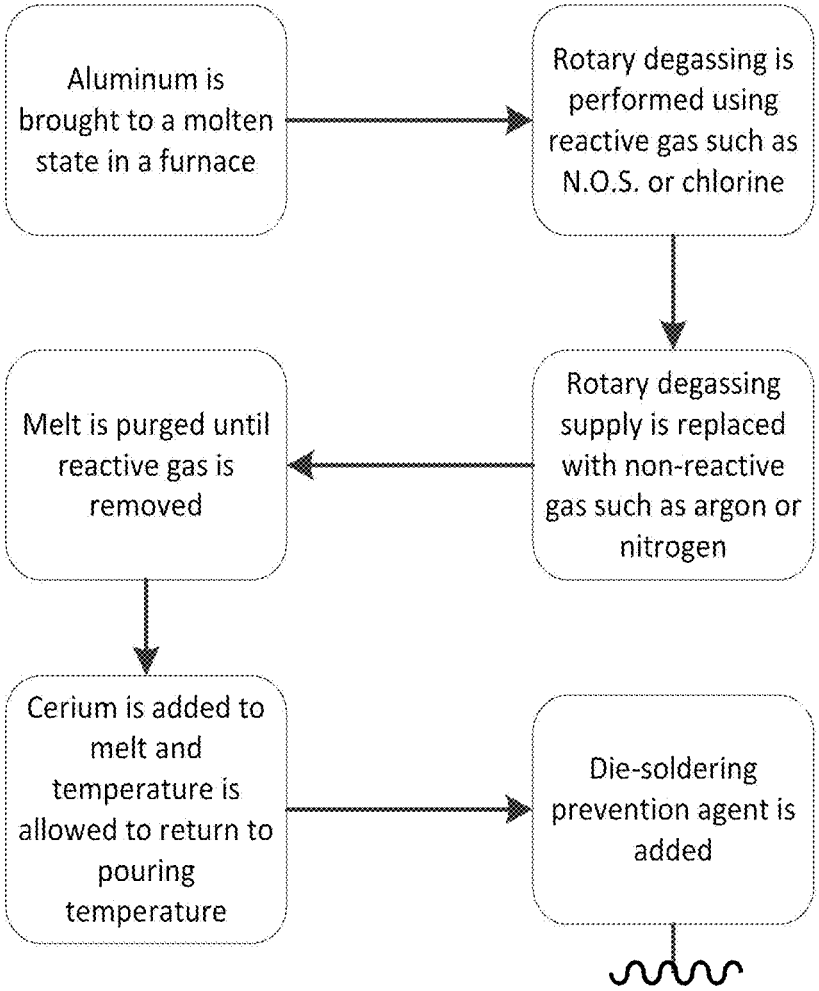
FIGS. 9A and 9B are schematic diagrams of another representative method for making a die-cast aluminum-rare earth element alloy embodiment.
Figure 9B:
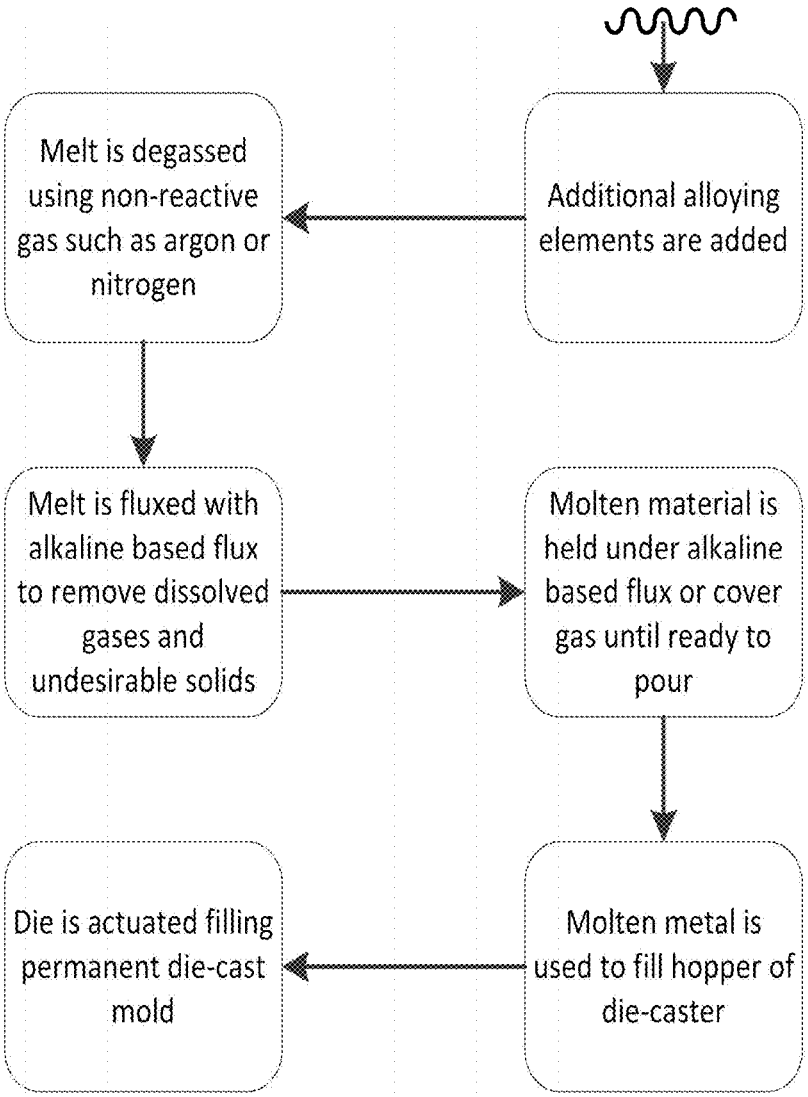

FIGS. 9A and 9B provide a schematic diagram of an additional method embodiment wherein a purging step is used. In the embodiment shown by FIGS. 9A and 9B, the aluminum is heated to a molten state, followed by a first rotary degassing step with a reactive gas and a second rotary degassing step with a non-reactive gas. A purging step is then used to remove any remaining reactive gas. The rare earth element is added and the mixture is allowed to cool to a pouring temperature. An additive component is then added, followed by one or more additional alloying components. Degassing and fluxing steps are then used, followed by die actuation and filling as described above.

Figure 10:
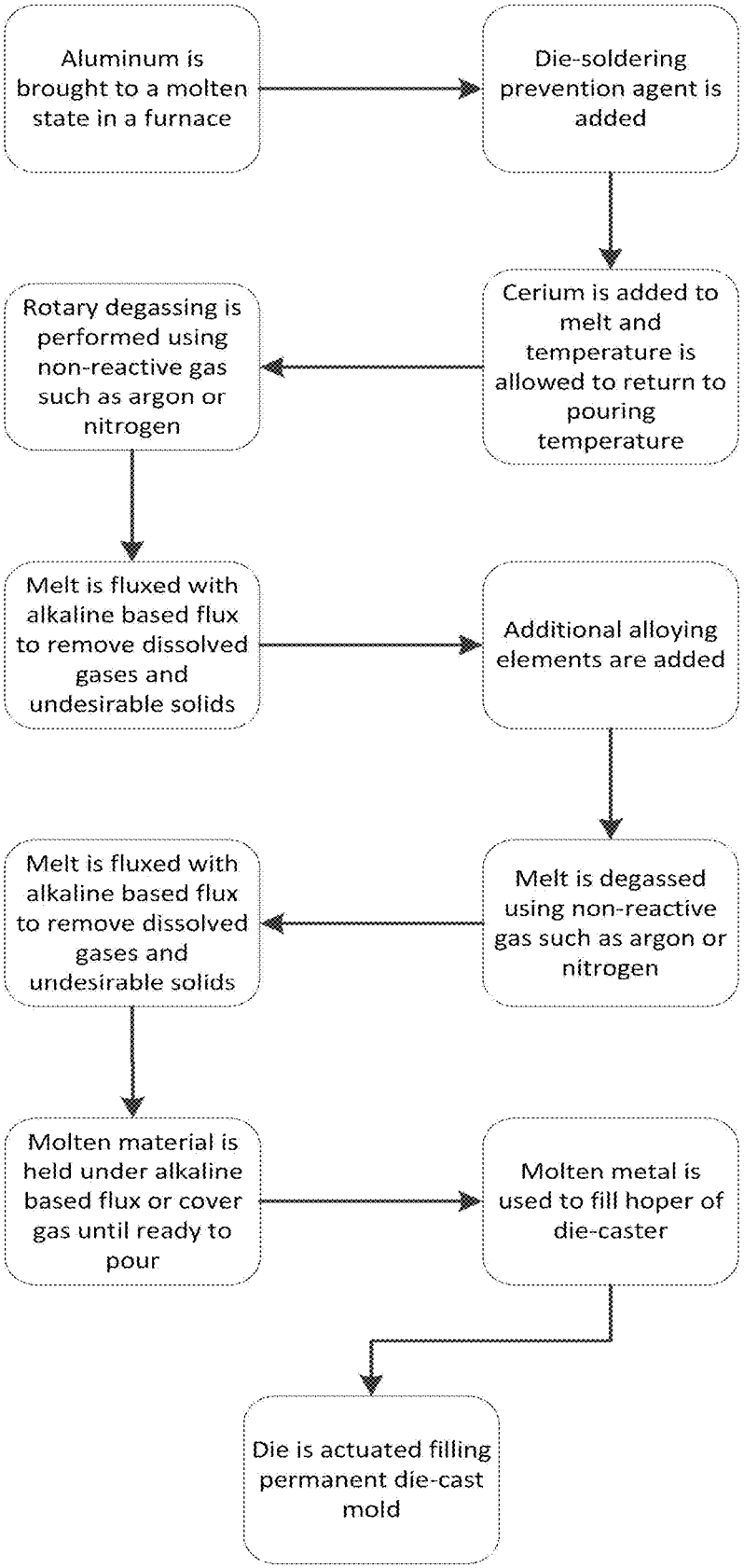
FIG. 10 is a schematic diagram of another representative method for making a die-cast aluminum-rare earth element alloy embodiment.

An additional method embodiment is shown by FIG. 10. According to the embodiment of FIG. 10, molten aluminum is combined with the additive component followed by rare earth element addition. Rotary degassing and fluxing steps are then used, followed by adding the additional alloying elements. The melted composition is then degassed with a non-reactive gas, fluxed with an alkaline-based flux, and then, once it is ready to pour, it is added to a fill hopper and then to a die-cast mold.

Figure 11A:
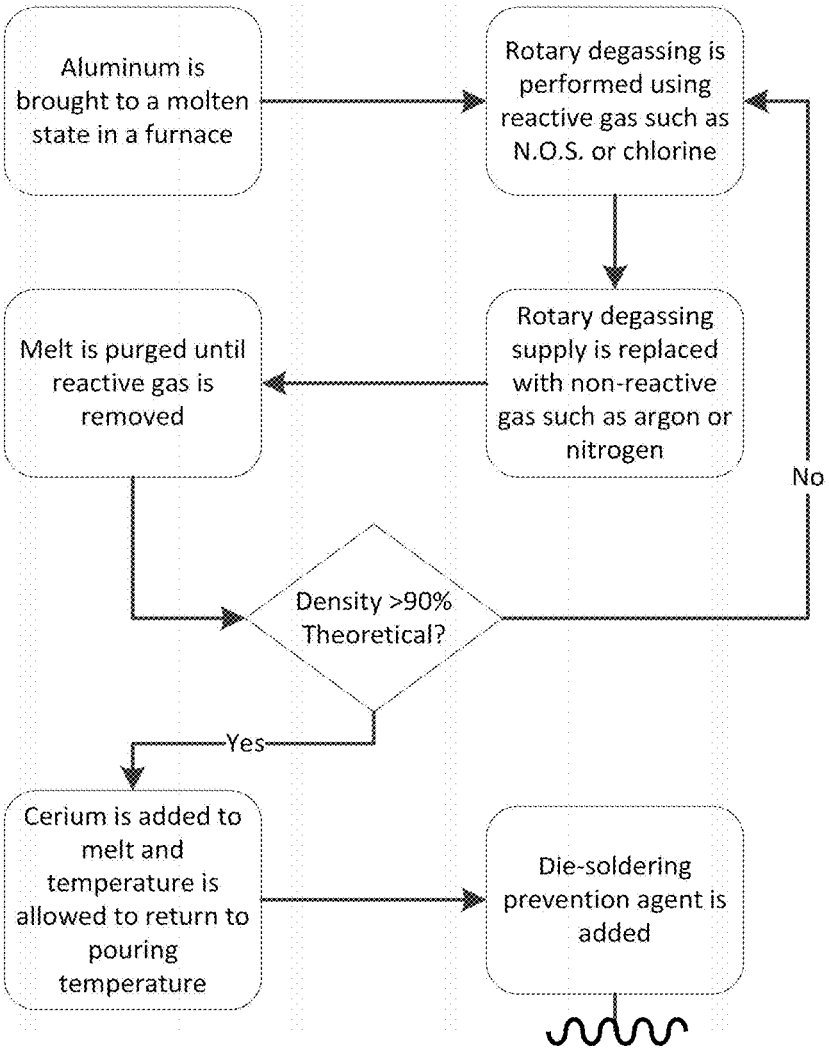
FIGS. 11A and 11B are schematic diagrams of another representative method for making a die-cast aluminum-rare earth element alloy embodiment.
Figure 11B:
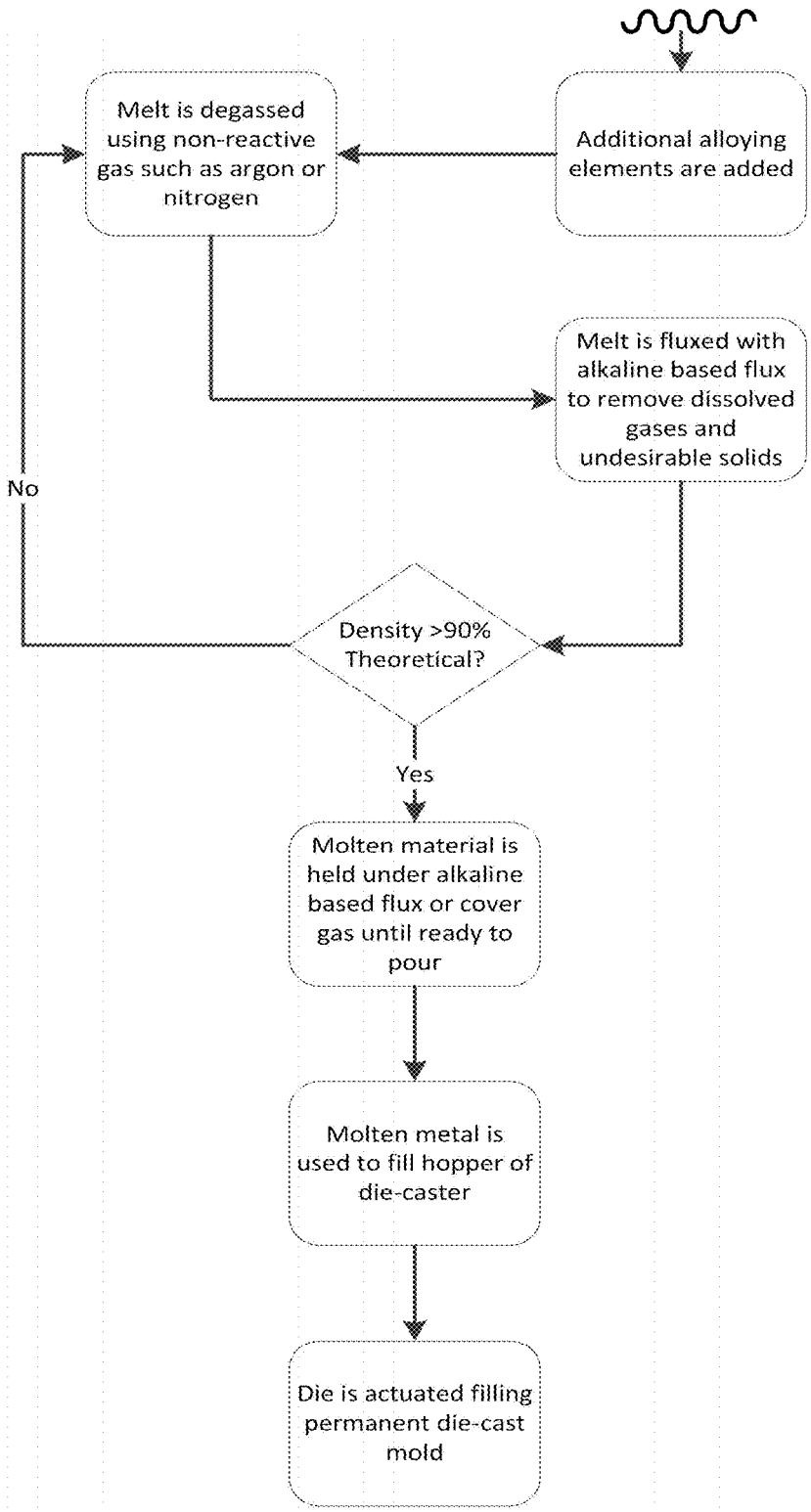

In some representative embodiments, the molten aluminum can be degassed and purged and evaluated for density prior to adding the additive component, the additional alloying elements, or both. One such representative embodiment is shown in FIGS. 11A and 11B, wherein the molten aluminum is first degassed with a reactive gas and then a non-reactive gas. After purging the system until the reactive gas is removed, the density can be evaluated and if it is not greater than 90% of the theoretical density, the degassing and purging steps can be repeated. The rare earth element can then be added followed by the additive component. Then, the additional alloying elements are added, followed by one or more degassing and fluxing steps until a density of greater than 90% of the theoretical density is obtained.

Figure 12A:
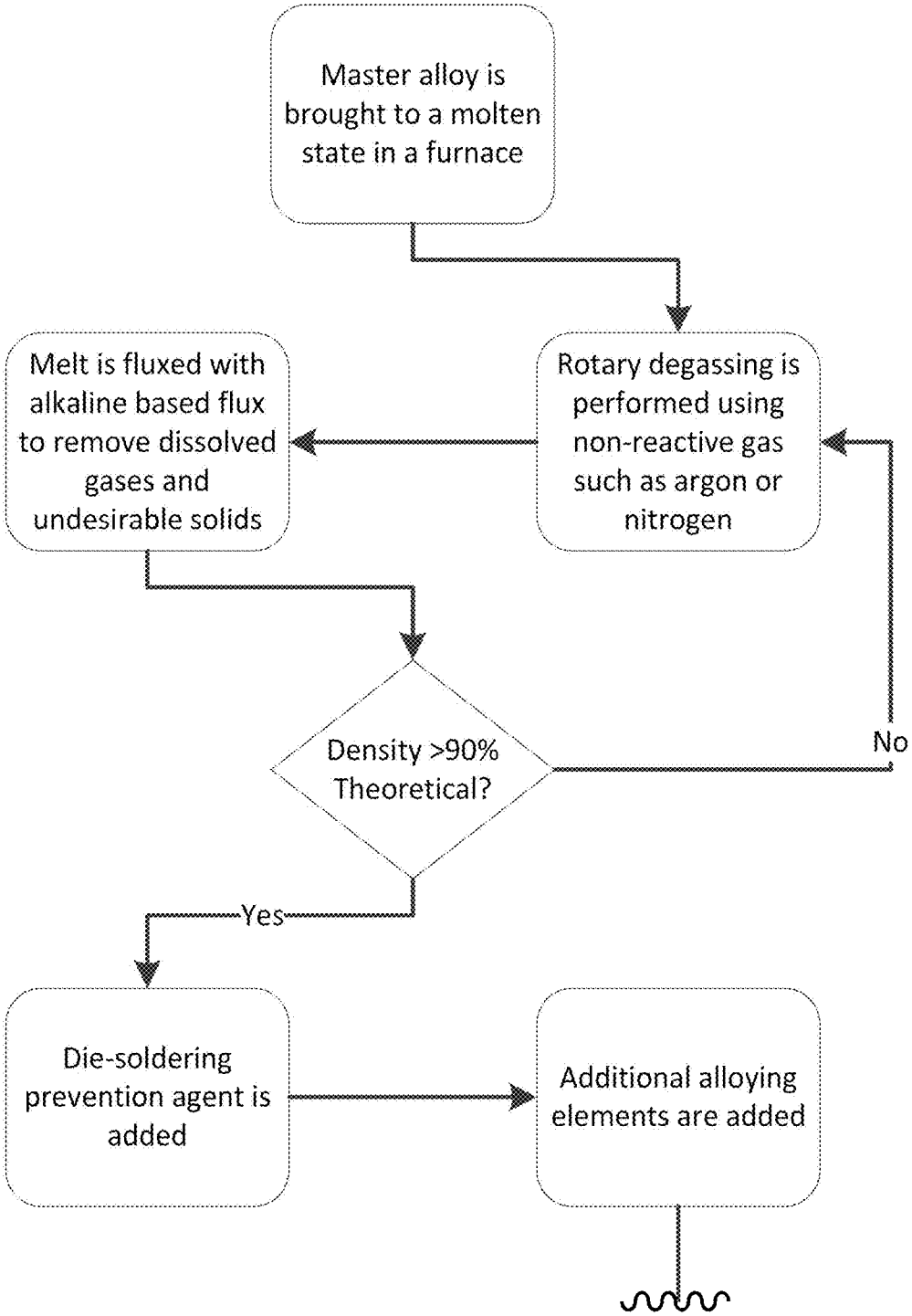
FIGS. 12A and 12B are schematic diagrams of a representative method for making a die-cast aluminum-rare earth element alloy embodiment using a master alloy as a starting material.
Figure 12B:
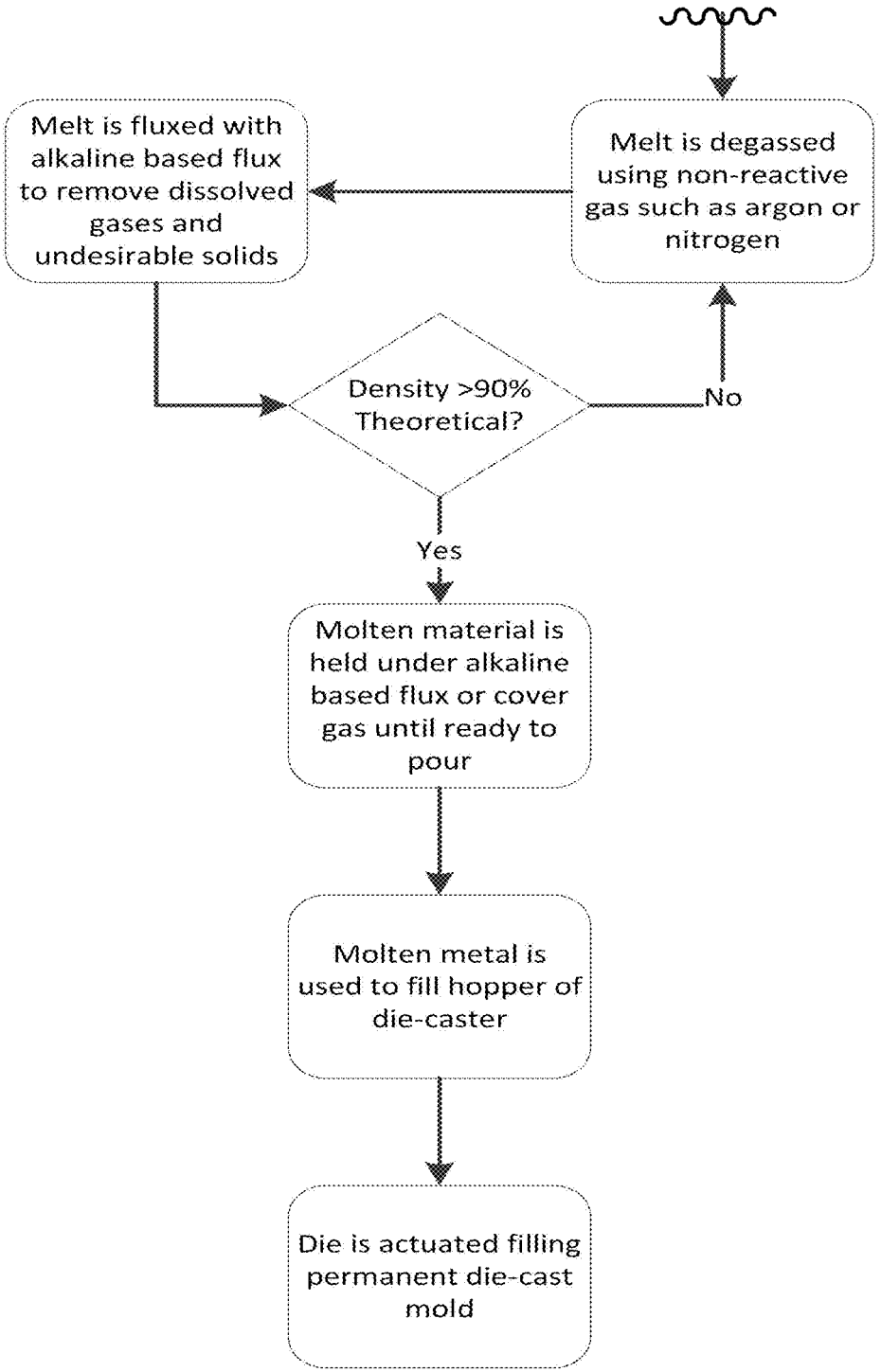

FIGS. 12A and 12B are schematic illustrations of a method embodiment using a master alloy as the starting material. In this embodiment, the master alloy, which comprises aluminum and the rare earth metal (and can include other additional components) is heated to a molten state and one or more degassing and fluxing steps are used until the density is greater than 90% of the theoretical density. An additive component is then added, followed by one or more additional alloying elements. The resulting mixed alloy composition is degassed and fluxed until a desired density is obtained and then it, once it is ready to be poured, it is added to the fill hopper and into the die-cast mold.

Figure 13A:
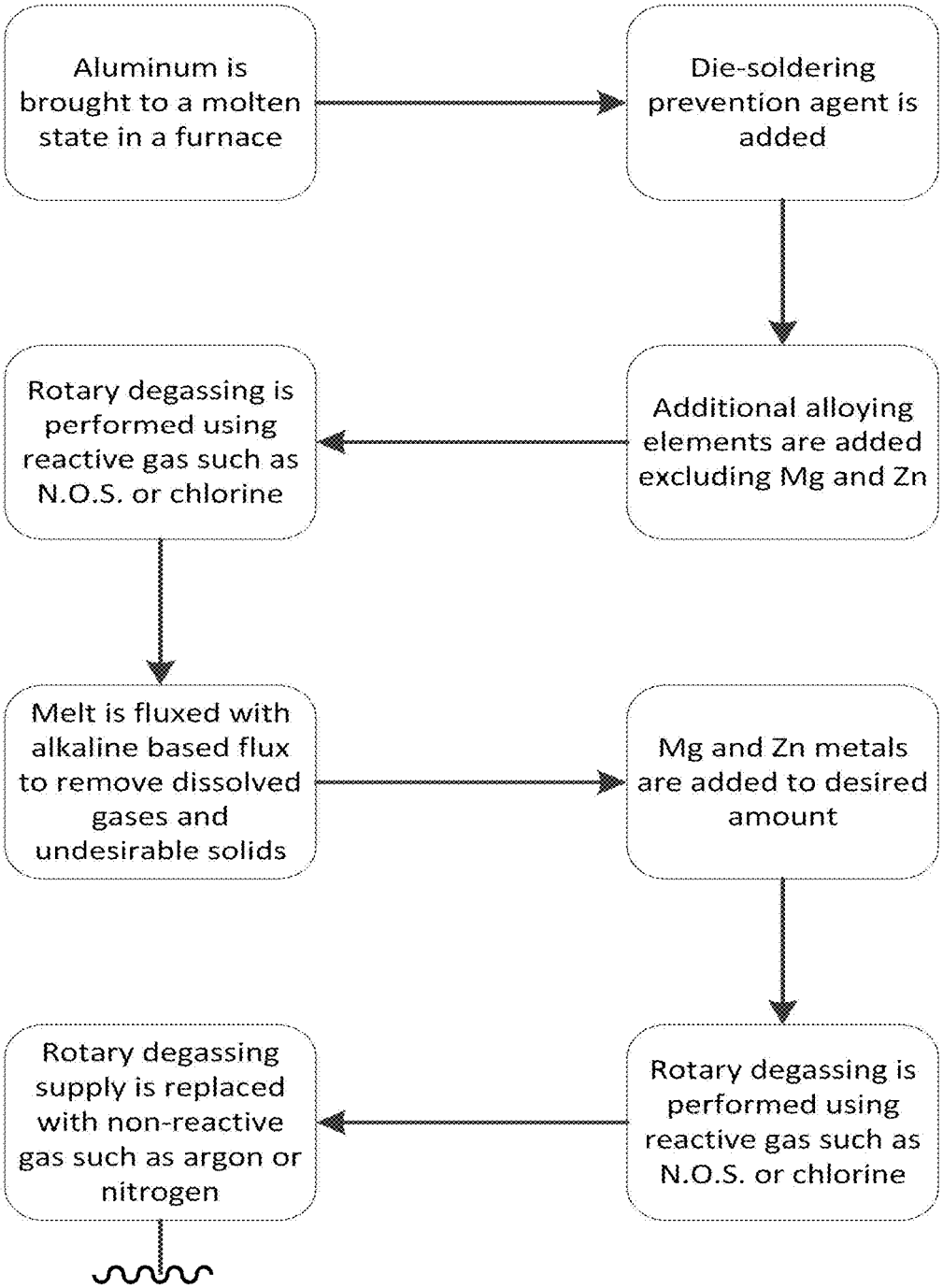
FIGS. 13A and 13B are schematic diagrams of a representative method for making a die-cast aluminum-rare earth element alloy embodiment wherein Mg and Zn are added separately from and after other additional alloying elements.
Figure 13B:
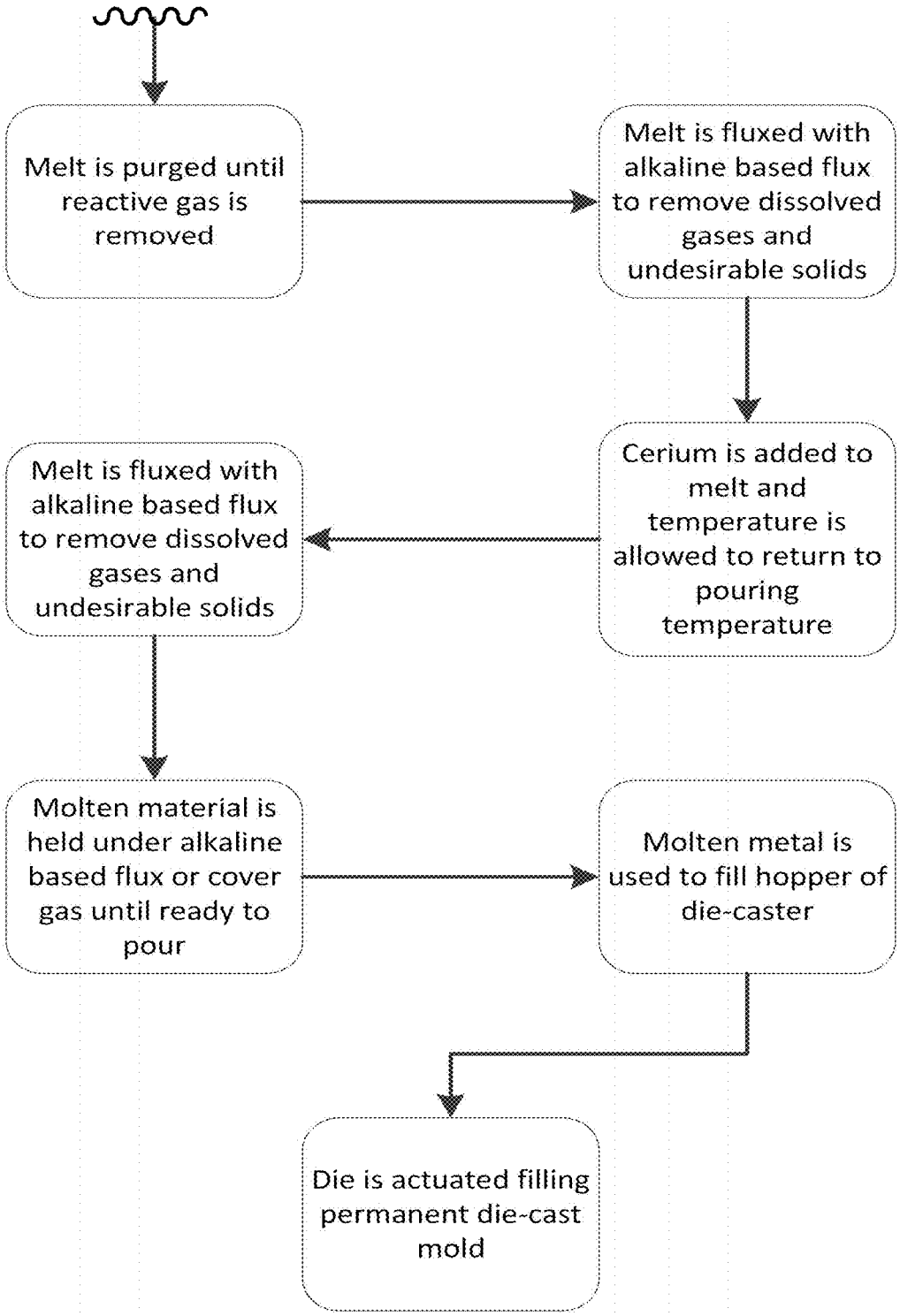
Figure 14A:
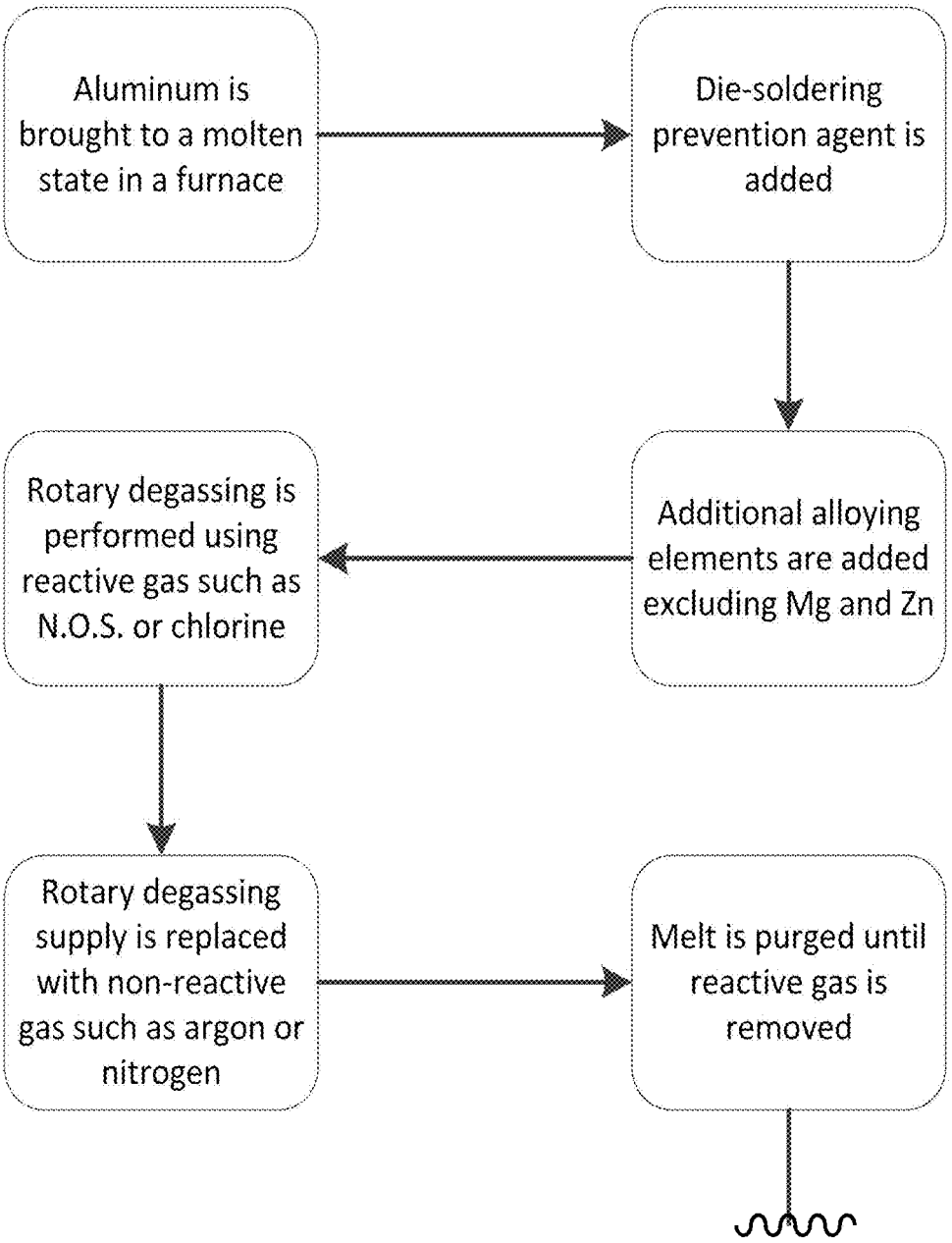
FIGS. 14A and 14B are schematic diagrams of another representative method for making a die-cast aluminum-rare earth element alloy embodiment wherein Mg and Zn are added separately from and after other additional alloying elements.
Figure 14B:
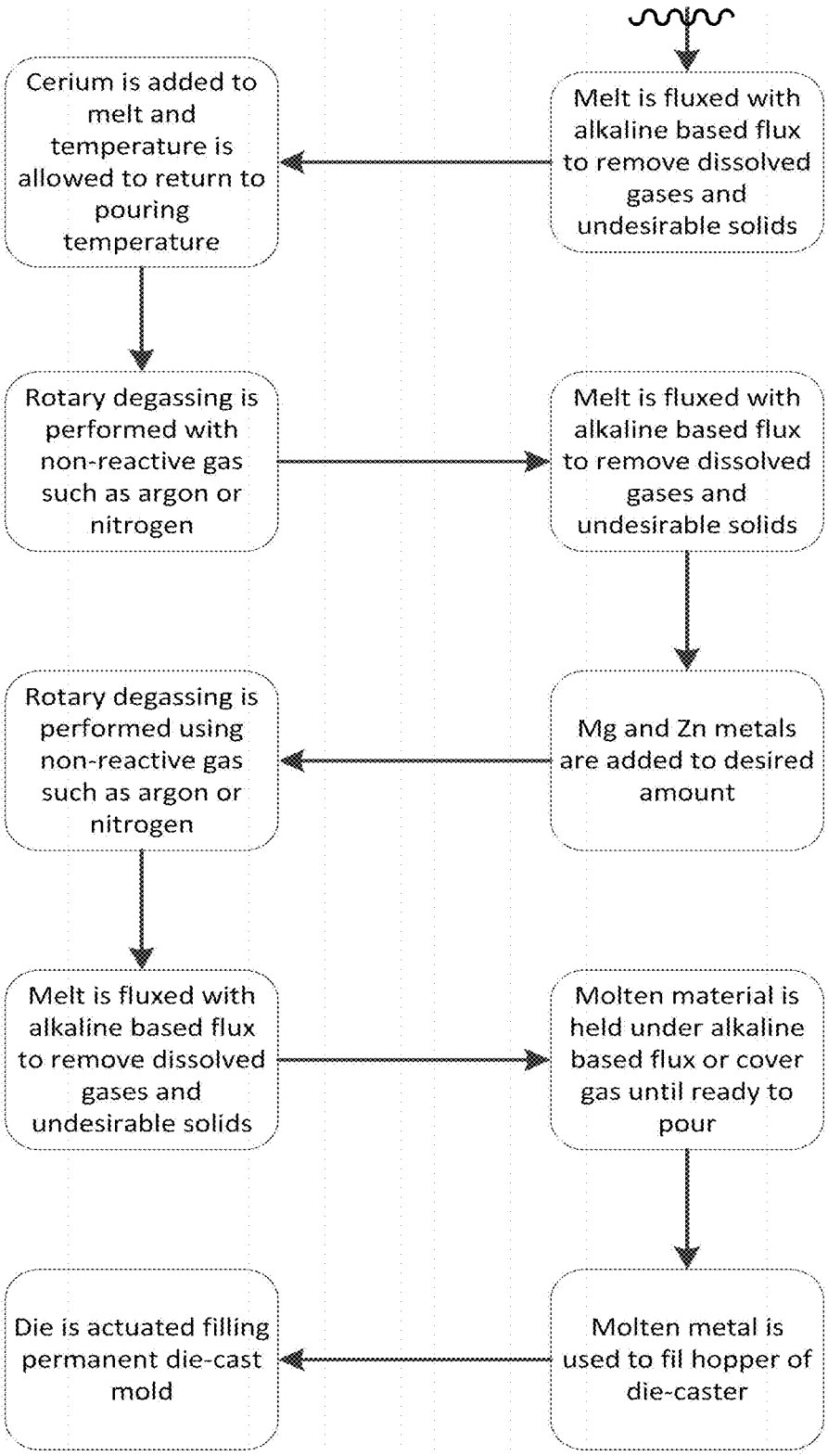
Figure 15A:
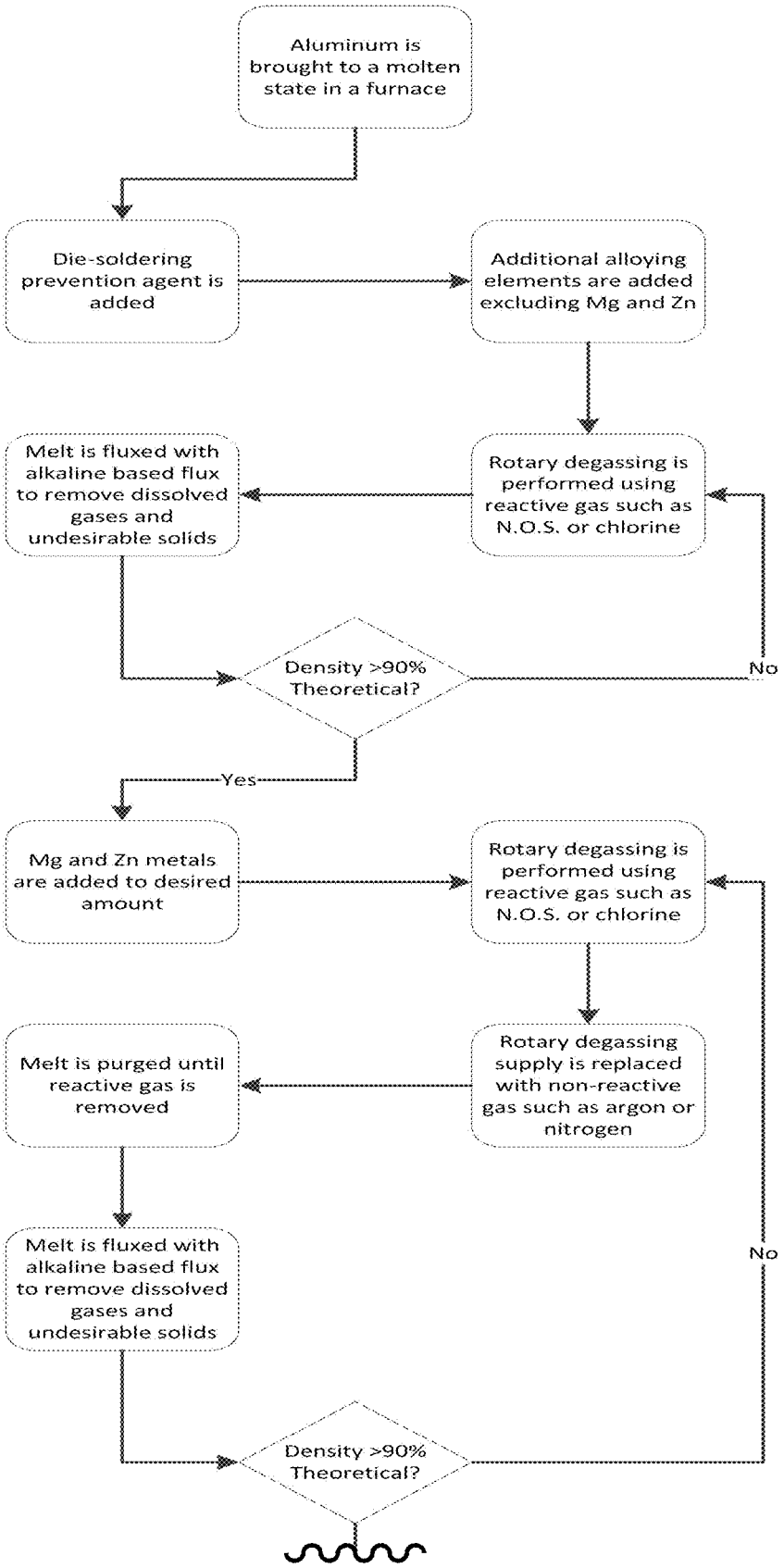
FIGS. 15A and 15B are schematic diagrams of another representative method for making a die-cast aluminum-rare earth element alloy embodiment wherein Mg and Zn are added separately from and after other additional alloying elements.
Figure 15B:
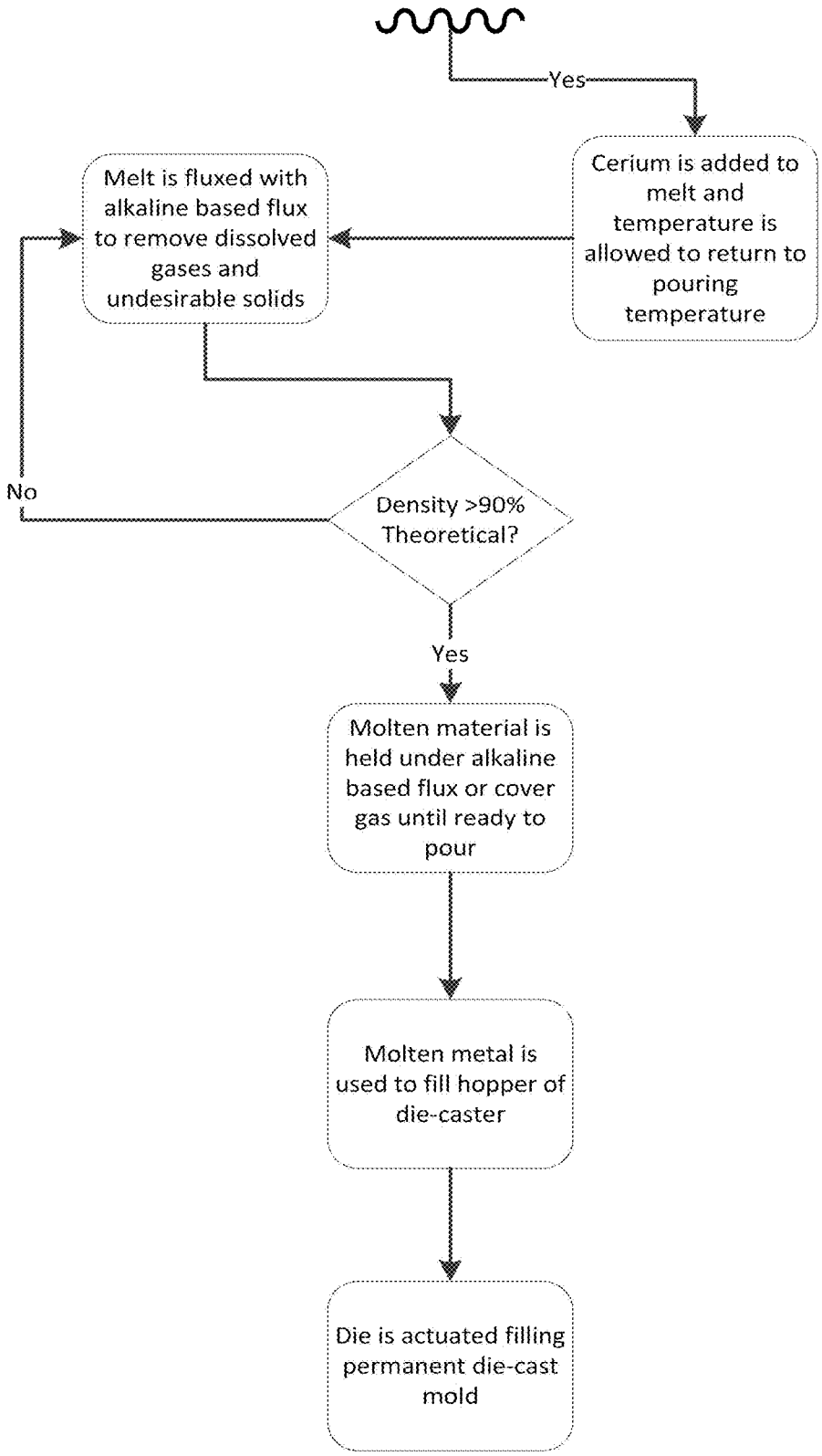
Figure 16A:
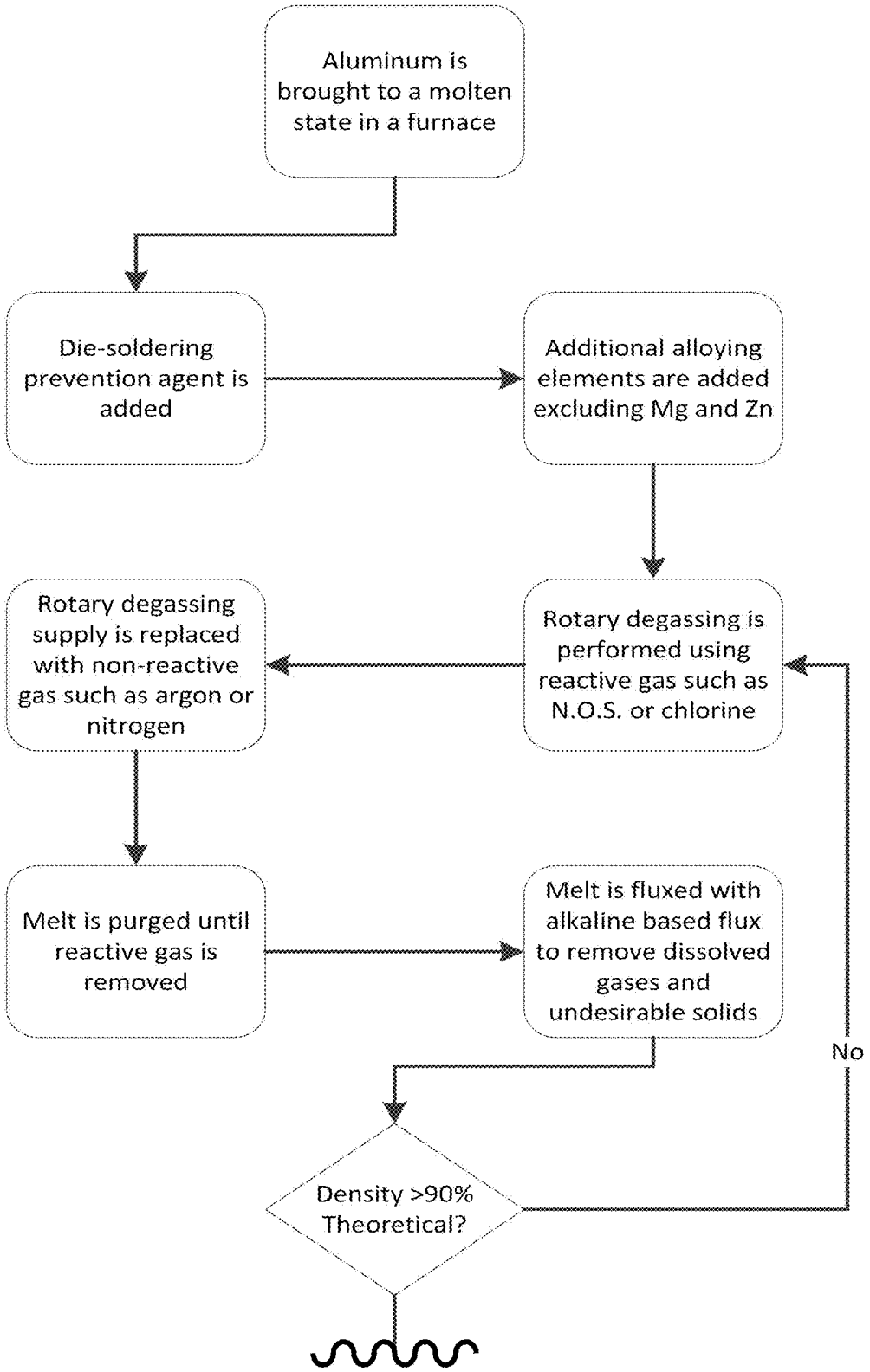
FIGS. 16A-16C are schematic diagrams of another representative method for making a die-cast aluminum-rare earth element alloy embodiment wherein Mg and Zn are added separately from and after other additional alloying elements.
Figure 16B:
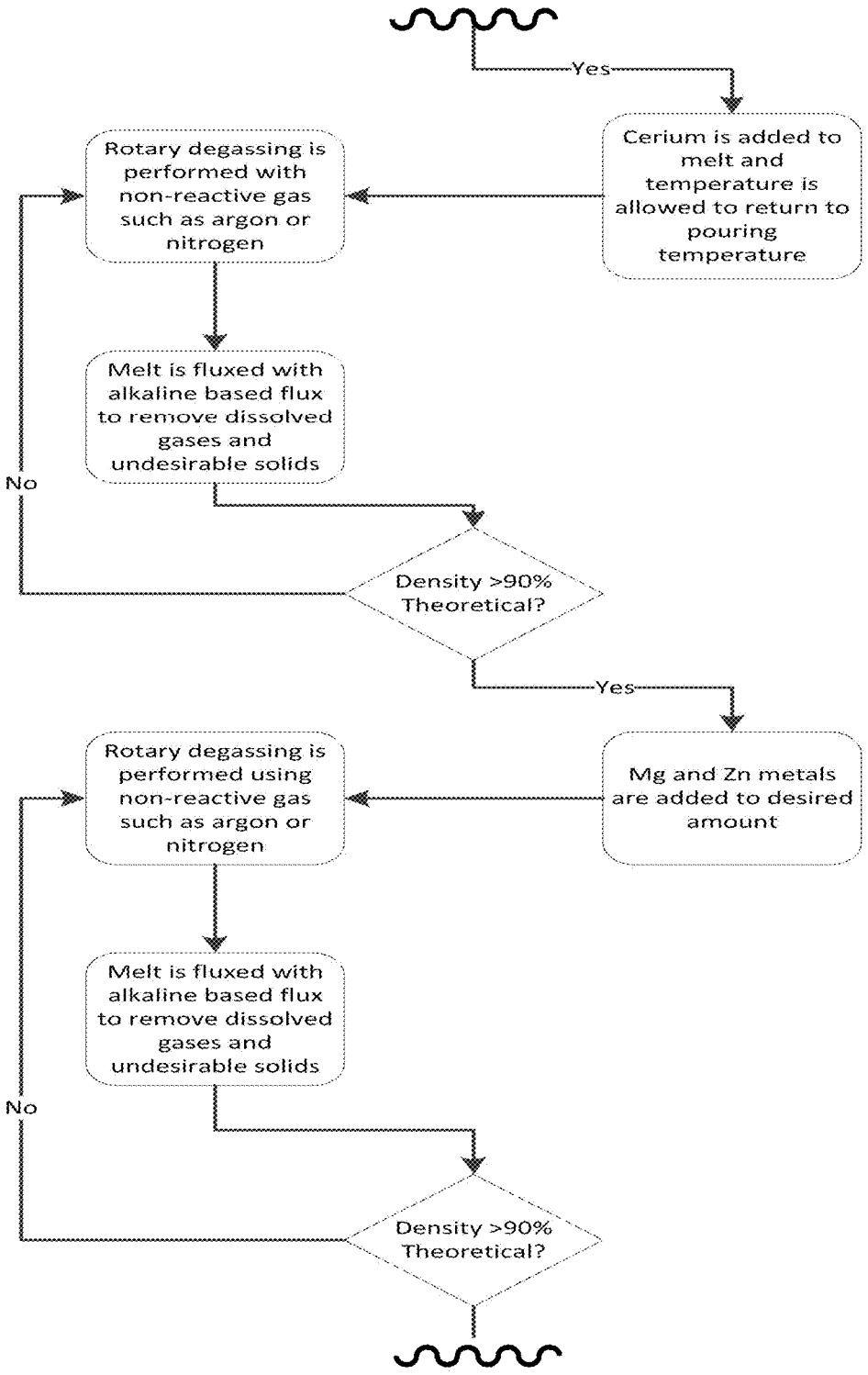
Figure 16C:
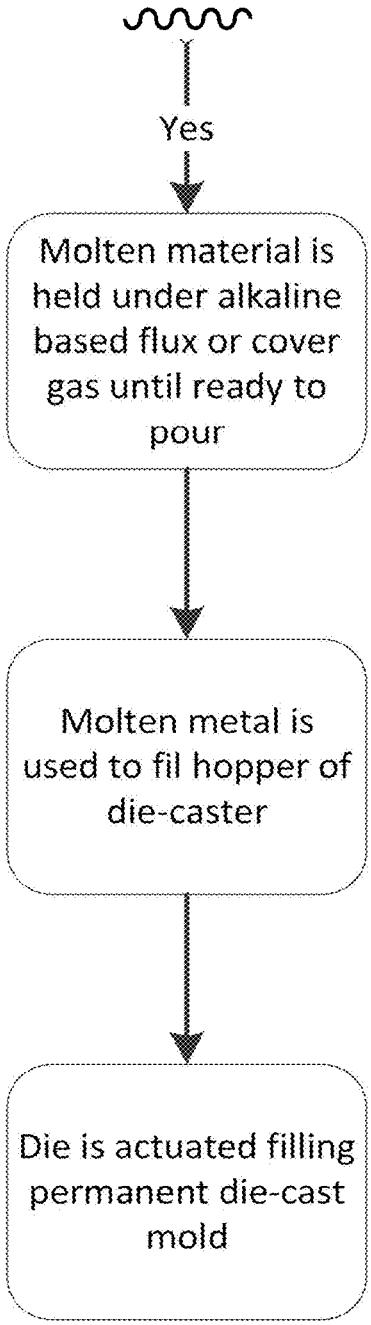
Figure 17A:
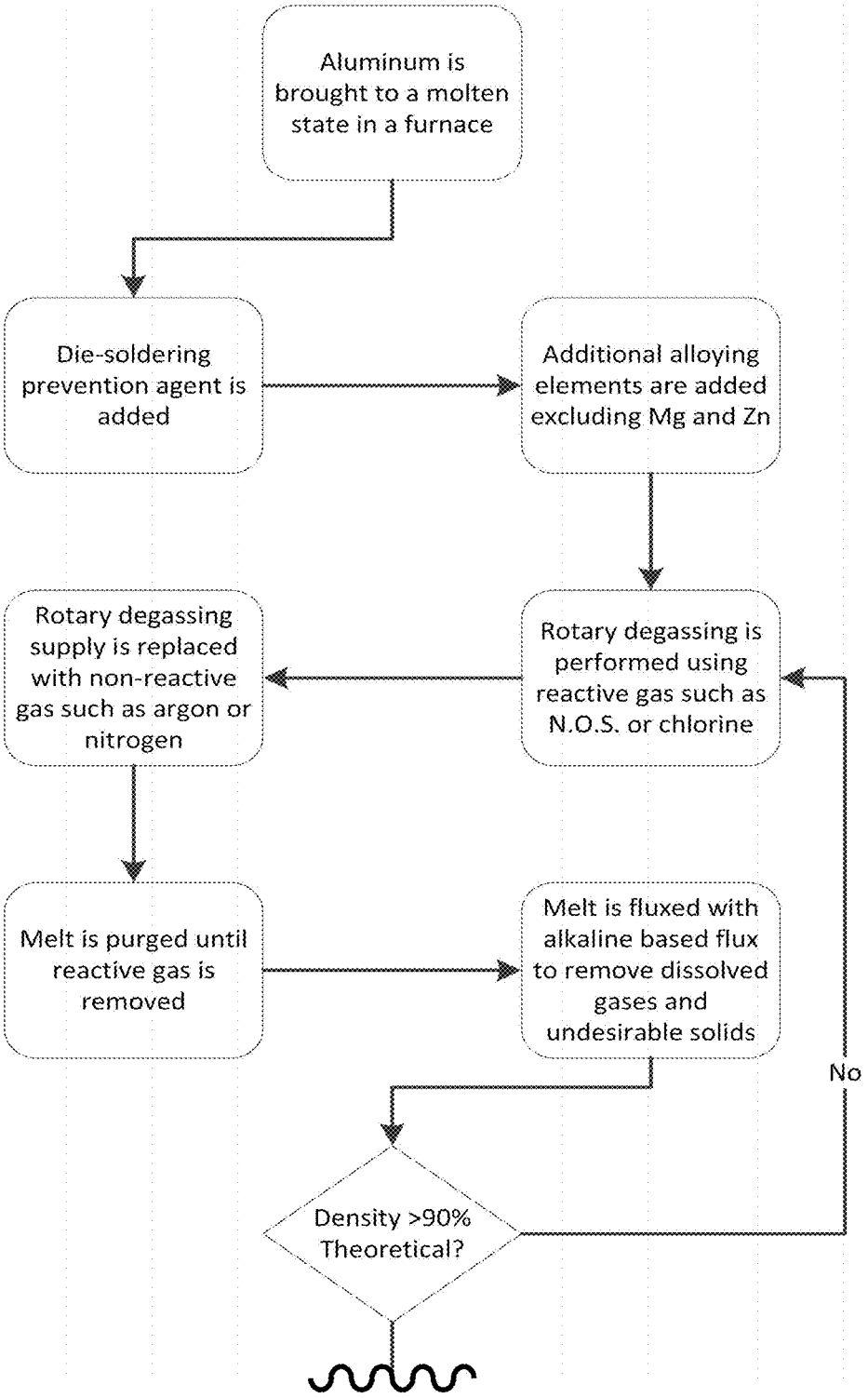
FIGS. 17A-17C are schematic diagrams of another representative method for making a die-cast aluminum-rare earth element alloy embodiment wherein Mg and Zn are added separately from and after other additional alloying elements.
Figure 17B:
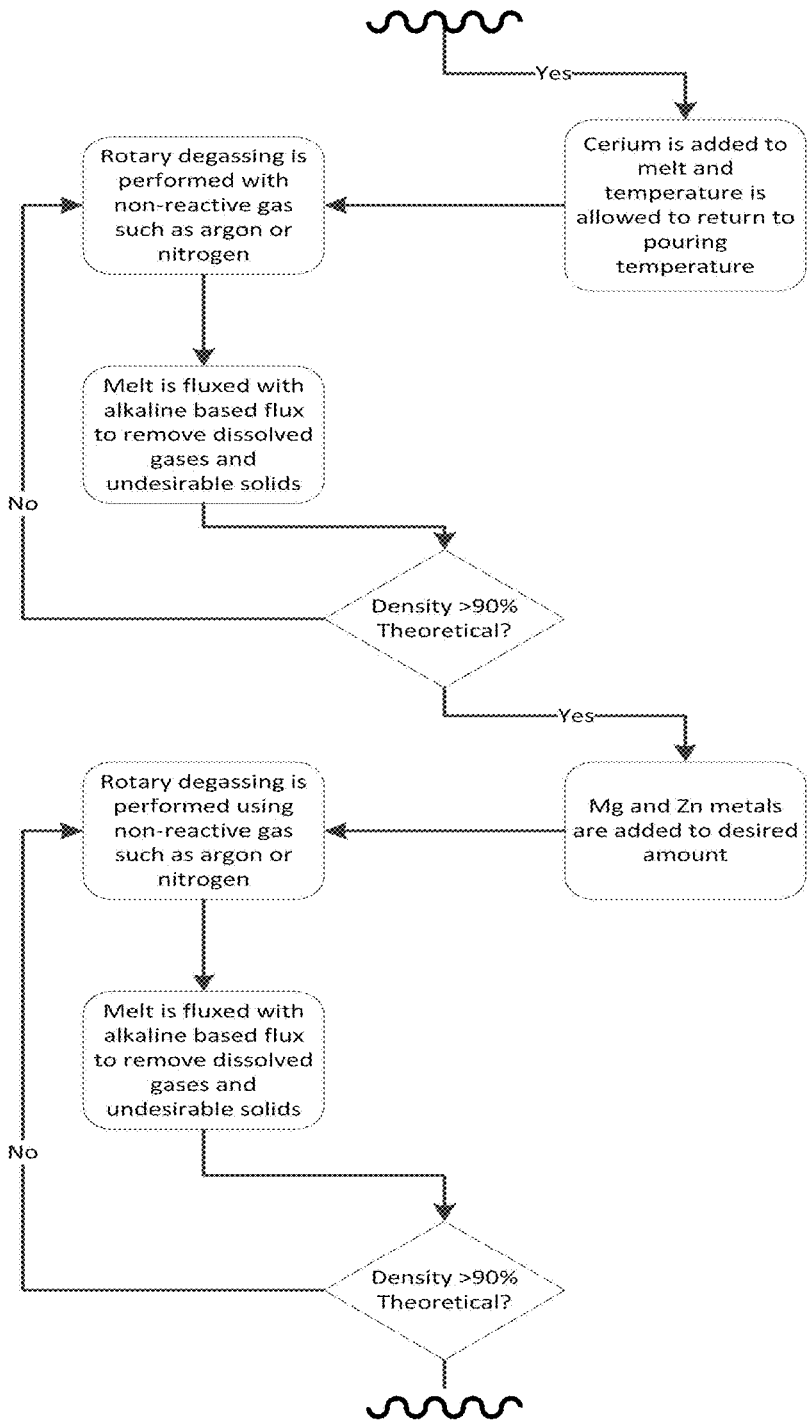
Figure 17C:
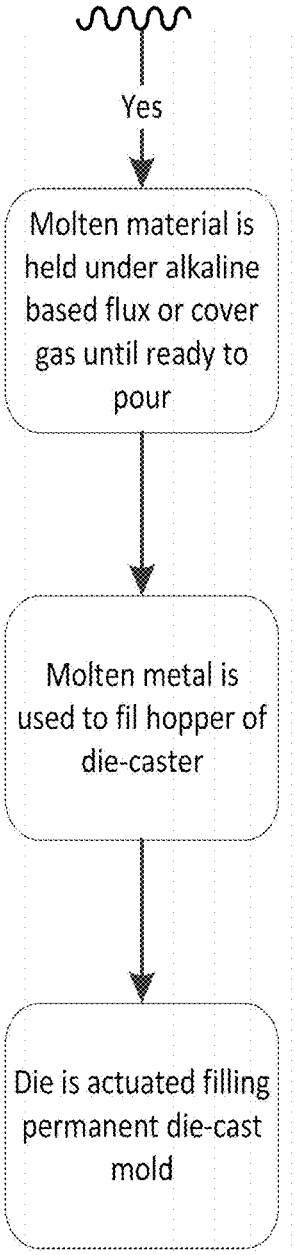

In some embodiments, particular additional alloying elements can be added to the alloy in separate addition steps. Representative embodiments of such methods are shown in FIGS. 13A, 13B, 14A, 14B, 15A, 15B, 16A-16C, and 17A-17C. In the embodiment shown in FIGS. 13A and 13B, the molten aluminum and additive component are first combined and then additional alloying elements, excluding Mg and Zn, are added. Degassing and fluxing steps are performed and then Mg and Zn are added to achieve desired amounts in the composition. Rotary degassing steps with first a reactive gas and then a non-reactive gas are used, followed by a purging step and fluxing step. The rare earth element is then added and the composition is allowed to return to a suitable pouring temperature. An additional fluxing step is used and the composition is held under the alkaline-based flux or a cover gas until it is poured into a hopper and then into the die-cast mold. In a modified method (see FIGS. 14A and 14B), the same method is used as shown in FIGS. 13A and 13B, except that before adding the rare earth element and the Mg and Zn, a purging step and fluxing step are used. Then, the rare earth element is added and the melted composition is allowed to return to pouring temperature. After degassing and fluxing steps, the Mg and Zn are added to the desired amounts. Degassing and fluxing is again carried out and the melted composition is held under the alkaline-based flux or a cover gas until pouring into a hopper and then into the die-cast mold. FIGS. 15A, 15B, 16A-16C, and 17A-17C show similar method embodiments as those shown in FIGS. 13A, 13B, 14A, and 14B, but wherein one or more density determination steps are utilized to ensure that the density is greater than 90% of the theoretical density. As shown by FIGS. 15A, 15B, 16A-16C, and 17A-17C, degassing, purging, and/or fluxing steps can be repeated until the desired density is achieved.

V. Overview of Several Embodiments

Disclosed herein are embodiments of a method of making a rapidly solidified alloy, comprising: combining aluminum with one or more additional alloying elements and at least one rare earth element to form a mixed alloy composition; and rapidly cooling the mixed alloy composition at an average cooling rate effective to form the rapidly solidified alloy, wherein a portion of the rapidly solidified alloy comprises a semi- to fully-eutectic microstructure with a maximum spacing between dominant eutectic features being no greater than 8 μm; or a cellular microstructure; or a microstructure comprising laths, particles, and/or rods.

In some embodiments, the method further comprises adding an additive component prior to or after combining the one or more additional alloying elements, the at least one rare earth element, or both with the aluminum.

In any or all of the above embodiments, the additive component is iron, strontium, manganese, titanium, cobalt, silicon, boron, chromium, carbon, or any combinations thereof.

In any or all of the above embodiments, the rapidly solidified alloy comprises greater than 0.1 wt % to 3 wt % of the iron, strontium, manganese, titanium, cobalt, silicon, boron, chromium, carbon, or the combination thereof.

In any or all of the above embodiments, the additional alloying elements are selected from magnesium, zinc, copper, titanium, manganese, nickel, zirconium, scandium, vanadium, or any combinations thereof.

In any or all of the above embodiments, the average cooling rate ranges from 100 K/s to less than 1000 K/s.

In any or all of the above embodiments, the average cooling rate ranges from 1000 K/s to $10^5$ K/s.

In any or all of the above embodiments, the average cooling rate ranges from greater than $10^5$ K/s to $10^8$ K/s.

In any or all of the above embodiments, the rapidly solidified alloy comprises 8 wt % to 12 wt % of the rare earth element and wherein the rare earth element is cerium, lanthanum, or mischmetal.

In any or all of the above embodiments, the rapidly solidified alloy comprises an $Al_{13}(Mg,Ce)_2$ phase, an $Al_{12}CeMg_6$ phase, an FCC matrix phase comprising aluminum and cerium, or any combination of such phases.

In any or all of the above embodiments, the rapidly solidified alloy consists essentially of 12 wt % cerium, 0.4 wt % magnesium, 1 wt % iron, and a balance of aluminum.

In any or all of the above embodiments, a portion of the rapidly solidified alloy comprises semi- to fully-eutectic microstructure with a maximum spacing between dominant eutectic features ranging from 0 μm to 5 μm.

In any or all of the above embodiments, the method further comprises: performing one or more fluxing steps using an alkaline-based flux composition; performing one or more degassing steps using a reactive gas or a non-reactive gas or a combination thereof in sequence; and transferring the mixed alloy composition to a die-cast mold to form a filled mold prior to rapidly cooling the mixed alloy composition.

In any or all of the above embodiments, the method does not comprise a post-processing heat treatment.

In any or all of the above embodiments, the rapidly solidified alloy does not exhibit substantial coarsening of the semi- to fully-eutectic microstructure, or the cellular microstructure, or the microstructure comprising particles and/or rods after being exposed to processing temperatures of 150° C. to 500° C. for 1500 hours.

Also disclosed herein are embodiments of making a die-cast alloy, comprising:

heating aluminum to a molten state;

adding one or more additional alloying elements;

adding a rare earth element and allowing a resulting composition to come to a pouring temperature ranging from 690° C. to 800° C.;

performing one or more fluxing steps using an alkaline-based flux composition;

performing one or more degassing steps using a reactive gas or a non-reactive gas or a combination thereof in sequence;

obtaining an alloy composition having a density that exceeds 90% theoretical density;

transferring the alloy composition to a die-cast mold to form a filled mold; and rapidly cooling the filled mold using an average cooling rate of 100 K/s to 1000 K/s.

In some embodiments, the method comprises:

(i) adding the additive component to the aluminum after the aluminum is melted to a molten state to form an additive-containing composition;

(ii) adding the one or more additional alloying elements to the additive-containing composition to form an alloy composition;

(iii) degassing the alloy composition with a reactive gas and a non-reactive gas in two sequential degassing steps;

(iv) purging the alloy composition after degassing until its density reaches greater than 90% theoretical density;

(v) fluxing the alloy composition after purging with an alkaline-based flux to provide a substantially purified alloy composition;

(vi) adding cerium to the substantially purified alloy composition to provide a cerium-containing alloy composition;

(vii) performing an additional degassing step on the cerium-containing alloy composition with a non-reactive gas and an additional fluxing step with an alkaline-based flux;

(viii) transferring the cerium-containing alloy composition to a die-cast mold to form a filled mold; and (ix) rapidly cooling the filled mold using an average cooling rate of 100 K/s to 1000 K/s.

In some embodiments, the method comprises:

(i) adding the additive component to the aluminum after the aluminum is melted to a molten state to form an additive-containing composition;

(ii) adding cerium to the additive-containing composition to provide a cerium-containing alloy composition;

(iii) degassing the cerium-containing alloy composition with a non-reactive gas;

(iv) fluxing the cerium-containing alloy composition with an alkaline-based flux to provide a substantially purified cerium-containing alloy composition;

(v) determining the density of the substantially purified cerium-containing alloy composition, wherein (a) if the density is greater than 90% theoretical density then the one or more additional alloying elements are added to the substantially purified cerium-containing alloy composition to form a mixed alloy composition; or (b) if the density is not greater than 90% theoretical density then steps (iii) and (iv) are repeated until the density is greater than 90% theoretical density and then the one or more additional alloying elements are added to the substantially purified cerium-containing alloy composition to form the mixed alloy composition;

(vi) performing additional degassing and fluxing steps on the mixed alloy composition until density of the mixed alloy composition is greater than 90% theoretical density;

(vii) transferring the mixed alloy composition to a die-cast mold to form a filled mold; and (viii) rapidly cooling the filled mold using a cooling rate of 100 K/s to 1000 K/s.

Also disclosed herein are embodiments of a rapidly solidified alloy, comprising: 5 wt % to 30 wt % of a rare earth element or a mixed rare earth composition; 0.4 wt % to 12 wt % magnesium; and aluminum; wherein the rapidly solidified alloy has a semi- to fully-eutectic microstructure with a maximum spacing between dominant eutectic features being no greater than 8 μm; or a cellular microstructure; or a microstructure comprising particles and/or rods.

In some embodiments, the rapidly solidified alloy consists essentially of 12 wt % cerium, 0.4 wt % magnesium, 1 wt % iron, and a balance of aluminum.

VI. Examples

Example 1

In this example, wedge mold studies were conducted to understand the effect of changing high cooling rate on Al—Ce-based alloys. Based on mechanical performance in low pressure mold production, six compositions from the Al—Ce—Mg system were selected for wedge mold trials:

Al-8Ce-0.4Mg, Al-12Ce-0.4Mg, and Al-8Ce-8Mg, along with the same three compositions with 1% Fe added (all percentages by weight, with remainder Al). Flowability (e.g., mold filling properties) of the alloys was evaluated and the effects of cooling rate and Fe additions on cast microstructures was characterized.

The alloys listed above were prepared by arc melting the pure elements (all greater than 99.9% pure by weight) together in an Ar environment to achieve a homogenous ingot. The ingot was then placed in quartz tubes and melted via induction heating. The molten alloys were injection cast into a Cu mold which has a rectangular opening of 5×10 mm and a depth of 35 mm by an applied pressure of Ar gas (insert pressure). Due to the wedge shape of the mold, the cooling rate for the cooling of the alloy is dependent on the vertical position along the mold. Since there are many parameters that are difficult to measure during casting (e.g. surface area that remains in contact with the mold walls, the temperature gradient through the Cu mold, etc.), calculating the exact cooling rates ($R_c$) in the wedge mold was not attempted. Previous work on metallic glass alloys, however, has shown that $R_c \sim 1/h^2$, where h is the length of the mold from the wedge tip to the largest cross-section.

Figure 18A:
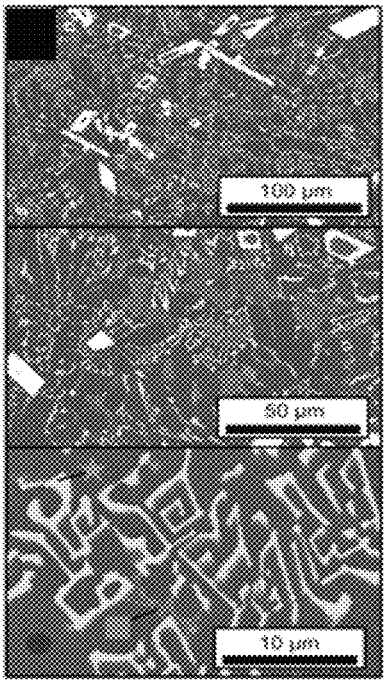
Figure 18B:
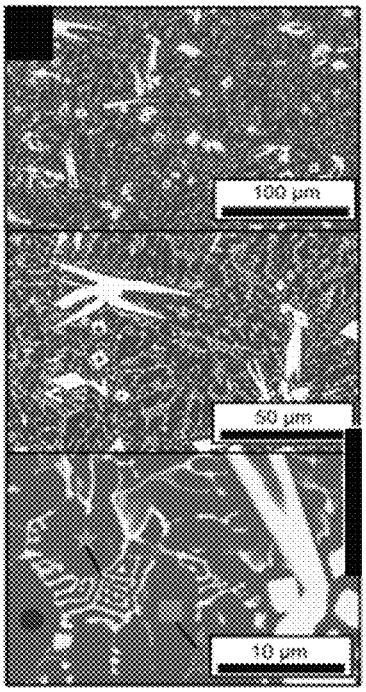
Figure 18C:
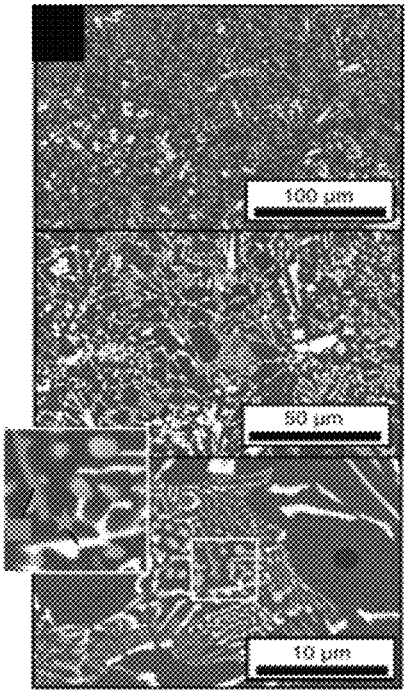

Microstructural results from the wedge mold tests for Al-12Ce-0.4Mg-1 Fe are shown in FIGS. 18A-18C and are summarized in Table 1. All micrographs were taken with a Hitachi S-4700 scanning electron microscope (SEM) with a backscattered electron (BSE) detector. In FIGS. 18A-18C, the micrographs are displayed in increasing magnification from top to bottom and the micrographs in FIG. 18A are obtained using a slow cooling rate, the micrographs in FIG. 18B are obtained using a moderate cooling rate, and the micrographs in FIG. 18C are obtained using a rapid cooling rate. Al—Ce-based alloy microstructures consist primarily of an aluminum matrix and a binary intermetallic, $Al_{11}Ce_3$, that form by a eutectic reaction upon cooling/solidification. Here, Mg is preferentially absorbed into the aluminum metal matrix (dark phase) while $Al_{11}Ce_3$ intermetallic (brightest phase) forms and strengthens the material. The addition of 1% Fe introduces another component to the eutectic microstructure (gray phase in the inset in FIG. 18C) which appears as an intermediate contrast between the matrix and $Al_{11}Ce_3$. As cooling rate increases (left to right), the primary aluminum dendrites become finer, along with a more refined proeutectic $Al_{11}Ce_3$. When comparing the highest magnification images, as cooling rate increases, the two intermetallic components of the eutectic microstructure begin to co-precipitate forming a nested eutectic microstructure at the highest cooling rate. In addition, the eutectic microstructure refines with increasing cooling rate. Overall, however, no other significant mesoscale changes in morphology or structure size were observed within the range of cooling rates during die casting. This stability suggests that variation in the rapid cooling rate of HPDC would allow for a more uniform microstructure and properties across the cast component.

TABLE 1

Composition of phases in Al—12Ce—0.4Mg—1Fe in weight percent as measured by Energy Dispersive X-Ray Spectroscopy (EDS). Icon corresponds to phases in FIGS. 18A-12C.

| Phase | Al | Ce | Fe | Icon |
|---|---|---|---|---|
| α-Al | 99.6% | 0.2% | 0.2% | ● |
| $Al_{11}Ce_3$ | 18.5% | 81.0% | 0.4% | ★ |
| $Al_{13}Fe_4$ | 65.3% | 1.2% | 32.9% | ▩ |

Example 2

Next, the effect of Fe addition was evaluated to determine if it affects microstructure and properties. As discussed above, the potential for die soldering is reduced by maintaining excess liquid Fe near the die-Al interface. Seen in FIGS. 19A-19D, the addition of Fe did not significantly affect microstructure. Electron dispersive X-Ray spectroscopy (EDS) and X-Ray diffraction (XRD) were used to determine the phases represented in each composition. In the case of the Fe-free samples, bright laths and large primary crystals of $Al_{11}Ce_3$ surrounded by a matrix of aluminum make up the two constituent phases. In the case of the high Mg compositions, Mg is dissolved into the aluminum matrix and does not participate is ternary or binary phase formation. Modification by 1% Fe leads to the formation of a binary phase $Al_{13}Fe_4$ phase, which typically forms on or near the eutectic laths, resulting from the tendency of the laths to act as nucleation sites for additional phases during cooling/solidification. Although ternary phases of Al—Ce—Fe are known to exist neither XRD nor EDS give any evidence to suggest these phases being present in the compositions investigated for this example. Additionally, due to the sensitivity limits of XRD, only the two main constituent phases are measurable and spectra can be seen in FIGS. 20A-20C. All other constituent phases exist in volume fractions below the detection and characterization limits inherent to XRD.

Figure 19A:
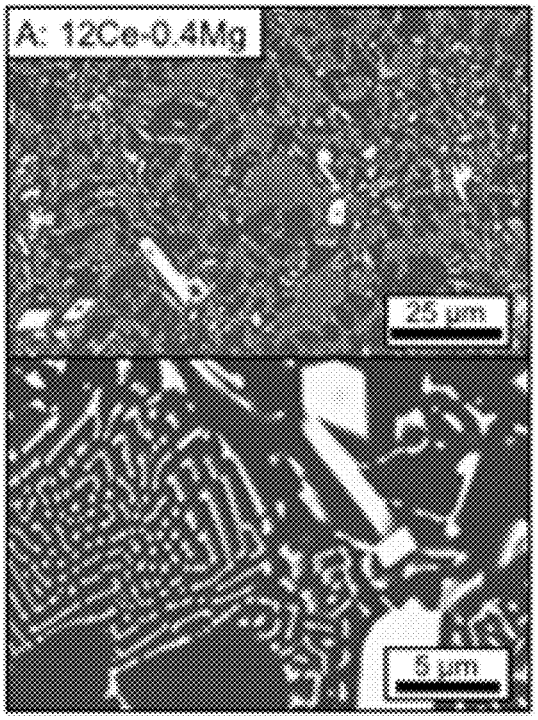
FIGS. 19A-19F are SEM backscatter images of aluminum-rare earth element alloys without an iron additive component (FIGS. 19A-19C) and with an iron additive component (FIGS. 19D-19F).
Figure 19B:
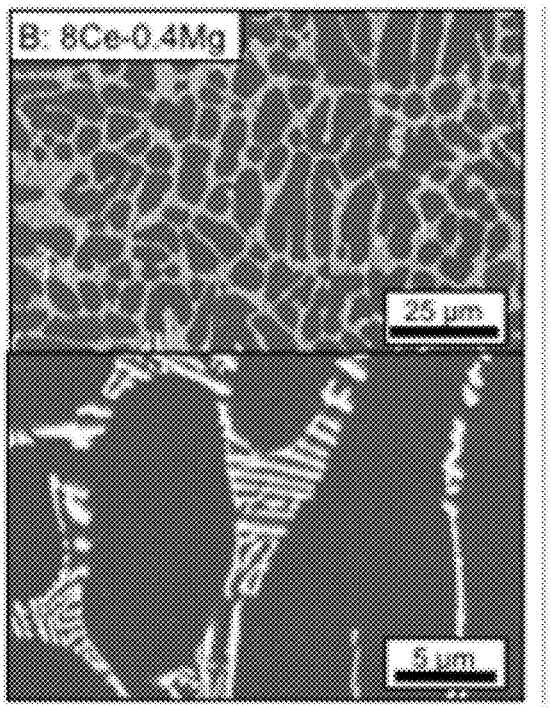
Figure 19C:
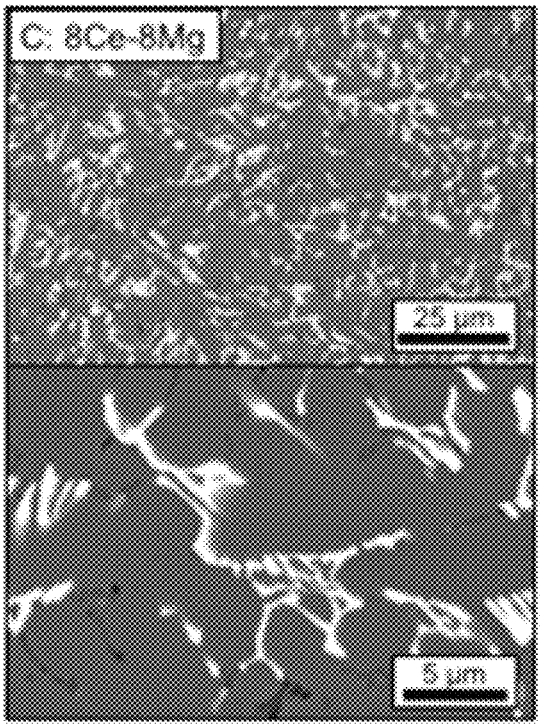
Figure 19D:
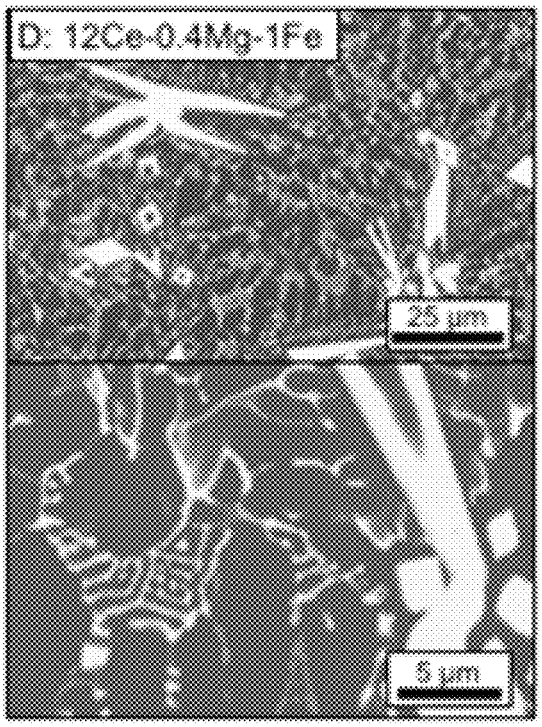
Figure 19E:
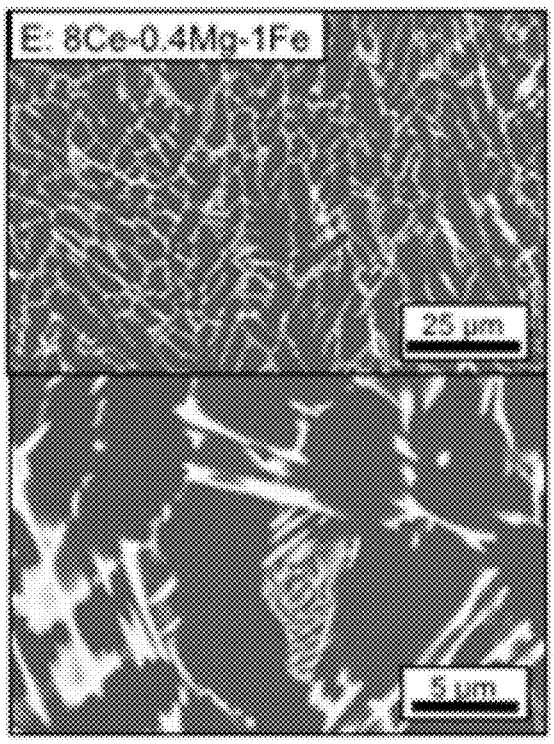
Figure 19F:
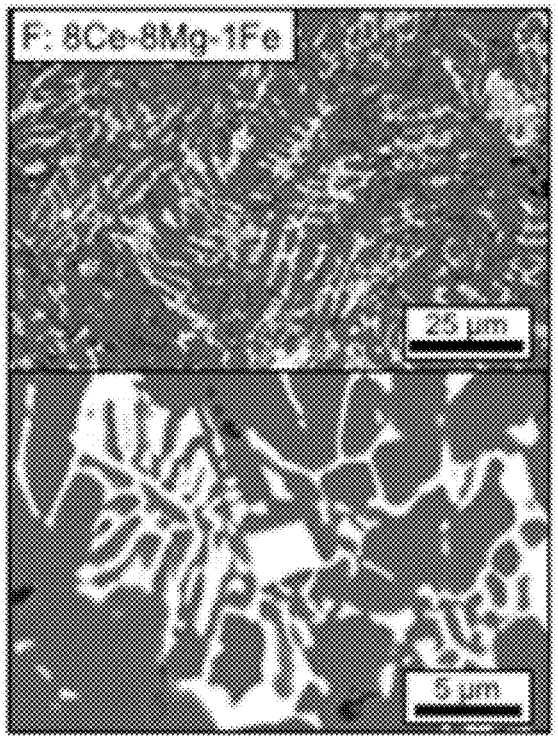
Figure 20A:
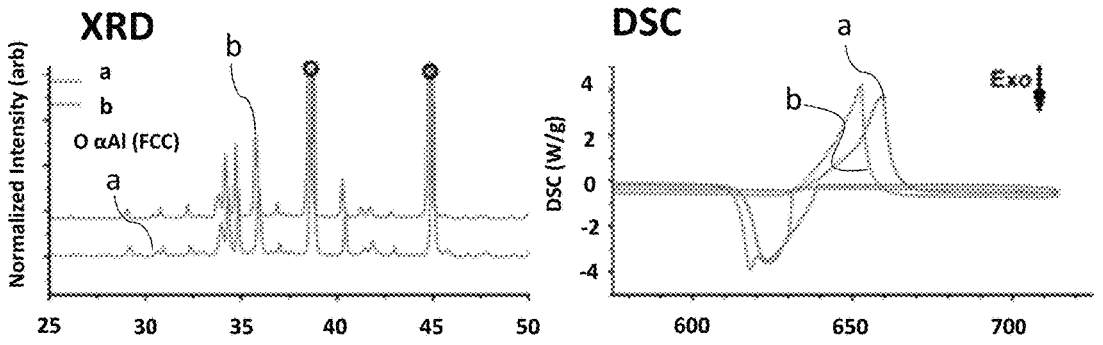
FIGS. 20A-20C are X-ray diffraction ("XRD") plots (left) and differential scanning calorimetry ("DSC") plots (right) showing the effect of iron addition on aluminum-rare earth element alloys and thermodynamics of the different alloys systems.
Figure 20B:
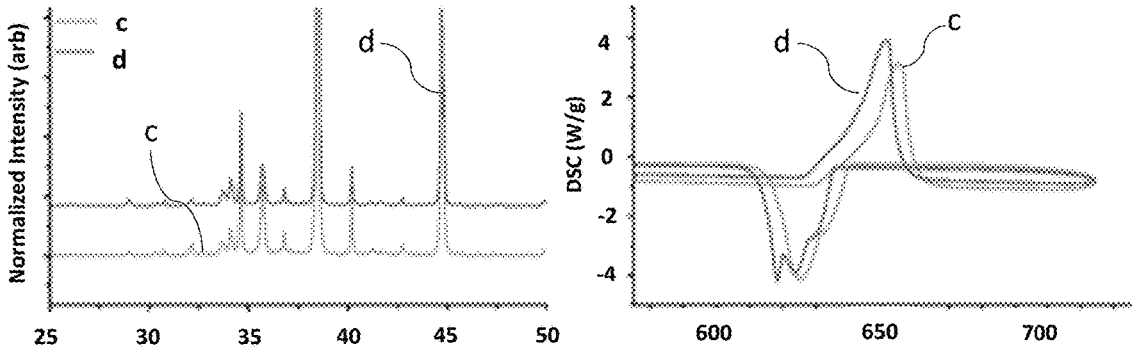
Figure 20C:
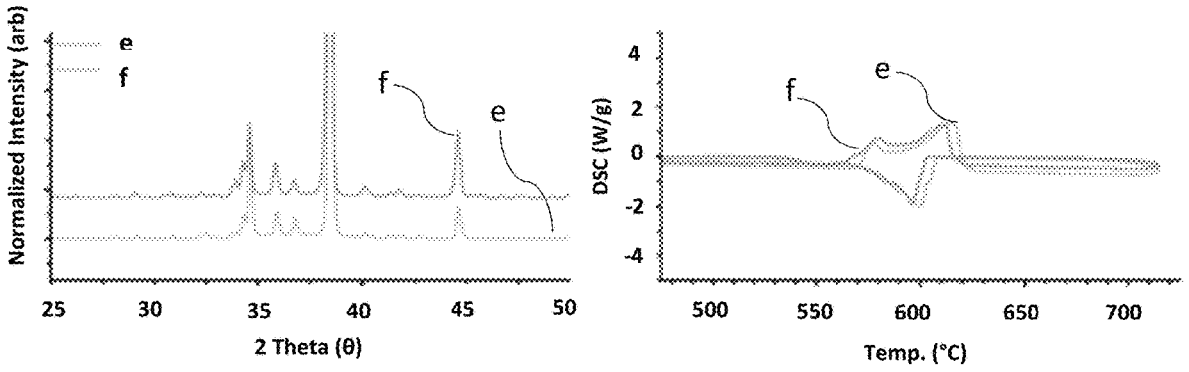

The addition of 1% Fe had little effect on the phases present and thermodynamics of the samples as was confirmed by X-Ray diffraction (XRD) using a panalytical X'Pert Pro diffractometer and differential scanning calorimetry (DSC) using a Netzsch combined DSC and TGA. FIGS. 20A-20C display the XRD profiles (left images of FIGS. 20A-20C) which show no significant changes in phases present resulting from the Fe addition. In all three model alloys aluminum and Al—Ce intermetallic peaks remain largely unchanged and the presence of the Al—Fe binary intermetallic does not appear due to its low phase fraction. The addition of Fe has had more measurable effects on phase transformation as measured by DSC (right images in FIGS. 20A-20C). The addition of 1% Fe results in a downward shift of the liquidus temperature by ~5° C. in all compositions, which can be seen in the melting offset temperatures in Table 2. Additionally, a small increase in total melting enthalpy is evident. The alloy with 8% Mg resulted in a diffuse two-step solidification peak (DSC curve "b" in FIG. 20A). Based on the cast microstructure (FIGS. 19C and 19F) it can be inferred that there is a broad solidification range where the interaction between primary dendrites combined with solute rejection of Mg into interdendritic regions between adjacent FCC dendrites results in a relatively wide temperature range prior to cooling/solidification of the eutectic regions.

TABLE 2

Quantification of DSC results from FIGS. 20A-20C; all temperatures are in degrees Celsius.

| | Melting Onset | Peak Positions | Melting Offset | ΔT Melting | Solidif. Onset | Peak Positions | Solidif. Offset | ΔT Solidif. |
|---|---|---|---|---|---|---|---|---|
| Al—12Ce—0.4Mg | 633 | 659 | 671 | 38 | 639 | 623 | 610 | 29 |
| Al—12Ce—0.4Mg—1Fe | 628 | 652 | 666 | 38 | 631 | 617, 623 | 604 | 27 |
| Al—8Ce—0.4Mg | 629 | 655 | 667 | 38 | 640 | 625, 632 | 608 | 32 |
| Al—8Ce—0.4Mg—1Fe | 625 | 651 | 663 | 38 | 635 | 618, 624, 628 | 605 | 30 |
| Al—8Ce—8Mg | 567 | 576, 614 | 626 | 59 | 608 | 588, 596, 600, 603 | 562 | 46 |
| Al—8Ce—8Mg—1Fe | 560 | 579, 611 | 624 | 64 | 603 | 583, 596 | 560 | 43 |

Table 3 summarizes Vickers hardness values obtained from analyzing wedge mold samples of different alloy embodiments in comparison to the commercial aluminum alloy A380.

TABLE 3

Comparison of Vickers Hardness values

| Alloy/Sample | Composition | Vickers Hardness (HV) |
|---|---|---|
| ALC-212.X-1A | Al—8Ce—0.4Mg | 46.2 |
| ALC-212.X-2A | Al—12Ce—0.4Mg | 64.4 |
| ALC-212.X-3A | Al—8Ce—0.4Mg—1Fe | 54.1 |
| ALC-212.X-4A | Al—12Ce—0.4Mg—1Fe | 65.8 |
| ALC-212.X-5A | Al—8Ce—8Mg | 87.9 |
| ALC-212.X-6A | Al—8Ce—8Mg—1Fe | 100.5 |
| A380 | Al—4Cu—9Si—3Zn—1Fe | 50 (calculated from Industry BH) |

To characterize the effects of cooling rate and composition on the mechanical properties, hardness testing was performed on each of the cast samples, and the results are shown in FIG. 20A. The hardness values for all the as-cast samples are consistent with or greater than (alloys with 8Mg) A380 in the T6 heat treated condition, which was tested as a baseline comparison due to its wide use as a die cast aluminum alloy. The alloys with 1% Fe additions provided slight increases in hardness over the base alloys, and with limited effects on microstructure, these additions should have an overall benefit when moving to a die casting process.

Additional mechanical property results comparing tensile strength of rapidly and non-rapidly cooled additive manufactured alloys comprising Al-8Ce-10Mg are provided in Table 4.

TABLE 4

Mechanical property summary for Additive Manufactured Al-8 wt. % Ce-10 wt. % Mg

| Build Plate Temperature | Test Temperature | 0.2% Offset Yield Stress | Ultimate Tensile Stress |
|---|---|---|---|
| Cold (25° C.) | 25° C. | 357 MPa | 512 MPa |
| | 240° C. | 325 MPa | 341 MPa |
| | 300° C. | 296 MPa | 316 MPa |
| Hot (170° C.) | 25° C. | 265 MPa | 499 MPa |
| | 240° C. | 233 MPa | 264 MPa |

Example 3

Figure 21:
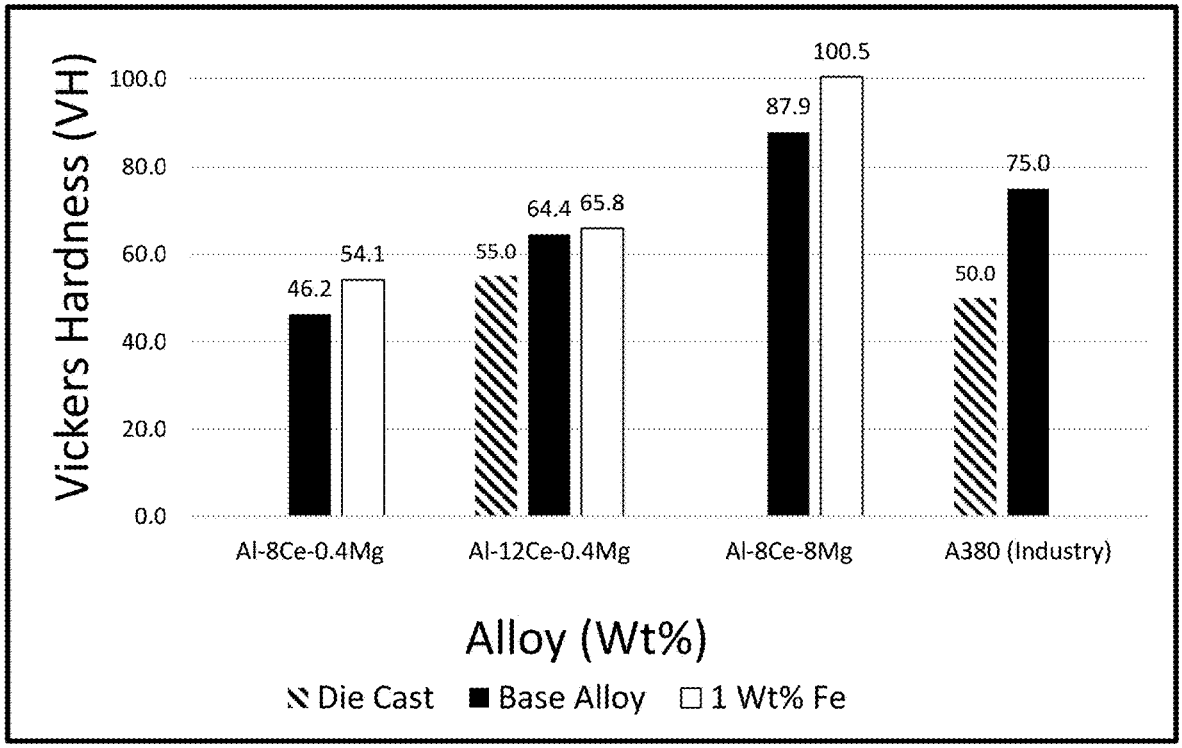
FIG. 21 is a graph of Vickers hardness measured for wedge mold samples of three different aluminum-rare earth element alloy embodiments without an iron additive component ("Base Alloy") and with 1 wt % of an iron additive component ("1 Wt % Fe); Vickers hardness for a die-cast embodiment also is illustrated for one alloy embodiment as well as for the A380 aluminum alloy.

Al-12Ce-0.4Mg-1Fe, which exhibited relatively high hardness, narrow temperature range for cooling, and good castability, was further evaluated in an industrial die-casting facility. The hardness results from this die cast alloy are also shown in FIG. 21 for comparison with the wedge mold samples. These results are favorable compared to commercial aluminum alloy, A380, with a T6 heat treatment and the slight decrease compared to the wedge mold samples could be due to differences in cooling rate or minor variations in composition as a result of the nature of industrial manufacturing.

For the industrial scale die cast trial, 4000 pounds of Al-12Ce-0.4Mg-1Fe was produced and poured into ingots. The ingots were then shipped to the die cast foundry, melted down, degassed, and prepared for production runs. The die casting trial utilized a 600 ton die cast machine and a die used for process development and qualification. The part consisted of a flat plate with holes at the corners and a curved vertical surface on one side. As a result, the cooling rate varied across the mold with the highest rate near the edge of the plate and near the holes. The cooling rate at the connection to the vertical surface was the lowest. The cooling rates during die casting are estimated to be between 15° C./s and 115° C./s. HPDC is typically not instrumented with direct measurements of thermal profiles of castings due to turbulent flow, high pressure and transient cooling rates combined with the risk of catastrophic die failure leading to explosion.

Figure 22A:
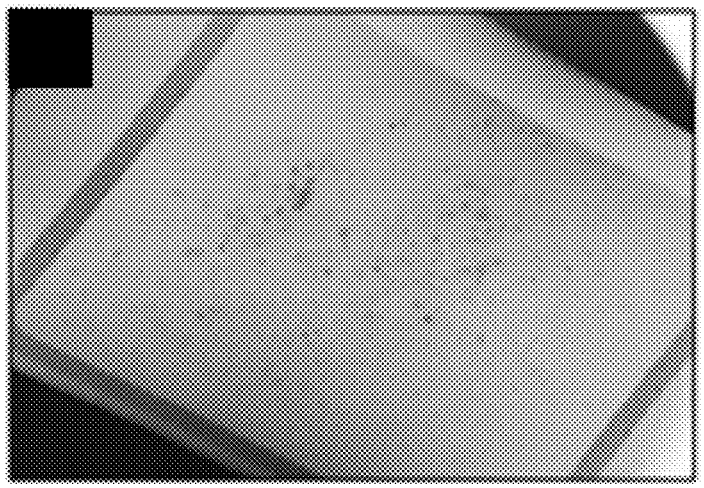
Figure 22B:
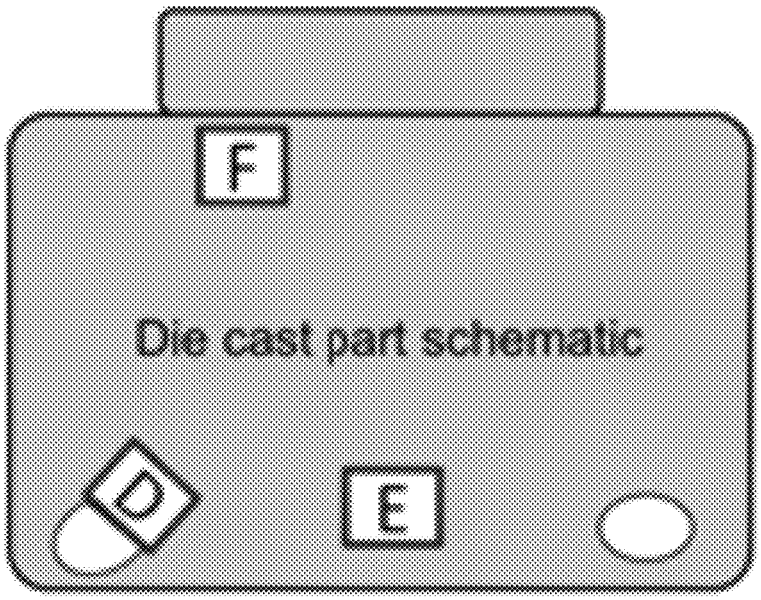
Figure 22C:
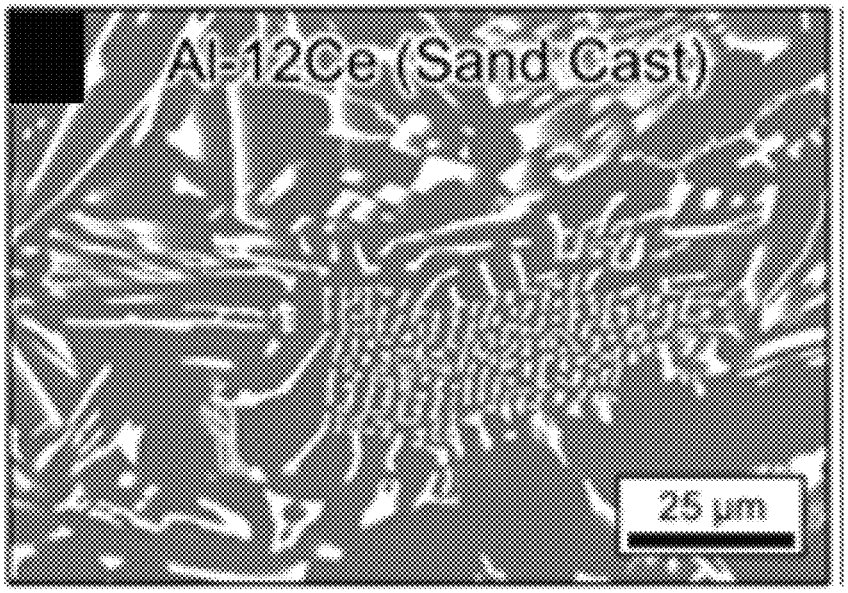
Figure 22D:
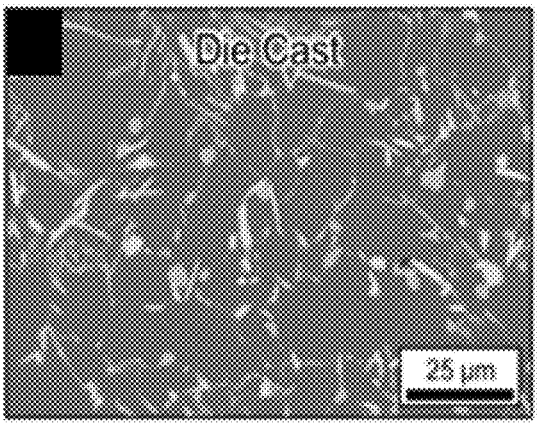
Figure 22E:
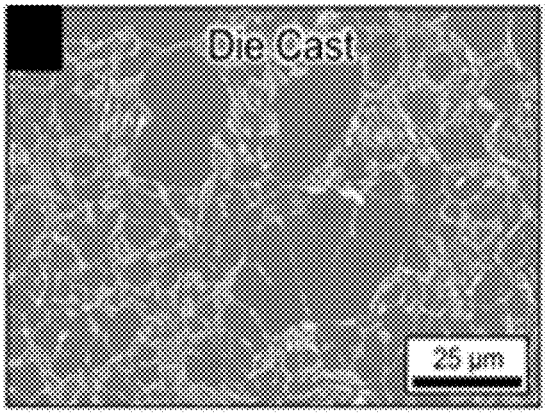
Figure 22F:
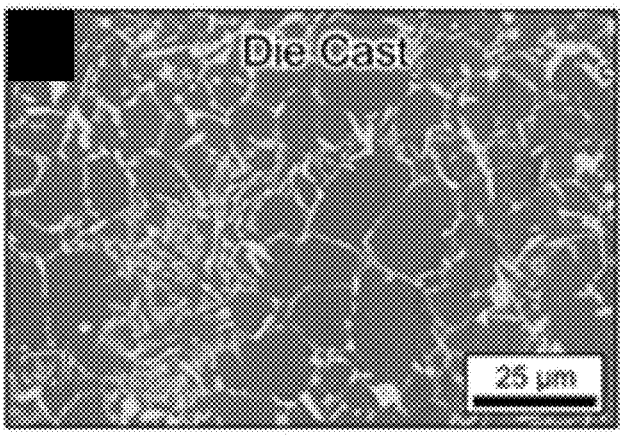

Die cast samples were selected for detailed microstructural characterization. FIG. 22A shows an X-ray radiograph of a die cast part revealing limited porosity. Multiple portions of cast parts, particularly those at the extremes of expected cooling rates (i.e. near the edge, across the hole, and near the vertical surface) were analyzed using SEM. The micrograph in FIG. 22C was taken from a sand cast binary Al-12Ce alloy and is shown for comparison. FIGS. 22D-22F are micrographs from the die cast part and were taken from the locations shown in the schematic in FIG. 22B. The formation of Al—Fe intermetallics varied slightly with cooling rate. As shown in FIG. 22D, in the highest cooling rate region, precipitation of Fe-rich phases (spherodized grey phase) is present throughout. Lower cooling rate regions do not have visible Fe-rich precipitates, but are instead characterized by a morphology representative of a eutectic co-solidification. Overall, the die cast part has a similar range of microstructural scale compared to the wedge mold castings, hence casting into a wedge mold is an adequate screening tool for alloy compatibility with die casting.

The eutectic structure was evaluated and the properties from the more cellular structures observed in the high cooling rate regions of the wedge mold samples exhibited an average hardness value between 60-70 HVN. The die cast samples, however, exhibited a similar microstructure to those observed in the wedge mold with a lower average hardness (50-60 HVN). The hardness (FIG. 21) was measured based on an average from all regions observed in FIG. 22B. Without being limited to a particular theory, it currently is believed that this slightly lower hardness could be attributed to microporosity and impurities associated with large scale processing. The Al-12Ce-0.4Mg-1Fe alloy exhibited good fluidity and no major casting defects at comparable settings used for A380 with a ~10° C. increase in melt temperature. The fill shot time was increased by approximately 0.25 seconds to accommodate for turbulence issues associated with the higher fluidity of the alloy. These results from the die casting trial suggest that casting compositions with more complex solidification paths, such as that found in the higher strength 8% Mg alloy, is feasible.

Figure 23:
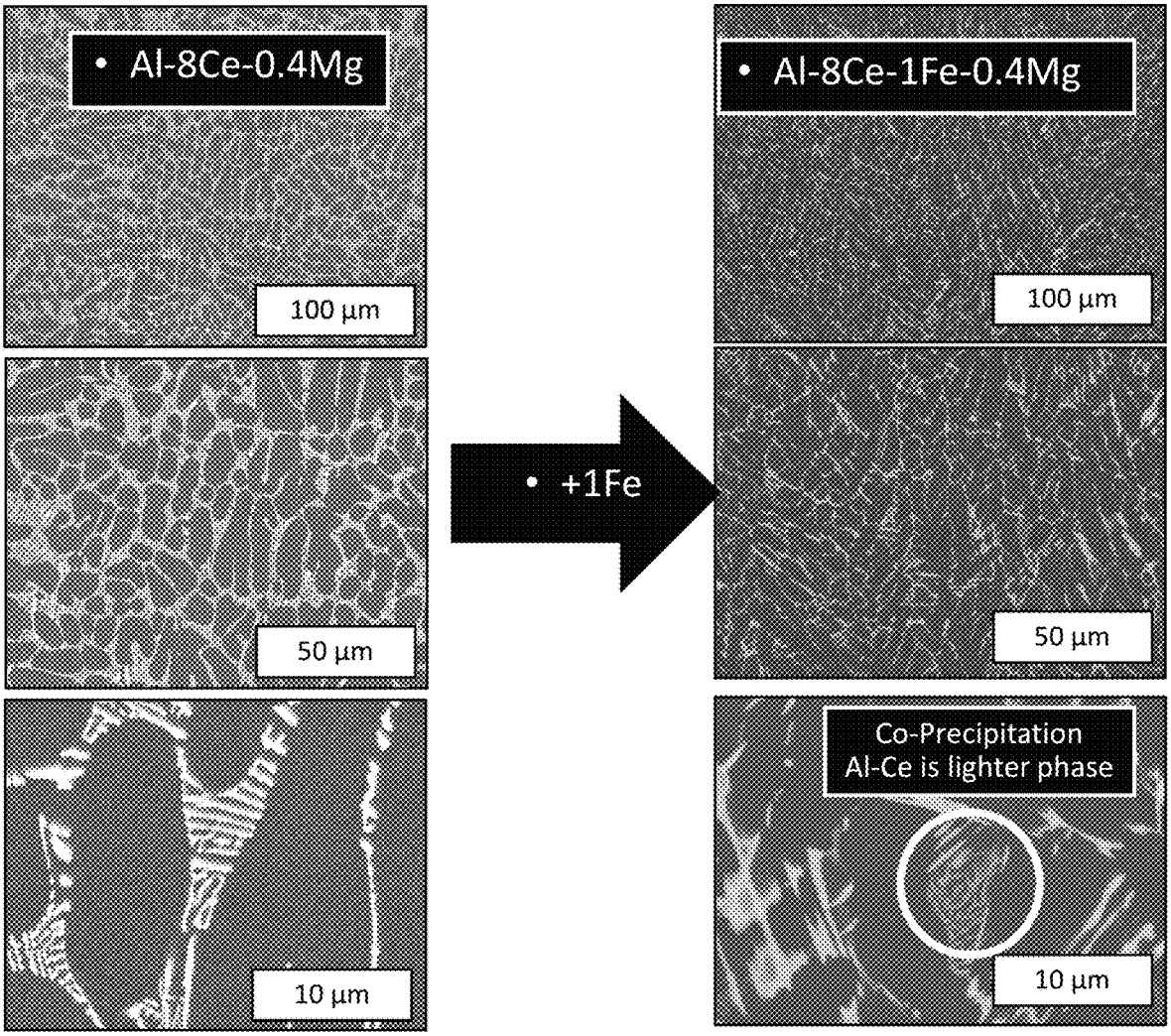
FIG. 23 provides a compilation of SEM images showing the influence of an iron additive component on the microstructure of a representative aluminum-rare earth element alloy, wherein the left images show three different magnifications of the microstructure without iron and the right images show three different magnifications of the microstructure with iron.
Figure 24:
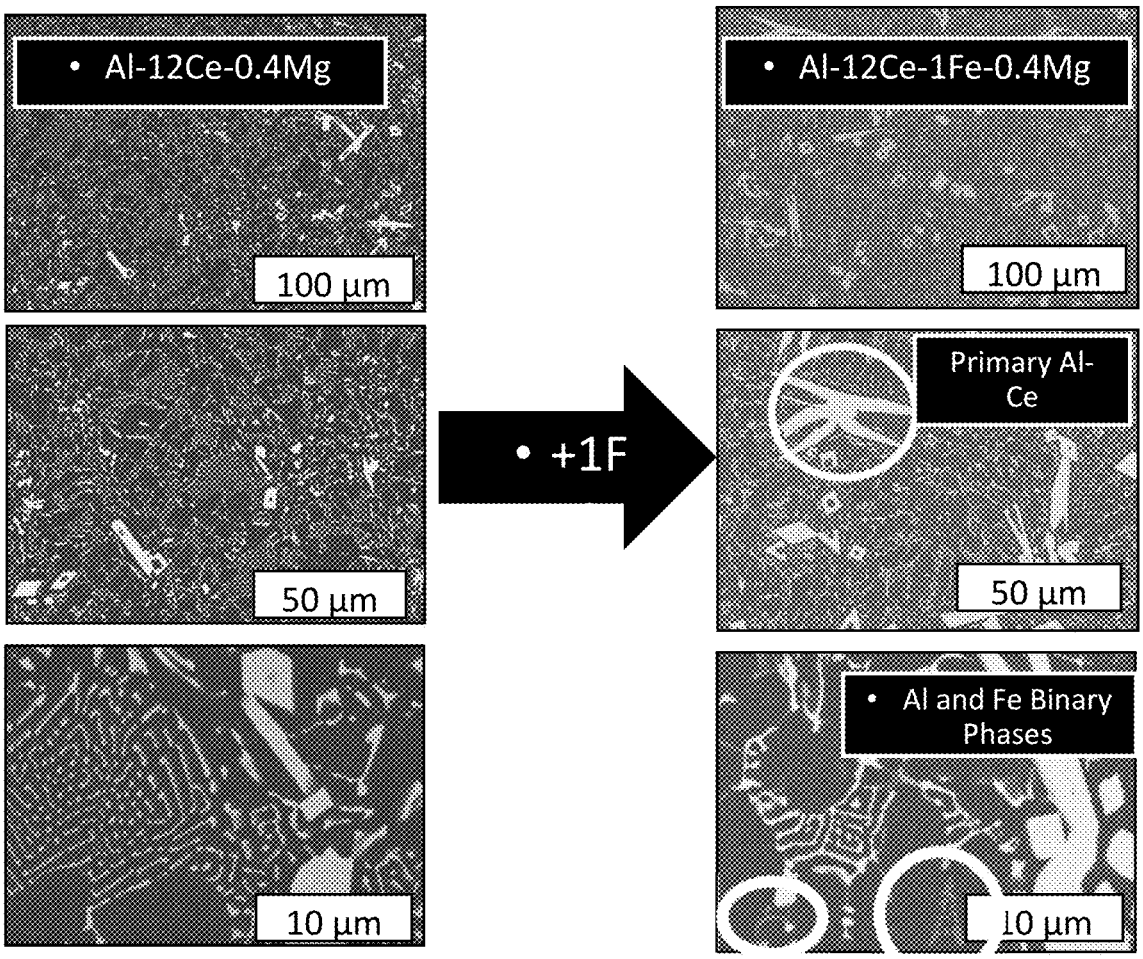
FIG. 24 provides a compilation of SEM images showing the influence of an iron additive component on the microstructure of another representative aluminum-rare earth element alloy, wherein the left images show three different magnifications of the microstructure without iron and the right images show three different magnifications of the microstructure with iron.
Figure 25B:
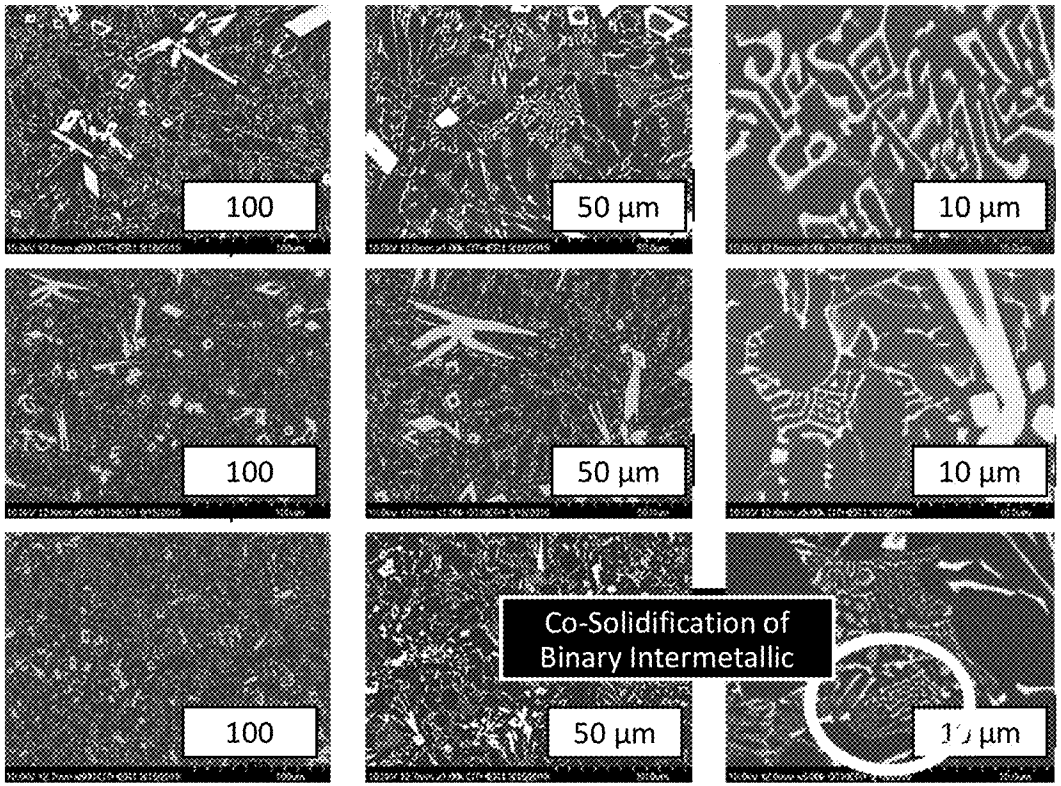
FIGS. 25A and 25B show a die-cast aluminum alloy (FIG. 25A) and SEM images (FIG. 25B) obtained from analyzing different sections (i.e., end, middle, and tip) of the die-cast aluminum alloy shown in FIG. 25A at different magnifications.
Figure 25A:
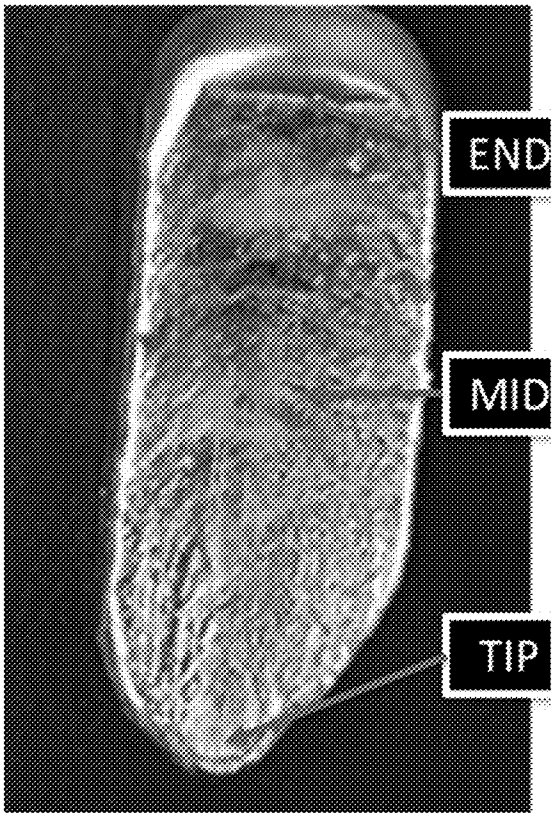

Additional results from alloy embodiments modified to include an iron additive component are shown by FIGS. 23 and 24. FIG. 23 shows the microstructure of one alloy, Al-8Ce-0.4Mg, before iron addition (left) and after (right). As shown by FIG. 23, the addition of iron results in a finer microstructure as evidenced by lower average distance between laths and smaller cellular zones. Another example using an Al-12Ce-0.4Mg alloy is shown by FIG. 24. As shown by FIGS. 25A and 25B, changes in microstructure may be found in different regions of the cast alloy. As shown by FIG. 25B, a representative die-cast alloy exhibits linear co-solidification of the Al—Fe binary intermetallic more predominantly in a high cooling rate region (e.g., the tip of the die-cast alloy shown by FIG. 25A) as opposed to other regions (e.g., the middle and end of the die-cast alloy of FIG. 25A).

Figure 26A:
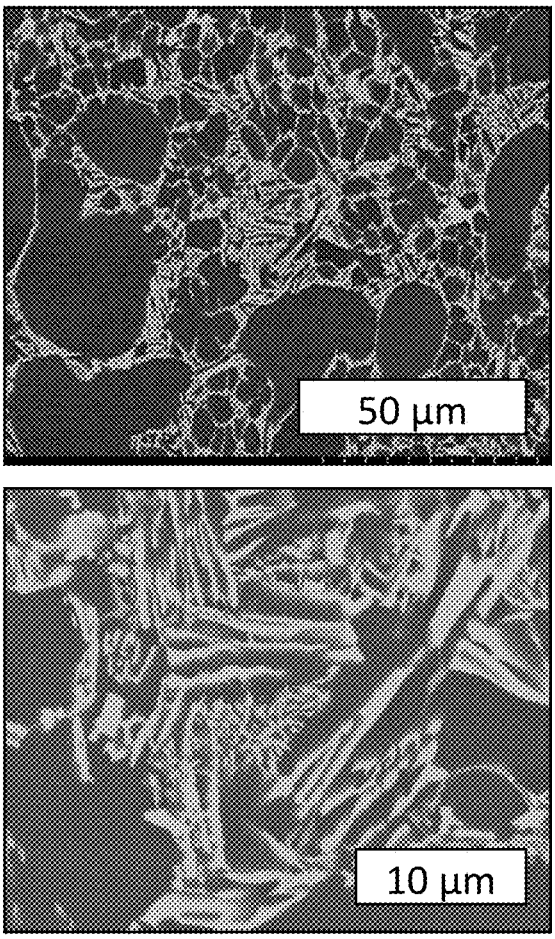
FIGS. 26A and 26B are SEM images that show differences in the microstructure of a representative aluminum-rare earth element alloy at different magnifications using a slow cooling rate (FIG. 26A) and a rapid cooling rate (FIG. 26B).
Figure 26B:
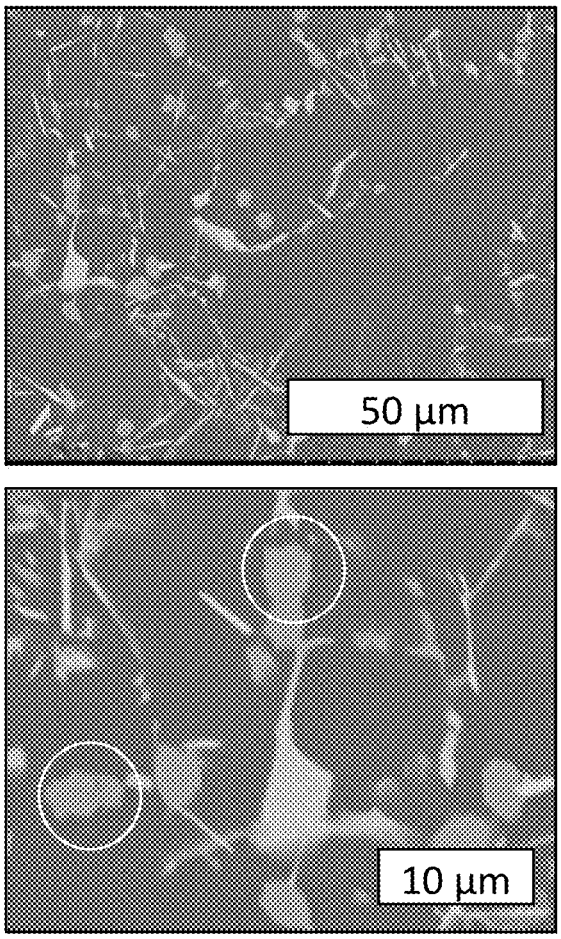
Figure 27A:
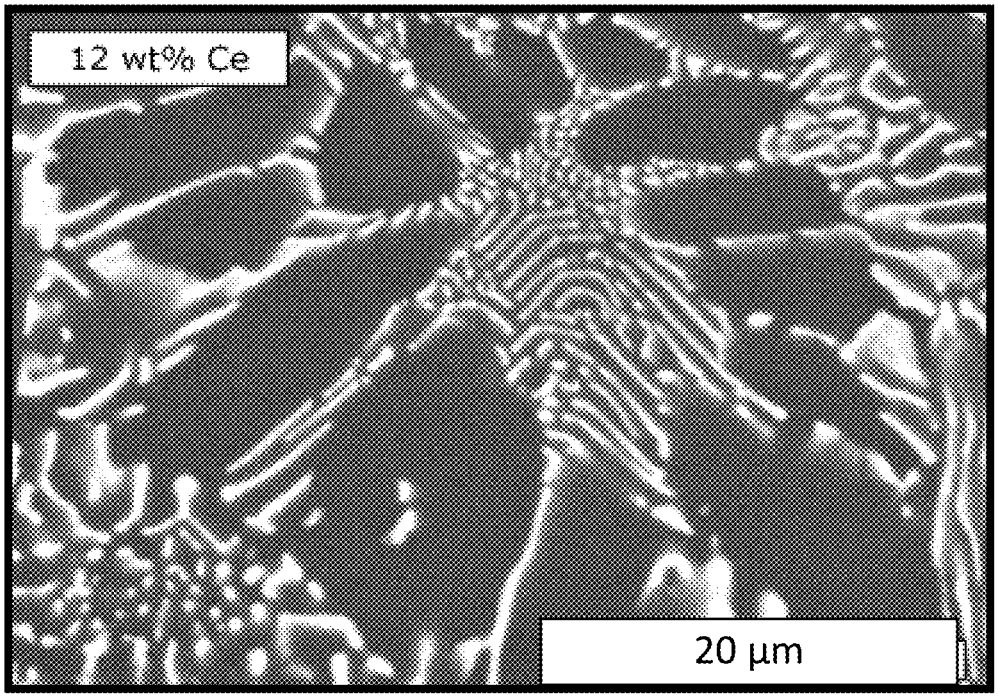
FIGS. 27A and 27B are SEM images of a permanent mold alloy (FIG. 27A) and a representative die-cast aluminum-rare earth element alloy (FIG. 27B), which illustrate that the microstructure of the die-cast alloy is cellular and less continuous then the permanent mold alloy.
Figure 27B:
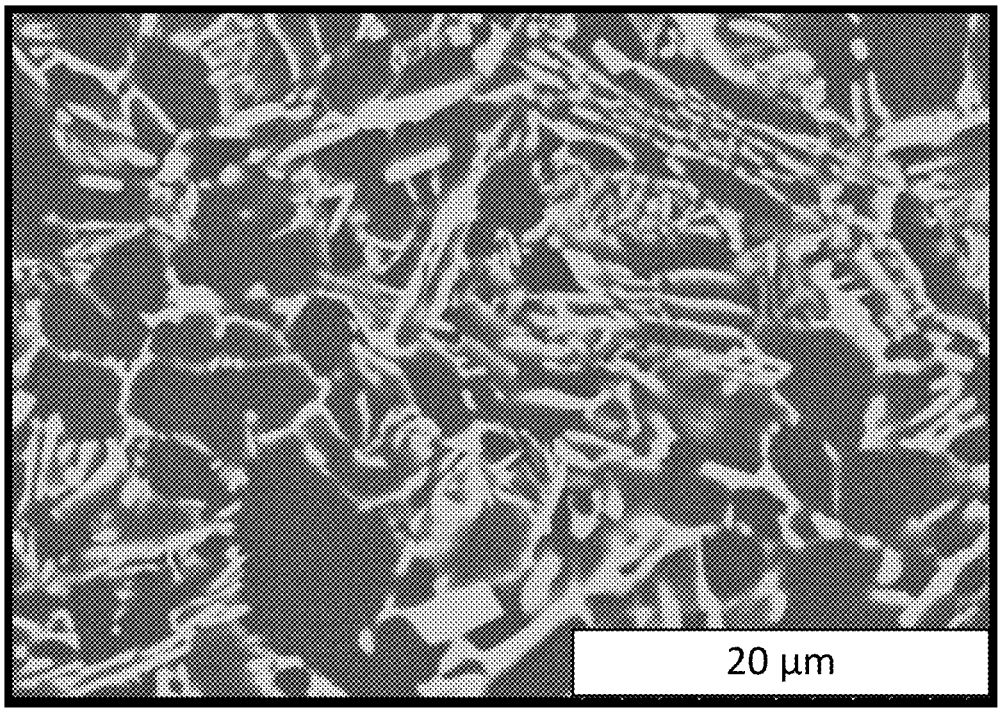

In some examples, such as in the alloys shown by FIGS. 26A and 26B, it was observed that at slower cooling rates in the bulk, the additive component (e.g., iron) precipitates on the edge of Al—Ce binary structures (FIG. 26A) and also appears to result in a more intermingled structure between phases, whereas at rapid cooling rates the Fe appears to react with the aluminum to form a beta-Fe (Al5Fe) phase (FIG. 26B). FIGS. 27A and 27B also confirm that the microstructures of die-cast alloys described herein are different from those that are obtained without rapid cooling, such as cast alloys obtained using a permanent mold.

Example 4

In this example, four total phases of an aluminum-rare earth alloy embodiment were identified, the primary $Al_{FCC}$ phase (FIG. 2), the $Al_{11}Ce_3$ phase (FIG. 1), and two new phases unique to the alloy embodiments of the present disclosure, namely a solid solution $Al(Ce)_{FCC}$ phase (FIG. 3) and a nanocrystalline ternary phase (tau phase). This tau phase can be composed of up to two different ternary phases, as illustrated in FIGS. 4 and 5. The solid solution $Al(Ce)_{FCC}$ will not form under normal cooling rates due to the extreme preference for Al and Ce to form stable intermetallic compounds. However, under very rapid cooling rates, such as those described herein, the solid solution $Al(Ce)_{FCC}$ can be observed. This phase is almost completely coherent with the surrounding $Al_{FCC}$ matrix, which contributes to the high-strength exhibited by the alloys. The tau phase also will not form under slow cooling rates. Instead, it can only be seen in as-processed samples which undergo solidification at very rapid cooling rates.

Figure 28:
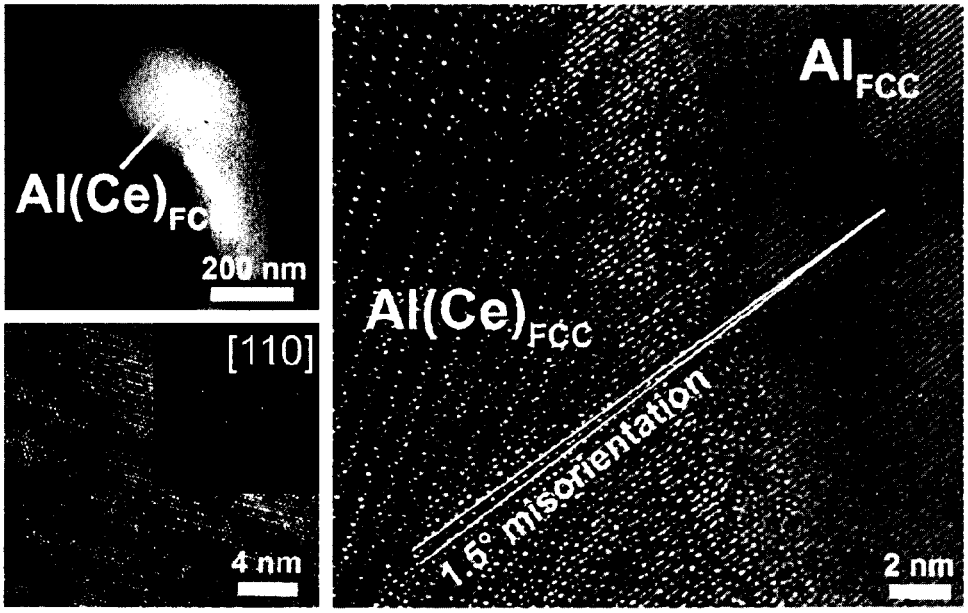
FIG. 28 provides TEM images obtained from dark field imaging of a unique Al—Ce phase of a representative alloy that is an FCC solid solution of Ce and Al, wherein the Ce is present in an amount of up to 25% and thus making it a coherent $Al_{FCC}$ phase with Ce in solid solution.
Figure 29:
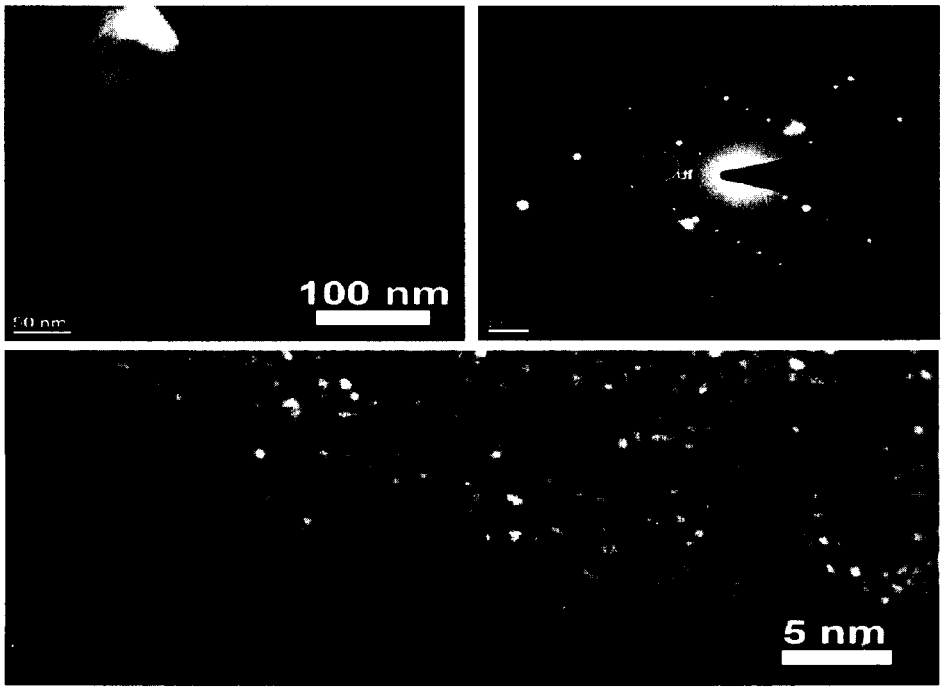
FIG. 29 provides TEM images obtained from dark field imaging and selected area diffraction of a unique $Al_{12}CeMg_6$ phase that is achieved in alloy embodiments disclosed herein using rapid solidification rates disclosed herein.

An imaging technique that uses only the diffracted electron beam from similarly oriented phases, called dark field imaging, with an aperature over the ring reveals an agglomeration of extremely small nanocrystals (<1 nm), FIGS. 28 and 29 (Tau Phase). Without being limited to a particular theory, it currently is believed that this intermetallic phases is formed due to an interplay between partitioning of Mg and Ce that leads to the three intermetallic phases.

Figure 30:
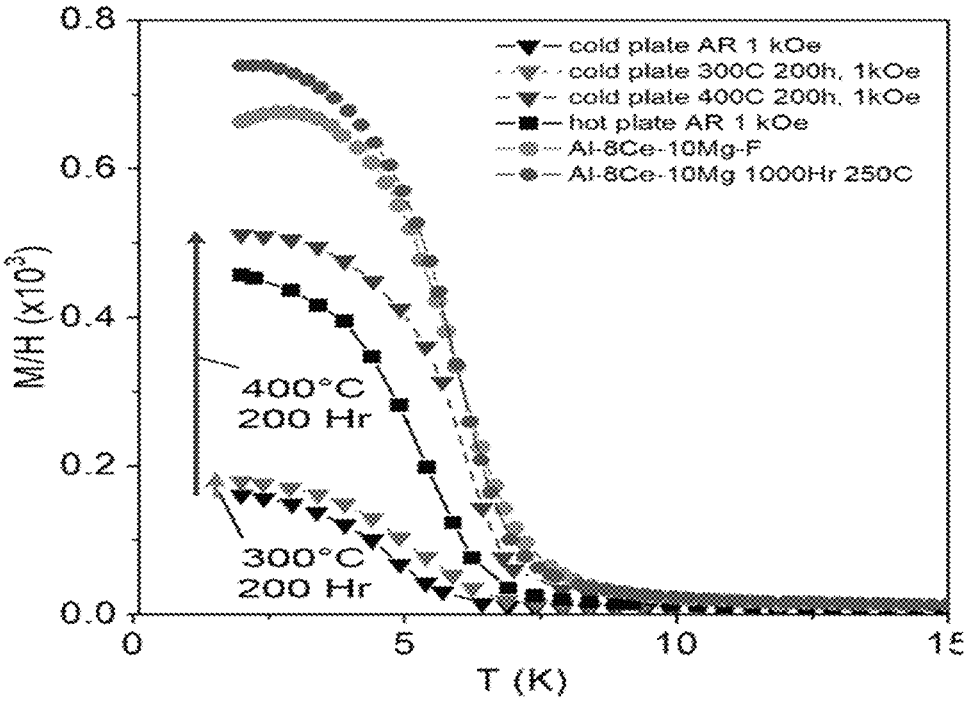
FIG. 30 is a graph of magnetization as a function of temperature (K) showing the thermal behavior of alloys described herein that have been additively manufactured.
Figure 31:
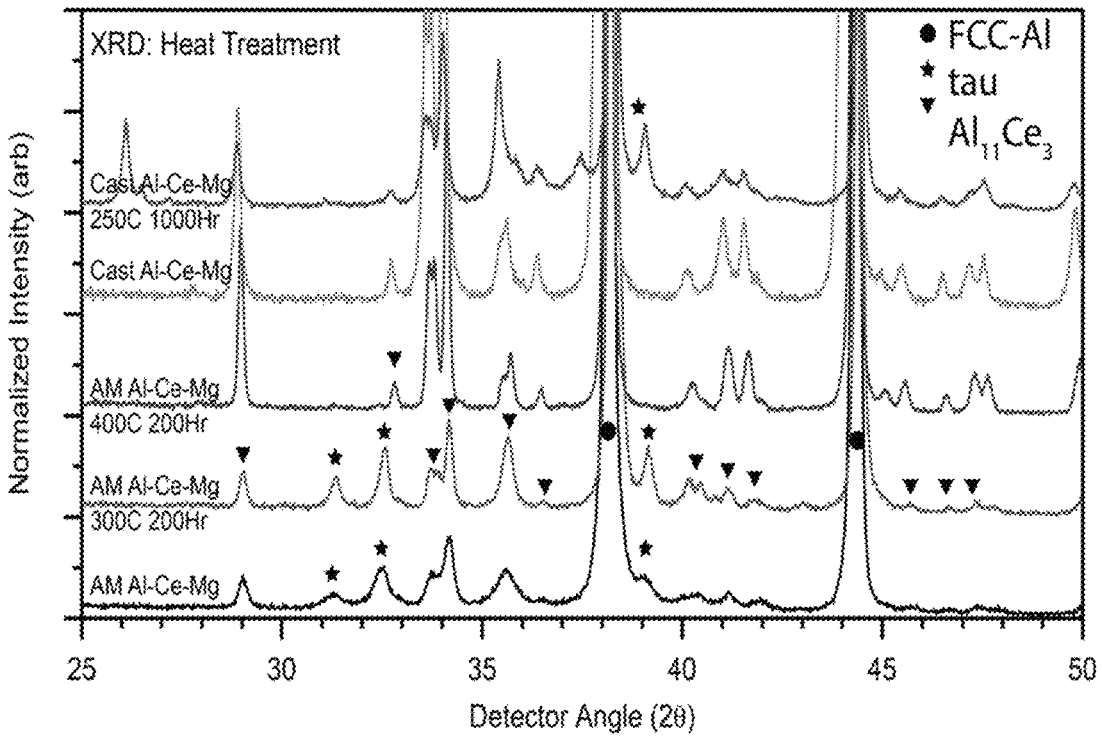
FIG. 31 is an XRD plot showing different phases obtained from representative alloy embodiments described herein as well as a comparative alloy that is cast without rapid cooling ("cast Al—Ce—Mg").

An investigation of the thermal response of the AM Al—Ce—Mg also was conducted using magnetization measurements at low temperature (FIG. 30) and x-ray diffraction at room temperature (FIG. 31). To further quantify the thermal stability of the AM Al—Ce—Mg alloys, different annealing treatments were used, with results in FIG. 30. Bulk quantitative measurements of phase fraction changes during annealing can be difficult for the different intermetallic phases due to their small-length scales. Tracking the change in the magnetization of the alloy, however, is an effective measurement of the fraction of $Al_{11}Ce_3$ since it exhibits a characteristic ferromagnetic transition around 7K that is well correlated to the microstructure. Al11Ce3 undergoes magnetic phase transition below about 8 K, which can be used to probe the intermetallic in these alloys. Upon cooling, the magnetization increases sharply and reaches a saturation value near 2 K, and the magnetic response arises almost entirely from the cerium. Thus, the magnetization measured at 2 K indicates the amount of Al11Ce3 present in the alloy, or for a fixed alloy composition the fraction of the total Ce that is present in the Al11Ce3 intermetallic. The 2.5× difference between the magnetization of the hot-plate (squares) and cold-plate (triangles for "cold plate AR 1 kOe") AM samples as printed indicates a significantly lower concentration of Al11Ce3 in the cold-plate specimen. This is associated with the additional Ce-bearing phases noted above in the microscopy analysis. Annealing the cold-plate AM material at 300° C. for 200 hours had little effect on the magnetic response (triangles for "cold plate 300 c 200 h, 1 kOe"). Annealing at a higher temperature of 400° C. for the same time (triangles for "cold plate 400 C 200 h, 1 kOe") strongly enhanced the magnetic response, suggesting the conversion of other phases to Al11Ce3 and indicating that dissolution and diffusion of tertiary phases occurs only above 300° C. The magnetic susceptibility reaches $0.5\times10^{-3}$ at 2K after the 400° C. anneal, similar to the value seen in the hot-plate AM as-printed sample, and corresponding to $0.09\times10^{-3}$ per wt. % Ce for this Al-5.5 wt % Ce-8 wt % Mg alloy. Also shown on FIG. 30 are data for non-rapidly cooled cast alloys with 8% Ce, in which Al(Mg) and Al11Ce3 are known to be the only phases present. Their magnetic susceptibility at 2 K is about $0.7\times10^{-3}$, which also corresponds to $0.09\times10^{-3}$ per wt. % Ce.

Figure 32:
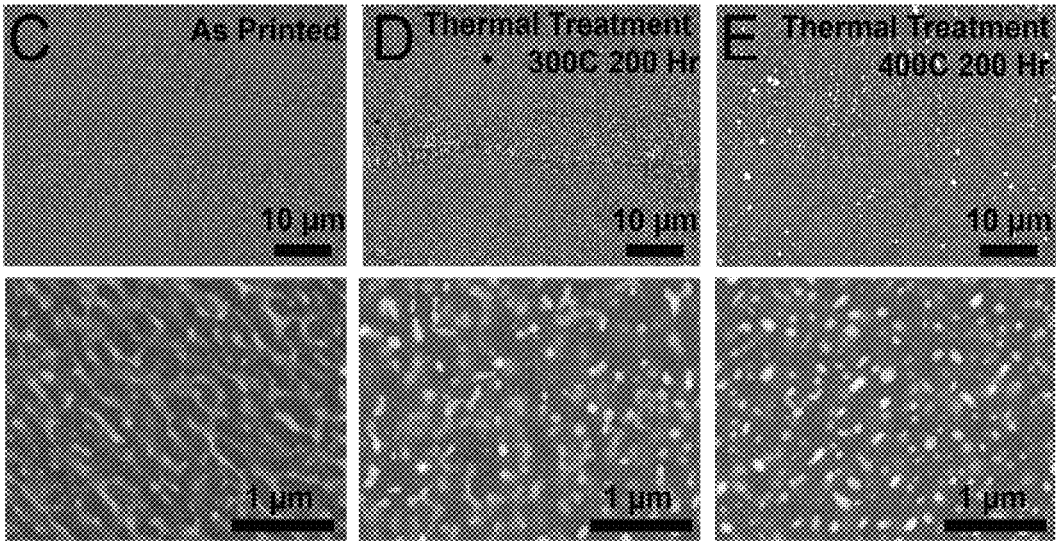
FIG. 32 provides images taken at different magnifications of the microstructure of a representative alloy embodiment before (left images) and after (middle and right images) different thermal treatments.
Figure 33:
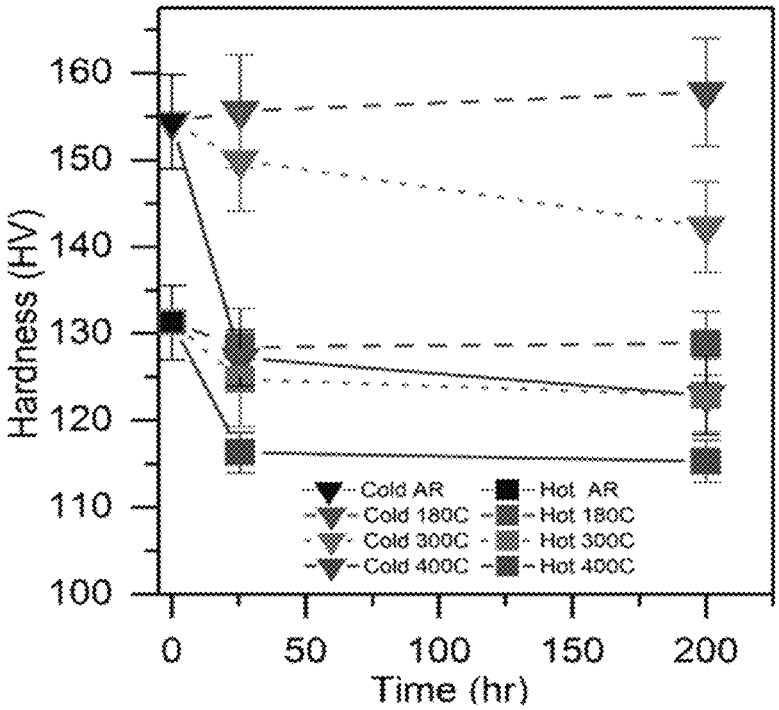
FIG. 33 is a graph of Vickers hardness as a function of time showing mechanical retention of Al—Ce rapidly cooled alloys, which provides results obtained from analyzing the strength of different alloy embodiments.

This interpretation of the magnetic data is supported by the x-ray diffraction data shown in FIG. 31 for the cold-plate AM sample with comparison to the cast alloys. XRD of the AM Al—Ce—Mg samples reveal the different transitions that occur during annealing at different temperatures and times. The as-printed sample contains at least three phases, FCC-Al, Al11Ce3, and tau. Little change in the phase fractions is seen after annealing at 300° C., though crystallinity of the secondary phases is improved. After heating at 400° C. the fraction of the Al11Ce3 intermetallic is significantly increased while the tau phase vanishes, giving a diffraction pattern similar to the cast alloy. Interestingly, heat treating the AM Al—Ce—Mg sample at 400° C. for 200 hours yields an XRD pattern very similar to the cast Al—Ce—Mg, which is also shown in FIG. 31. Unlike the AM sample for which the $\tau_1$ phase is present in the as printed state, this phase can only be achieved in the cast material after heat treatment for 1000 hours at 250° C. Microstructures of the as-printed and thermally treated samples are presented in the images provided by FIG. 32. Spheroidization of the intermetallic phases is evident at 300° C., but almost no coarsening of the structure is found due to the low solubility of Ce in Al. Self-diffusion within the matrix and reinforcement permit changes in shape to minimize interfacial energy, but without ripening. Room temperature Vickers hardness measurements of the heat-treated materials are provided by FIG. 33.

Figure 34A:
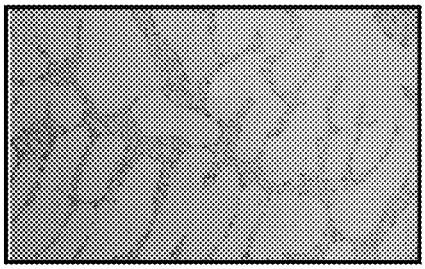
FIGS. 34A-34G are SEM images of an Al—Si alloy before (FIG. 34A) and after (FIG. 34B) heat treatment as well as images of a representative alloy embodiment that has been slow cooled, wherein the images show the alloy before (FIG. 34C) and after (FIG. 34D) heat treatment; and magnified images of the representative alloy's microstructure using rapid cooling rates described herein (FIGS. 34E-34G).
Figure 34B:
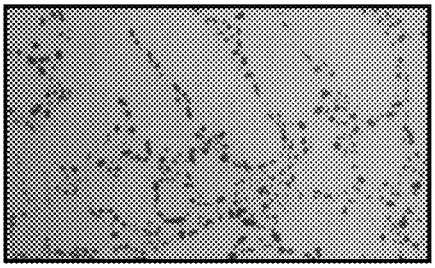
Figure 34C:
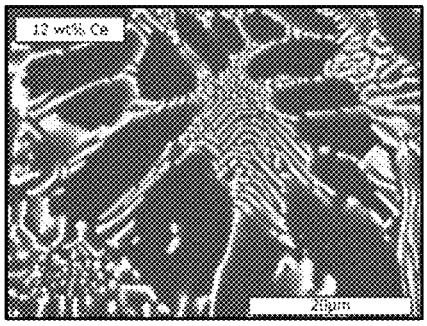
Figure 34D:
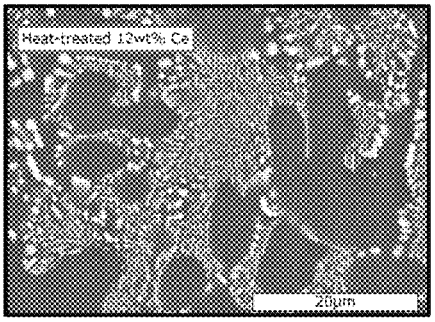
Figure 34E:
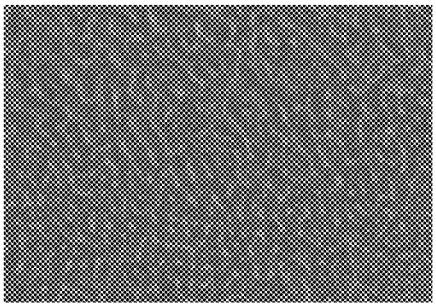
Figure 34F:
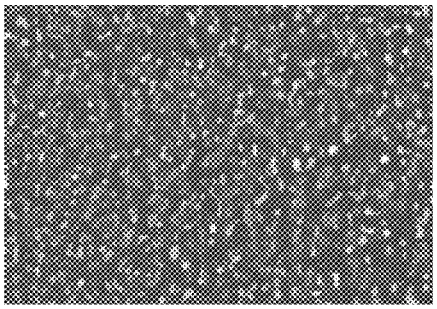
Figure 34G:
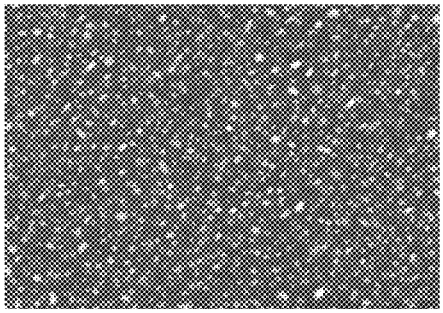

Additional results showing the ability of the disclosed alloys to avoid substantial coarsening are illustrated by FIGS. 34A-34G. FIGS. 34A and 34B show the effective coarsening of Al—Si alloys after exposure to 540° C. for 8 hours. FIGS. 34C and 34D show the non-coarsening behavior of Al—Ce alloys after exposure to 540° C. for 8 hours. FIGS. 34E and 34G show the microstructure of rapidly cooled Al—Ce alloys in the as-produced, after exposure to 300° C. for 200 hours, and 400° C. for 200 hours, respectively. The lack of coarsening is apparent for Al—Ce alloys in both the slow cooled (FIGS. 34C and 34D) and very rapidly cooled states (FIGS. 34F and 34G).

In view of the many possible embodiments to which the principles of the present disclosure may be applied, it should be recognized that the illustrated embodiments are only preferred examples and should not be taken as limiting. Rather, the scope is defined by the following claims. We therefore claim as our invention all that comes within the scope and spirit of these claims.

We claim:

1. A method, comprising:

combining aluminum with (i) 0.1 wt % to 8 wt % of an additional alloying element selected from magnesium, zinc, titanium, manganese, zirconium, vanadium, scandium, copper, or nickel, or one or more of magnesium, zinc, titanium, manganese, zirconium, vanadium, and scandium in combination with copper or in combination with nickel; (ii) at least one rare earth component selected from lanthanum, cerium, mischmetal, or a combination thereof; and (iii) 0.1 wt % to 2 wt % of an additive component selected from iron, strontium, boron, manganese, titanium, chromium, cobalt, carbon, or a combination thereof to form an aluminum-based alloy composition; wherein the aluminum-based alloy composition does not comprise both copper and nickel in combination; and performing a cooling step, wherein the mixed aluminum-based alloy composition is cooled at an average cooling rate range from greater than 100 K/s to $10^8$ K/s to provide an aluminum-based alloy comprising an aluminum matrix phase, an $Al_{11}X_3$ intermetallic phase where X is one of lanthanum, cerium, or mischmetal, or a combination thereof, and (i) a semi- to fully-eutectic phase with a maximum spacing between morphologic features of the semi- to fully-eutectic phase being no greater than 8 μm; or (ii) a phase comprising laths and/or rods, wherein the aluminum matrix phase, the $Al_{11}X_3$ intermetallic phase, and the semi- to fully-eutectic phase, or the phase comprising laths and/or rods are obtained without a heat treatment; provided that the cooling step does not comprise continuous cast rolling to cool the mixed aluminum-based alloy composition.

2. The method of claim 1, wherein the average cooling rate ranges from 1000 K/s to $10^5$ K/s.

3. The method of claim 1, wherein the average cooling rate ranges from greater than $10^5$ K/s to $10^8$ K/s.

4. The method of claim 1, wherein the aluminum-based alloy comprises 8 wt % to 12 wt % of the at least one rare earth component and wherein the at least one rare earth component is cerium.

5. The method of claim 1, wherein the aluminum-based alloy comprises an $Al_{13}(Mg,Ce)_2$ phase, an $Al_{12}CeMg_6$ phase, an FCC matrix phase comprising aluminum and cerium, or any combination of such phases.

6. The method of claim 1, wherein the aluminum-based alloy consists essentially of 12 wt % cerium, 0.4 wt % magnesium, 1 wt % iron, and a balance of aluminum.

7. The method of claim 1, wherein the semi- to fully-eutectic phase has a maximum spacing between morphologic features ranging from greater than 0 μm to less than or equal to 5 μm.

8. The method of claim 1, wherein the method does not comprise a post-processing heat treatment.

9. The method of claim 1, wherein the aluminum-based alloy does not exhibit substantial coarsening of the semi- to fully-eutectic microstructure such that an increase in average spacing of lamellae and/or particles within the semi- to fully-eutectic microstructure does not occur after being exposed to processing temperatures of 150° C. to 500° C. for 1500 hours.

10. The method of claim 1, wherein the aluminum-based alloy composition consists of aluminum, the additional alloying element, the at least one rare earth component, the additive component, and trace impurities.

11. The method of claim 1, wherein the average cooling rate ranges from greater than 100 K/s to less than 1000 K/s.

* * * * *